US011378904B2

(12) United States Patent
Seki

(10) Patent No.: US 11,378,904 B2
(45) Date of Patent: Jul. 5, 2022

(54) IMAGE FORMING APPARATUS AND HEATING DEVICE COMPRISING PLURAL PRESSING DEVICES CONFIGURED TO GENERATE DIFFERENT PRESSING FORCES

(71) Applicant: Takayuki Seki, Kanagawa (JP)

(72) Inventor: Takayuki Seki, Kanagawa (JP)

(73) Assignee: Ricoh Company, LTD., Tokyo (JP)

( * ) Notice: Subject to any disclaimer, the term of this patent is extended or adjusted under 35 U.S.C. 154(b) by 0 days.

(21) Appl. No.: 17/087,961

(22) Filed: Nov. 3, 2020

(65) Prior Publication Data

US 2021/0165350 A1 Jun. 3, 2021

(30) Foreign Application Priority Data

Nov. 29, 2019 (JP) ..... JP2019-216897

(51) Int. Cl.
*G03G 15/20* (2006.01)

(52) U.S. Cl.
CPC ..... *G03G 15/2053* (2013.01); *G03G 15/2064* (2013.01); *G03G 2215/2009* (2013.01); *G03G 2215/2032* (2013.01)

(58) Field of Classification Search
CPC ..... G03G 15/2064; G03G 15/2042
See application file for complete search history.

(56) References Cited

U.S. PATENT DOCUMENTS

| | | | | |
|---|---|---|---|---|
| 8,170,435 | B2 * | 5/2012 | Ueno | G03G 15/2064 399/67 |
| 8,755,733 | B2 * | 6/2014 | Ehara | G03G 15/205 399/400 |
| 9,354,570 | B2 * | 5/2016 | Arimoto | G03G 15/2053 |
| 2016/0238975 | A1 | 8/2016 | Seki et al. | |
| 2017/0185020 | A1 | 6/2017 | Seki et al. | |
| 2017/0185021 | A1 | 6/2017 | Seki et al. | |
| 2017/0255147 | A1 | 9/2017 | Seki et al. | |
| 2017/0364000 | A1 | 12/2017 | Seki et al. | |
| 2018/0173138 | A1 | 6/2018 | Seki et al. | |

(Continued)

FOREIGN PATENT DOCUMENTS

| | | |
|---|---|---|
| JP | 2005-114959 | 4/2005 |
| JP | 2010-250228 | 11/2010 |

(Continued)

*Primary Examiner* — Arlene Heredia
(74) *Attorney, Agent, or Firm* — Harness, Dickey & Pierce, PLC

(57) ABSTRACT

A heating device includes a rotator, an opposed rotator configured to contact the rotator to form a nip, a heater configured to heat the rotator, and a plurality of pressing devices. The heater includes a first portion and a second portion. The second portion of the heater generates a smaller amount of heat than the first portion of the heater. The pressing devices are arranged in a longitudinal direction of the heater and each configured to press at least one of the rotator and the opposed rotator and cause the rotator and the opposed rotator to press each other. The pressing devices include a first pressing device corresponding to the first portion of the heater and a second pressing device corresponding to the second portion of the heater, and the first pressing device generates a smaller pressing force than the second pressing device.

19 Claims, 31 Drawing Sheets

(56) References Cited

U.S. PATENT DOCUMENTS

| | | | |
|---|---|---|---|
| 2020/0174408 | A1 | 6/2020 | Furuichi et al. |
| 2020/0209791 | A1 | 7/2020 | Seki |
| 2020/0249604 | A1 | 8/2020 | Adachi et al. |
| 2020/0285179 | A1 | 9/2020 | Seki |
| 2020/0292973 | A1 | 9/2020 | Furuichi et al. |
| 2021/0286303 | A1* | 9/2021 | Yamazaki ..... G03G 15/2053 |

FOREIGN PATENT DOCUMENTS

| | | |
|---|---|---|
| JP | 2016-062024 | 4/2016 |
| JP | 2016-114914 | 6/2016 |
| JP | 2017-173581 | 9/2017 |

* cited by examiner

| | FIRST BLOCK | SECOND BLOCK | THIRD BLOCK | FOURTH BLOCK | FIFTH BLOCK | SIXTH BLOCK | SEV-ENTH BLOCK |
|---|---|---|---|---|---|---|---|
| HEAT GENERATION AMOUNT OF FIRST POW-ER SUPPLY LINE 62A | 10000 | 6400 | 3600 | 1600 | 400 | — | — |
| HEAT GENERATION AMOUNT OF SECOND POWER SUPPLY LINE 62B | — | 25 | 255 | 1225 | 3025 | 5625 | 9025 |
| HEAT GENERATION AMOUNT OF FOURTH POWER SUPPLY LINE 62D | 25 | 25 | 25 | 25 | 25 | 25 | — |
| TOTAL HEAT GENERATION AMOUNT | 10025 | 6450 | 3850 | 2850 | 3450 | 5650 | 9025 |

| | FIRST BLOCK | SECOND BLOCK | THIRD BLOCK | FOURTH BLOCK | FIFTH BLOCK | SIXTH BLOCK | SEV-ENTH BLOCK |
|---|---|---|---|---|---|---|---|
| HEAT GENERATION AMOUNT OF FIRST POW-ER SUPPLY LINE 62A | 10000 | 6400 | 3600 | 1600 | 400 | — | — |
| HEAT GENERATION AMOUNT OF SECOND POWER SUPPLY LINE 62B | — | 400 | 1600 | 3600 | 6400 | 10000 | 14400 |
| HEAT GENERATION AMOUNT OF FOURTH POWER SUPPLY LINE 62D | 400 | 400 | 400 | 400 | 400 | 400 | — |
| TOTAL HEAT GENERATION AMOUNT | 10400 | 7200 | 5600 | 5600 | 7200 | 10400 | 14400 |

| | FIRST BLOCK | SECOND BLOCK | THIRD BLOCK | FOURTH BLOCK | FIFTH BLOCK | SIXTH BLOCK | SEV~ ENTH BLOCK |
|---|---|---|---|---|---|---|---|
| HEAT GENERATION AMOUNT OF FIRST POW ~ER SUPPLY LINE 62A | 10000 | 6400 | 3200 | 1600 | — | — | — |
| HEAT GENERATION AMOUNT OF SECOND POWER SUPPLY LINE 62B | — | 25 | 225 | 1225 | 3025 | 5625 | 9025 |
| HEAT GENERATION AMOUNT OF FOURTH POWER SUPPLY LINE 62D | 25 | 25 | 25 | 25 | 25 | 25 | 25 |
| HEAT GENERATION AMOUNT OF FIFTH POWER SUPPLY LINE 62E | 10000 | 10000 | 10000 | 10000 | 10000 | 10000 | 10000 |
| TOTAL HEAT GENERATION AMOUNT | 20025 | 16450 | 13450 | 12850 | 13050 | 15650 | 19050 |

| | FIRST BLOCK | SECOND BLOCK | THIRD BLOCK | FOURTH BLOCK | FIFTH BLOCK | SIXTH BLOCK | SEV-ENTH BLOCK |
|---|---|---|---|---|---|---|---|
| HEAT GENERATION AMOUNT OF FIRST POW-ER SUPPLY LINE 62A | 10000 | 6400 | 3200 | 1600 | 400 | — | — |
| HEAT GENERATION AMOUNT OF SECOND POWER SUPPLY LINE 62B | — | 400 | 1600 | 3600 | 6400 | 10000 | 14400 |
| HEAT GENERATION AMOUNT OF FOURTH POWER SUPPLY LINE 62D | 400 | 400 | 400 | 400 | 400 | 400 | 400 |
| HEAT GENERATION AMOUNT OF FIFTH POWER SUPPLY LINE 62E | 19600 | 19600 | 19600 | 19600 | 19600 | 19600 | 19600 |
| TOTAL HEAT GENERATION AMOUNT | 30000 | 26800 | 24800 | 25200 | 26800 | 30000 | 34400 |

IMAGE FORMING APPARATUS AND HEATING DEVICE COMPRISING PLURAL PRESSING DEVICES CONFIGURED TO GENERATE DIFFERENT PRESSING FORCES

CROSS-REFERENCE TO RELATED APPLICATION

This patent application is based on and claims priority pursuant to 35 U.S.C. § 119 to Japanese Patent Application No. 2019-216897 filed on Nov. 29, 2019 in the Japan Patent Office, the entire disclosure of which is hereby incorporated by reference herein.

BACKGROUND

Technical Field

Embodiments of the present disclosure generally relate to a heating device and an image forming apparatus.

Background Art

The image forming apparatuses often include a heating device. One example of the heating device is a fixing device that fixes toner onto a recording medium under heat. Another example of the heating device is a drying device that dries ink on a recording medium.

SUMMARY

This specification describes a heating device that includes a rotator, an opposed rotator configured to contact the rotator to form a nip, a heater configured to heat the rotator, and a plurality of pressing devices. The heater includes a first portion and a second portion. The second portion of the heater generates a smaller amount of heat than the first portion of the heater. The pressing devices are arranged in a longitudinal direction of the heater and each configured to press at least one of the rotator and the opposed rotator and cause the rotator and the opposed rotator to press each other. The pressing devices include a first pressing device corresponding to the first portion of the heater and a second pressing device corresponding to the second portion of the heater, and the first pressing device generates a smaller pressing force than the second pressing device.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIG. 7 is a plan view of a heater incorporated in the heating unit depicted in

FIG. 5;

Figure 1:
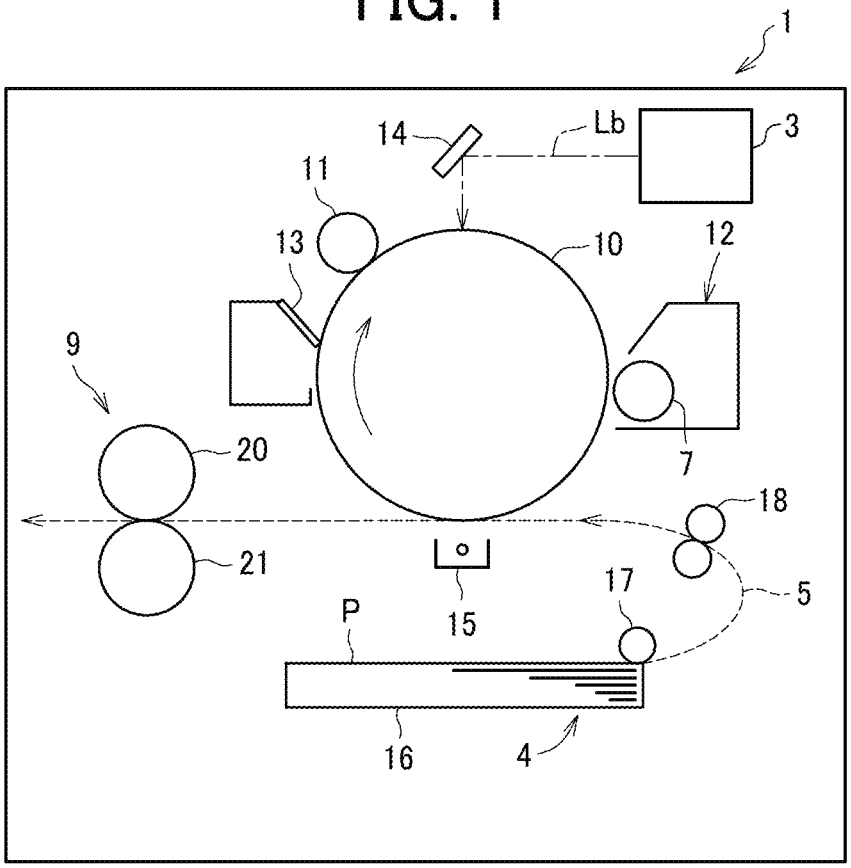
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure, and all of the components or elements described in the embodiments of this disclosure are not necessarily indispensable.

Referring to the drawings, embodiments of the present disclosure are described below. Identical reference numerals are assigned to identical components or equivalents and a description of those components is simplified or omitted. In the following description of each embodiment, a fixing device that fixes a toner image onto a sheet by heat is described as an example of a heating device.

A monochrome image forming apparatus 1 illustrated in FIG. 1 includes a photoconductor drum 10. The photoconductor drum 10 is a drum-shaped rotator that bears toner as a developer of a toner image on an outer circumferential surface of the photoconductor drum 10 and rotates in a direction indicated by arrow in FIG. 1. Around the photoconductor drum 10, the image forming apparatus 1 includes a charging roller 11, a developing device 12, and a cleaning blade 13. The charging roller 11 uniformly charges the surface of the photoconductor drum 10. The developing device 12 includes a developing roller 7 that supplies toner to the surface of the photoconductor drum 10. The cleaning blade 13 cleans the surface of the photoconductor drum 10.

In addition, the image forming apparatus 1 includes an exposure device 3. The exposure device 3 irradiates the surface of the photoconductor drum 10 with a laser light Lb based on image data via a mirror 14.

The image forming apparatus 1 includes a transfer device 15 including a transfer charger opposite the photoconductor drum 10. The transfer device 15 transfers the toner image on the surface of the photoconductor drum 10 to a sheet P.

A sheet feeder 4 is disposed in a lower portion of the image forming apparatus 1. The sheet feeder 4 includes a sheet tray 16 and a sheet feeding roller 17. Downstream from the sheet feeding roller 17 in a sheet conveyance direction, registration rollers 18 are disposed. The sheet tray 16 accommodates sheets P as recording media. The sheet feeding roller 17 conveys the sheet P from the sheet tray 16 to a conveyance path 5.

The fixing device 9 includes a fixing belt 20, a pressure roller 21, and a heater described below. The heater heats the fixing belt 20. The pressure roller 21 presses the fixing belt 20.

Next, a description is given of a basic operation of the image forming apparatus 1 with reference to FIG. 1.

At the beginning of a print operation (i.e. an image forming operation), the photoconductor drum 10 rotates, and the charging roller 11 charges the surface of the photoconductor drum 10. Subsequently, the exposure device 3 irradiates the photoconductor drum 10 with the laser light Lb based on the image data. An electric potential at the position of the photoconductor drum 10 that receives the laser light Lb decreases, and an electrostatic latent image is formed on the surface of the photoconductor drum 10. The developing device 12 supplies toner to the surface of the photoconductor drum 10 on which the electrostatic latent image is formed. As a result, the electrostatic latent image is visualized as a toner image (i.e. a developer image). The transfer device 15 transfers the toner image onto the sheet P, and the cleaning blade 13 removes the toner remaining on the photoconductor drum 10.

On the other hand, as the printing operation starts, the sheet feeding roller 17 of the sheet feeder 4 disposed in the lower portion of the image forming apparatus 1 is driven and rotated to feed the sheet P from the sheet tray 16 toward the registration rollers 18 through the conveyance path 5.

The registration rollers 18 convey the sheet P sent to the conveyance path 5 to a transfer portion, timed to coincide with the toner image on the photoconductor drum 10. The transfer portion is a portion at which the transfer device 15 faces the photoconductor drum 10. A transfer bias is applied between the transfer device 15 and the photoconductor drum 10, and the transfer device 15 transfers the toner image onto the sheet P.

The sheet P bearing the toner image is conveyed to the fixing device 9. The heated fixing belt 20 and the pressure roller 21 heat and press the sheet P. As a result, the toner image is fixed on the sheet P. The sheet P bearing the fixed toner image thereon is separated from the fixing belt 20, conveyed by a conveyance roller pair disposed downstream from the fixing device 9, and ejected to an output tray disposed outside the image forming apparatus 1.

Next, a configuration of the fixing device 9 is described.

Figure 2:
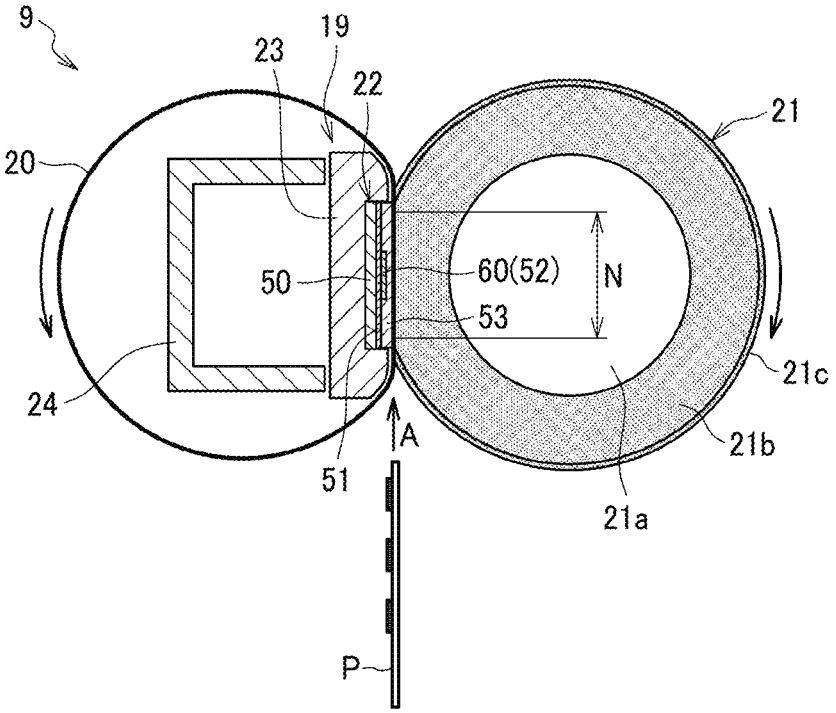
FIG. 2 is a schematic cross-sectional view of a fixing device incorporated in the image forming apparatus depicted in FIG. 1.

As illustrated in FIG. 2, the fixing device 9 according to the present embodiment includes a fixing belt 20 as a fixing rotator, a pressure roller 21 as an opposed rotator or a pressure rotator, and a heating unit 19. The pressure roller 21 contacts the outer circumferential surface of the fixing belt 20 to form a nip N. The heating unit 19 heats the fixing belt 20. The heating unit 19 includes a laminated heater 22 as a heater, a heater holder 23 as a holder to hold the heater 22, and a stay 24 as a supporter to support the heater holder 23.

The fixing belt 20 is an endless belt. The fixing belt 20 has a tubular base layer and a release layer. The tubular base layer is made of, for example, polyimide (PI) and has an outer diameter of 25 mm and a thickness of 40 to 120 μm. The release layer is formed as the outermost surface layer of the fixing belt. The release layer is formed of a fluorine-based resin such as PFA or PTFE and has a thickness of 5 to 50 μm to enhance durability of the fixing belt 20 and facilitate separation of the sheet P and a foreign substance from the fixing belt 20. Optionally, an elastic layer that is made of rubber or the like and has a thickness in a range of from 50 micrometers to 500 micrometers may be interposed between the base layer and the release layer. The base layer of the fixing belt 20 may be made of heat resistant resin such as polyetheretherketone (PEEK) or metal such as nickel (Ni) or stainless steel (SUS), instead of polyimide. An inner circumferential surface of the fixing belt 20 may be coated with polyimide, PTFE, or the like to produce a slide layer.

The pressure roller 21 has an outer diameter of 25 mm, for example. The pressure roller 21 includes a core 21*a*, an elastic layer 21*b*, and a release layer 21*c*. The core 21*a* is a solid core made of iron. The elastic layer 21*b* coats the circumferential surface of the core 21*a*. The release layer 21*c* coats an outer circumferential surface of the elastic layer 21*b*. The elastic layer 21*b* is made of silicone rubber and has a thickness of 3.5 mm, for example. In order to facilitate separation of the sheet P and the foreign substance from the pressure roller 21, the release layer 21*c* that is made of fluororesin and has a thickness of about 40 micrometers, for example, is preferably disposed on the outer surface of the elastic layer 21*b*.

The pressing device described below presses the fixing belt 20 against the pressure roller 21, and the fixing belt 20 contacts and presses the pressure roller 21. Thus, the fixing nip N is formed between the fixing belt 20 and the pressure roller 21. In addition, the pressure roller 21 functions as a drive roller. That is, the pressure roller 21 receives a driving force from a motor disposed in the main body of the image forming apparatus 1 and rotates. The fixing belt 20 is driven and rotated by the pressure roller 21 as the pressure roller 21 rotates. When the fixing belt 20 rotates, the fixing belt 20 slides on the heater 22. In order to facilitate sliding performance of the fixing belt 20, a lubricant such as oil or grease may be interposed between the heater 22 and the fixing belt 20.

The heater 22 extends in a longitudinal direction thereof throughout an entire width of the fixing belt 20 in a rotation axis direction of the fixing belt 20, referred to as a longitudinal direction of the fixing belt 20 below. The heater 22 contacts the inner circumferential surface of the fixing belt 20 at a position corresponding to the pressure roller 21. The heater 22 heats the fixing belt 20 as a heated member to a predetermined fixing temperature.

The heater 22 has a base 50 and a heat generator 60. In the present embodiment, the heat generator 60 is disposed on the base 50 to face the fixing belt 20. Alternatively, the heat generator 60 may be disposed on a surface of the base 50 facing the heater holder 23, that is, the surface opposite to a surface of the base 50 facing the fixing belt 20. In that case, since the heat of the heat generator 60 is transmitted to the fixing belt 20 through the base 50, it is preferable that the base 50 be made of a material with high thermal conductivity such as aluminum nitride. In the heater 22 according to the present embodiment, another insulation layer may be further disposed on a surface of the base 50 facing the heater holder 23, that is, the surface opposite to the surface of the base 50 facing the fixing belt 20.

The heater 22 may not contact the fixing belt 20 or may be disposed opposite the fixing belt 20 indirectly via a low-friction sheet or the like. However, the heater 22 that contacts the fixing belt 20 directly as in the present embodiment enhances conduction of heat from the heater 22 to the fixing belt 20. The heater 22 may contact the outer circumferential surface of the fixing belt 20. However, if the outer circumferential surface of the fixing belt 20 is brought into contact with the heater 22 and damaged, the fixing belt 20 may degrade quality of fixing the toner image on the sheet P. Hence, preferably, the heater 22 contacts the inner circumferential surface of the fixing belt 20.

The heater holder 23 and the stay 24 are disposed inside the inner circumferential surface of the fixing belt 20. The stay 24 is configured by a channeled metallic member, and both side plates of the fixing device 9 support both end portions of the stay 24. The stay 24 supports a stay side face of the heater holder 23, that faces the stay 24 and is opposite a heater side face of the heater holder 23. Accordingly, the stay 24 retains the heater 22 and the heater holder 23 to be immune from being bent substantially by pressure from the pressure roller 21, forming the fixing nip N between the fixing belt 20 and the pressure roller 21.

Since the heater holder 23 is subject to temperature increase by heat from the heater 22, the heater holder 23 is preferably made of a heat-resistant material. For example, the heater holder 23 made of heat-resistant resin having low thermal conduction, such as a liquid crystal polymer (LCP), reduces heat transfer from the heater 22 to the heater holder 23 and provides efficient heating of the fixing belt 20.

As a print job starts, the heater 22 supplied with power causes the heat generator 60 to generate heat, thus heating the fixing belt 20. The motor drives and rotates the pressure roller 21, and the fixing belt 20 starts rotating with the rotation of the pressure roller 21. When the temperature of the fixing belt 20 reaches a predetermined target temperature called a fixing temperature, as illustrated in FIG. 2, the sheet P bearing an unfixed toner image is conveyed to the nip N between the fixing belt 20 and the pressure roller 21 in a direction indicated by arrow A in FIG. 2, and the unfixed toner image is heated and pressed onto the sheet P and fixed thereon.

Figure 3:
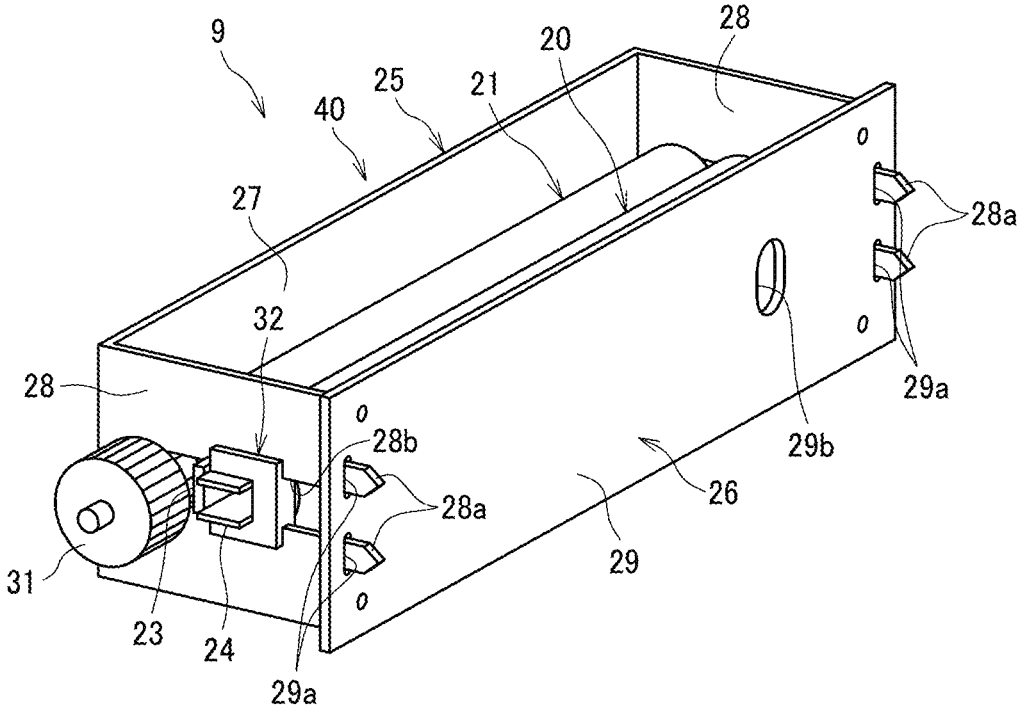
FIG. 3 is a perspective view of the fixing device depicted in FIG. 2.
Figure 4:
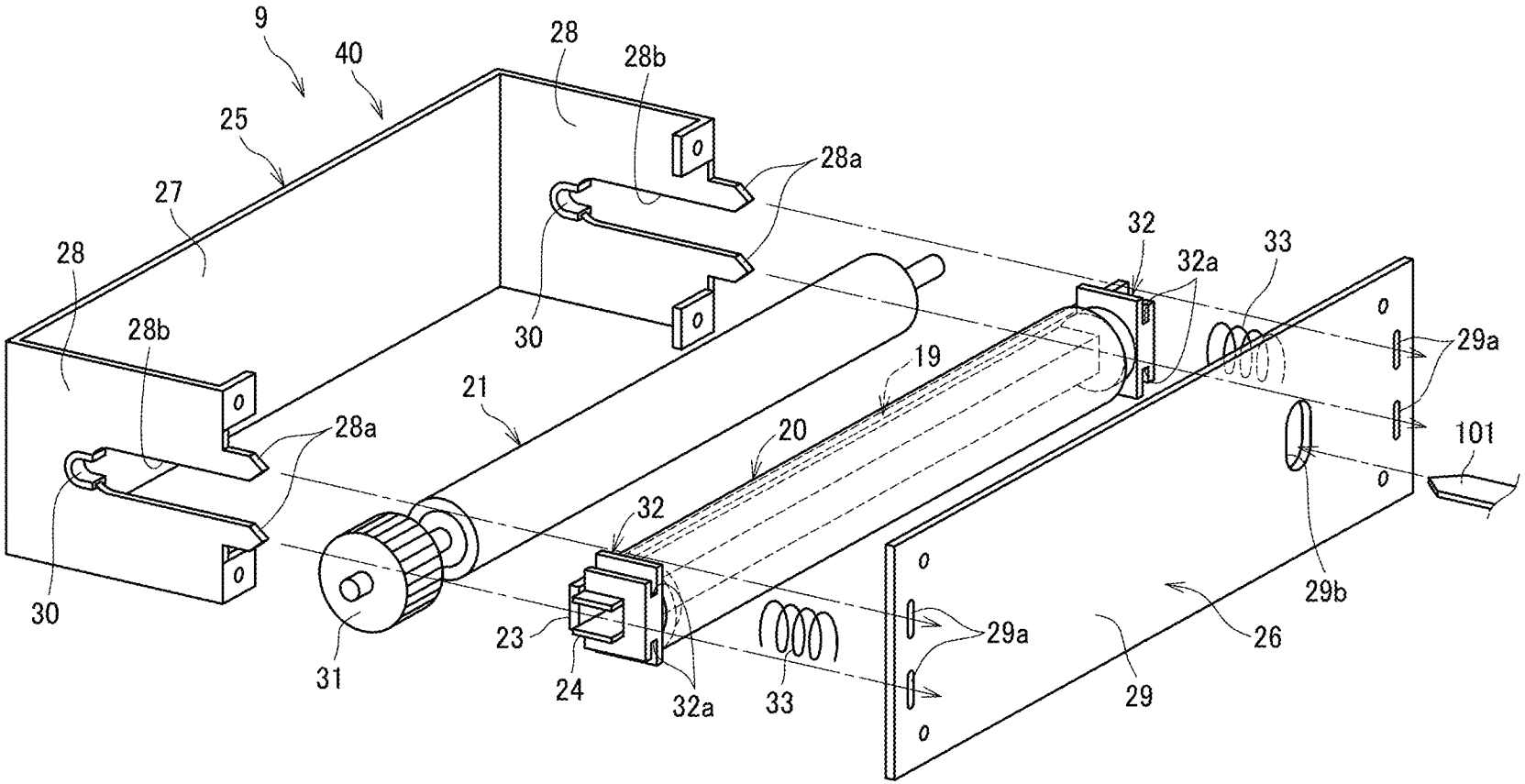
FIG. 4 is an exploded perspective view of the fixing device depicted in FIG. 2.

FIG. 3 is a perspective view of the fixing device 9. FIG. 4 is an exploded perspective view of the fixing device 9.

As illustrated in FIGS. 3 and 4, the fixing device 9 includes a device frame 40 that includes a first device frame 25 and a second device frame 26. The first device frame 25 includes a pair of side walls 28 and a front wall 27. The second device frame 26 includes a rear wall 29. The pair of side walls 28 are disposed at one side and another side of the fixing belt 20, respectively, in the longitudinal direction of the fixing belt 20. The side walls 28 support both sides of each of the pressure roller 21 and the heating unit 19, respectively. Each of the side walls 28 includes a plurality of engaging projections 28*a*. As the engaging projections 28*a* engage corresponding coupling holes 29*a* in the rear wall 29, the first device frame 25 is coupled to the second device frame 26.

Each of the side walls 28 includes a slot 28*b* through which a rotation shaft and the like of the pressure roller 21 are inserted. The slot 28*b* opens toward the rear wall 29 and closes at a portion opposite the rear wall 29, and the portion of the slot 28*b* opposite the rear wall 29 serves as a contact portion. A bearing 30 that supports the rotation shaft of the pressure roller 21 is disposed at an end of the contact portion. As both sides of the rotation shaft of the pressure roller 21 are attached to the corresponding bearings 30, the side walls 28 rotatably support the pressure roller 21.

A driving force transmission gear 31 serving as a driving force transmitter is disposed at an axial end side of the rotation shaft of the pressure roller 21. In a state in which the side walls 28 support the pressure roller 21, the driving force transmission gear 31 is exposed outside the side wall 28. Accordingly, when the fixing device 9 is installed in the body of the image forming apparatus 1, the driving force transmission gear 31 is coupled to a gear disposed inside the body of the image forming apparatus 1 so that the driving force transmission gear 31 transmits the driving force from the driver to the pressure roller 21. Alternatively, a driving force transmitter to transmit the driving force to the pressure roller 21 may be pulleys over which a driving force transmission belt is stretched taut, a coupler, and the like instead of the driving force transmission gear 31.

A pair of flanges 32 that support the fixing belt 20, the heater holder 23, the stay 24, and the like is disposed at both sides of the heating unit 19 in a longitudinal direction thereof, respectively. Each flange 32 has a guide groove 32*a*. As edges of the slot 28*b* of the side wall 28 enter the guide grooves 32*a*, respectively, the flange 32 is attached to the side wall 28.

A pair of springs 33 serving as a pair of biasing members contact flanges 32, respectively. As the springs 33 bias the flanges 32 and the stay 24 toward the pressure roller 21, respectively, the fixing belt 20 is pressed against the pressure roller 21 to form the fixing nip between the fixing belt 20 and the pressure roller 21. A pressure lever described below presses the end of the spring 33 on the side opposite to the side in contact with the flange 32.

As illustrated in FIG. 4, a hole 29*b* is disposed near one end of the rear wall 29 of the second device frame 26 in a longitudinal direction of the second device frame 26. The hole 29*b* serves as a positioner of the fixing device 9 that positions the body of the fixing device 9 with respect to the body of the image forming apparatus 100. Similarly, the body of the image forming apparatus 1 includes a projection 101 as a positioner fixed on the image forming apparatus 1. The projection 101 is inserted into the hole 29*b* of the fixing device 9. Accordingly, the projection 101 engages the hole 29*b*, positioning the body of the fixing device 9 with respect to the body of the image forming apparatus 1 in the longitudinal direction of the fixing belt 20. Note that although the hole 29*b* serving as the positioner is disposed at one side of the rear wall 29 in the longitudinal direction of the second device frame 26, a positioner is not disposed at another side of the rear wall 29. Thus, the second device frame 26 does not restrict thermal expansion and shrinkage of the body of the fixing device 9 in the longitudinal direction of the fixing belt 20 due to temperature change.

Figure 5:
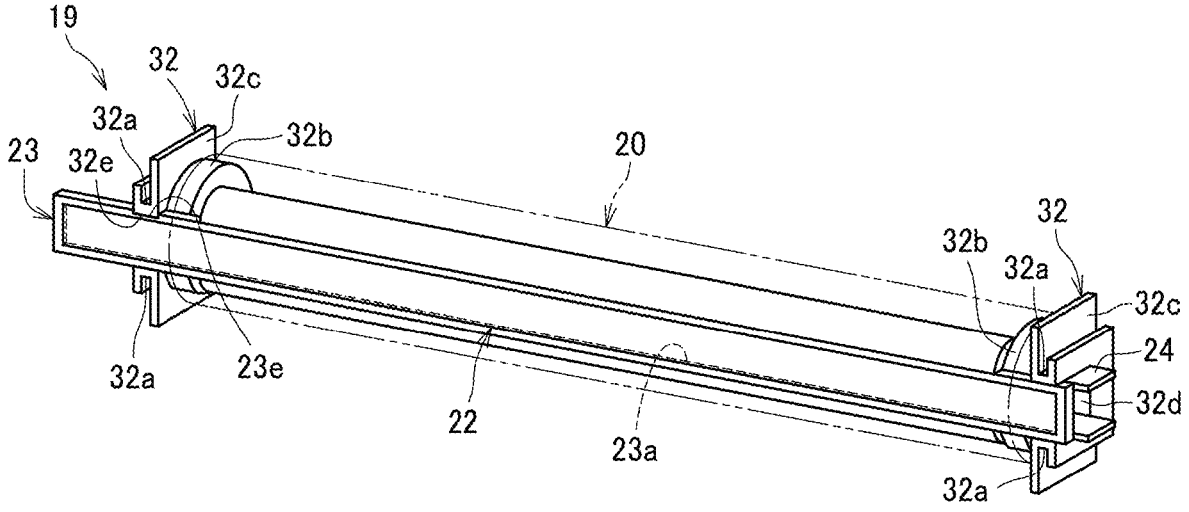
FIG. 5 is a perspective view of a heating unit incorporated in the fixing device depicted in FIG. 2.
Figure 6:
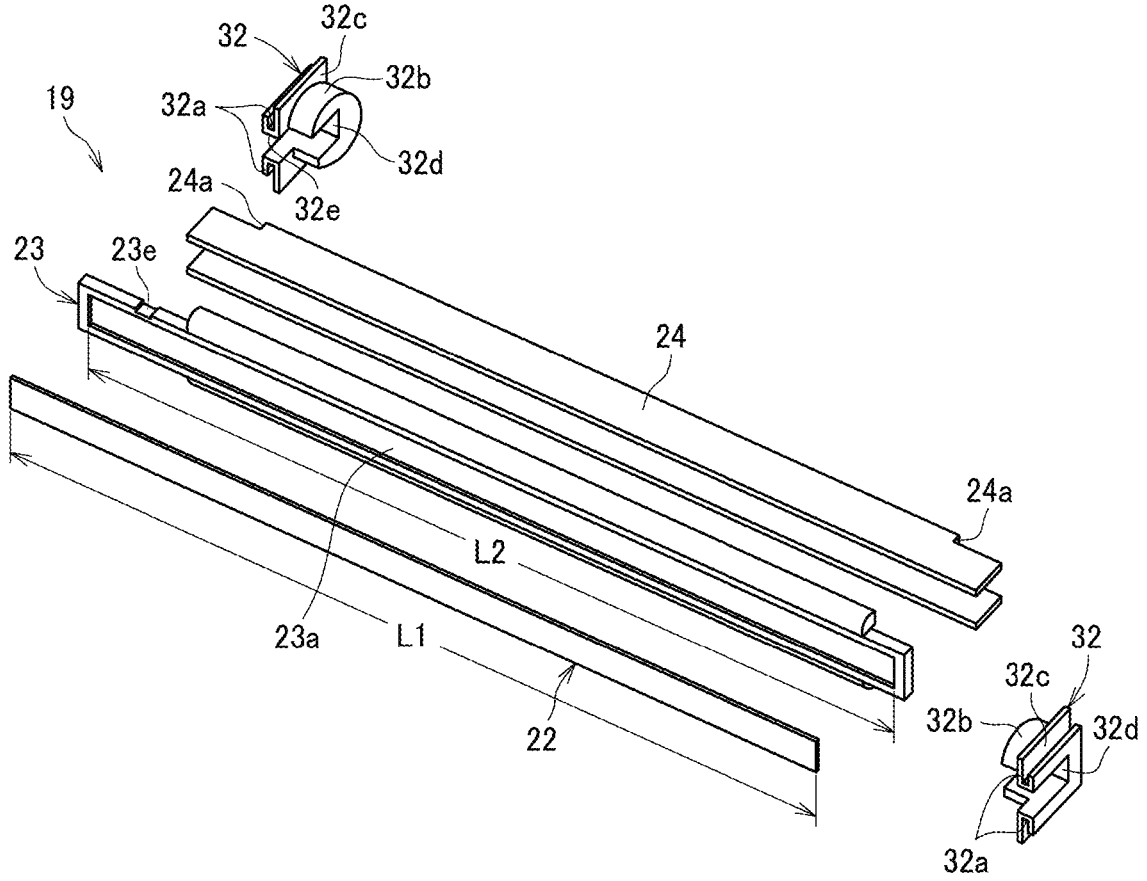
FIG. 6 is an exploded perspective view of the heating unit depicted in FIG. 5.

FIG. 5 is a perspective view of the heating unit 19. FIG. 6 is an exploded perspective view of the heating unit 19.

As illustrated in FIGS. 5 and 6, the heater holder 23 includes an accommodating recess 23*a* disposed on a fixing belt side face of the heater holder 23, that is a face in front side of FIGS. 5 and 6. The accommodating recess 23*a* is rectangular and accommodates the heater 22. The accommodating recess 23*a* has a similar shape and size of the heater 22, but a length L2 of the accommodating recess 23*a* in the longitudinal direction of the heater holder 23 is set slightly longer than a length L1 of the heater 22 in the longitudinal direction of the heater 22. The accommodating recess 23*a* formed slightly longer than the heater 22 does not interfere the heater 22 even when the heater 22 expands in the longitudinal direction due to thermal expansion. The accommodating recess 23*a* accommodates the heater 22, and a connector as power supplying member described below sandwiches the heater 22 and the heater holder 23, thus the heater 22 is held by the connector.

In addition to the guide grooves 32*a* described above, each of the pair of flanges 32 includes a belt support 32*b*, a belt restrictor 32*c*, and a supporting recess 32*d*. The belt support 32*b* is C-shaped and inserted into the loop of the fixing belt 20, thus contacting the inner circumferential surface of the fixing belt 20 to support the fixing belt 20. The belt restrictor 32*c* contacts an edge face of the fixing belt 20 to restrict motion (e.g., skew) of the fixing belt 20 in the longitudinal direction of the fixing belt 20. The supporting recess 32*d* is inserted with a lateral end of each of the heater holder 23 and the stay 24 in the longitudinal direction thereof, thus the flanges 32 support the heater holder 23 and the stay 24. The belt supports 32*b* inserted into the inner periphery of the fixing belt 20 in both ends support the fixing belt 20 in a state in which the fixing belt 20 is not tensioned in a circumferential direction thereof while the fixing belt 20 does not rotate, that is, by a free belt system.

As illustrated in FIGS. 5 and 6, the heater holder 23 includes a positioning recess 23*e* as a positioner disposed at one side of the heater holder 23 in the longitudinal direction thereof. The flange 32 further includes an engagement 32*e* illustrated in a left part in FIGS. 5 and 6. The engagement 32*e* engages the positioning recess 23*e*, positioning the heater holder 23 with respect to the flange 32 in the longitudinal direction of the fixing belt 20. The flange 32 illustrated in right parts in FIGS. 5 and 6 does not include the engagement 32*e* and therefore the heater holder 23 is not positioned with respect to the flange 32 in the longitudinal direction of the fixing belt 20. Positioning the heater holder 23 with respect to the flange 32 at one side of the heater holder 23 in the longitudinal direction of the fixing belt 20 does not restrict an expansion and contraction of the heater holder 23 in the longitudinal direction of the fixing belt 20 due to a temperature change.

As illustrated in FIG. 6, the stay 24 includes step portions 24*a* at both ends in the longitudinal direction of the stay 24 to set the stay 24 in the flanges 32. Each step portion 24*a* abuts the flange 32 to restrict movement of the stay 24 in the longitudinal direction with respect to the flange 32. However, at least one of the step portions 24*a* is arranged to have a gap, that is, loose fit with play between the step portion 24*a* and the flange 32. The above-described arrangement of the gap between the flange 32 and at least one of the step portions 24*a* enables an expansion and contraction of the stay 24 in the longitudinal direction of the fixing belt 20 due to the temperature change.

Figure 7:
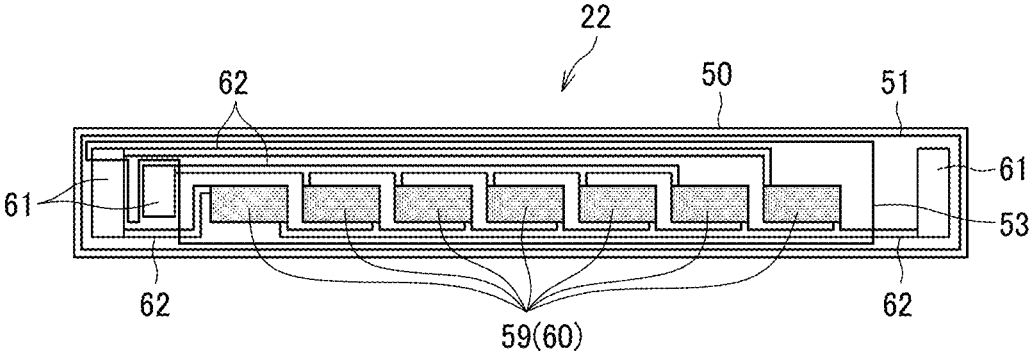
Figure 8:
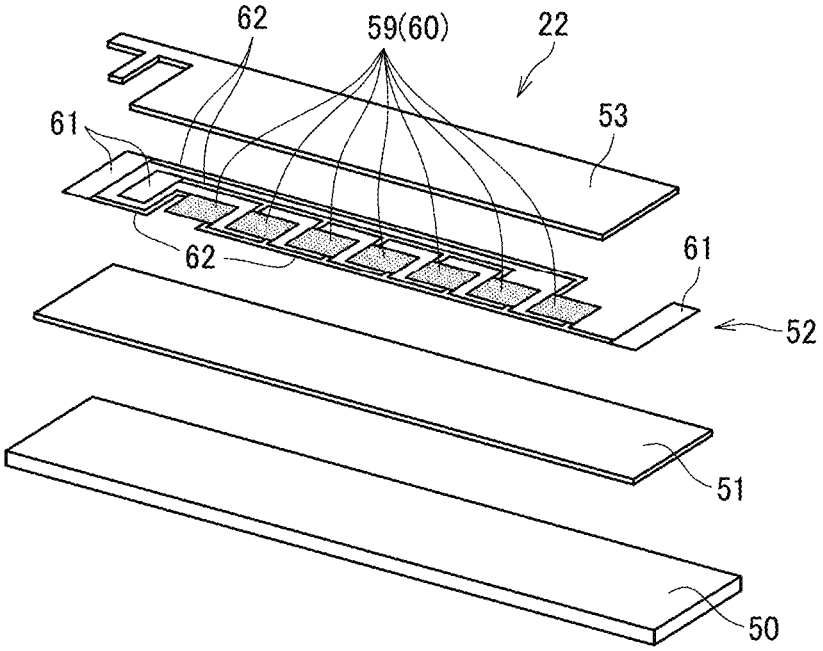
FIG. 8 is an exploded perspective view of the heater depicted in FIG. 7.

FIG. 7 is a plan view of the heater 22. FIG. 8 is an exploded perspective view of the heater 22.

As illustrated in FIG. 8, the heater 22 includes the base 50, a first insulation layer 51 disposed on the base 50, a conductor layer 52 disposed on the first insulation layer 51, and a second insulation layer 53 that covers the conductor layer 52. The conductor layer 52 includes the heat generator 60. In the present embodiment, the base 50, the first insulation layer 51, the conductor layer 52 including the heat generator 60, and the second insulation layer 53 are layered in this order toward the fixing belt 20, that is, the nip N. Heat generated from the heat generator 60 is transmitted to the fixing belt 20 via the second insulation layer 53 (see FIG. 2).

The base 50 is a long plate made of a metal such as stainless steel (SUS), iron, or aluminum. The base 50 may be made of ceramic, glass, etc. instead of metal. If the base 50 is made of an insulating material such as ceramic, the first insulation layer 51 sandwiched between the base 50 and the conductor layer 52 may be omitted. Since metal has an excellent durability when it is rapidly heated and is processed readily, using metal to make the base 50 reduces the manufacturing cost of the base 50. Among metals, aluminum and copper are preferable for the material of the base 50 because aluminum and copper have high thermal conductivity and are less likely to cause uneven temperature. Stainless steel is advantageous because stainless steel is manufactured at reduced costs compared to aluminum and copper.

The first insulation layer 51 and the second insulation layer 53 are made of material having electrical insulation, such as heat-resistant glass. Alternatively, each of the first insulation layer 51 and the second insulation layer 53 may be made of ceramic, polyimide (PI), or the like.

The conductor layer 52 includes the heat generator 60, a plurality of electrodes 61, and a plurality of power supply lines 62 as conductors. The heat generator 60 includes a plurality of resistive heat generators 59. The power supply line 62 electrically connects the heat generator 60 and the electrodes 61. Each of the resistive heat generators 59 is electrically connected to any two of the three electrodes 61 in parallel to each other via the plurality of power supply lines 62 disposed on the base 50. Thus, the resistive heat generators 59 are electrically connected in parallel to each other.

The heat generator 60 is produced by mixing silver-palladium (AgPd), glass powder, and the like into a paste. The paste is coated on the base 50 by screen printing or the like. Thereafter, the base 50 is fired to form the heat generator 60. Alternatively, the heat generator 60 may be made of a resistive material such as a silver alloy (AgPt) and ruthenium oxide (RuO2).

The power supply lines 62 are made of a conductor having an electrical resistance lower than that of the heat generator 60. The power supply lines 62 and the electrodes 61 may be made of a material prepared with silver (Ag), silver-palladium (AgPd), or the like. Screen-printing such a material forms the power supply lines 62 and the electrodes 61.

Figure 9:
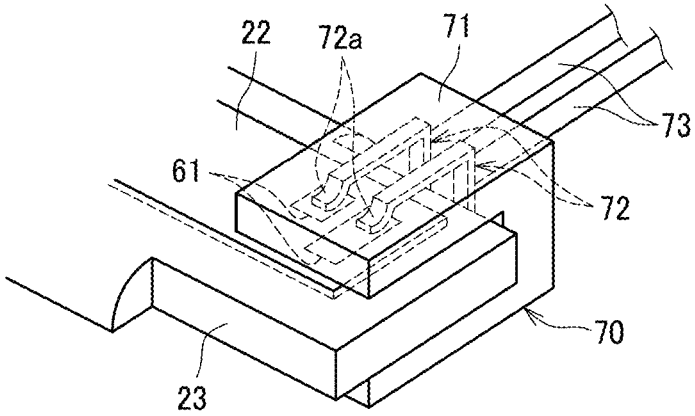
FIG. 9 is a perspective view illustrating the connector connected to the heater, according to the embodiment of the present disclosure.

FIG. 9 is a perspective view illustrating a connector 70 connected to the heater 22.

As illustrated in FIG. 9, the connector 70 includes a housing 71 made of resin and a plurality of contact terminals 72 fixed to the housing 71. Each contact terminal 72 is configured by a flat spring and connected to a power supply harness 73.

As illustrated in FIG. 9, the connector 70 is attached to the heater 22 and the heater holder 23 such that a front side of the connector 70 sandwiches the heater 22 and the heater holder 23 together with a back side of the connector 70. Thus, the contact portions 72*a* disposed at ends of the contact terminals 72 elastically contact and press against the electrodes 61 each corresponding to the contact terminals 72, and the heat generator 60 is electrically connected to the power supply provided in the image forming apparatus via the connector 70. The above-described configuration allows the power supply to supply power to the heat generator 60. Note that, as illustrated in FIG. 7, at least part of each of the electrodes 61 is not coated by the second insulation layer 53 and therefore exposed to secure connection with the corresponding connector 70.

Figure 10:
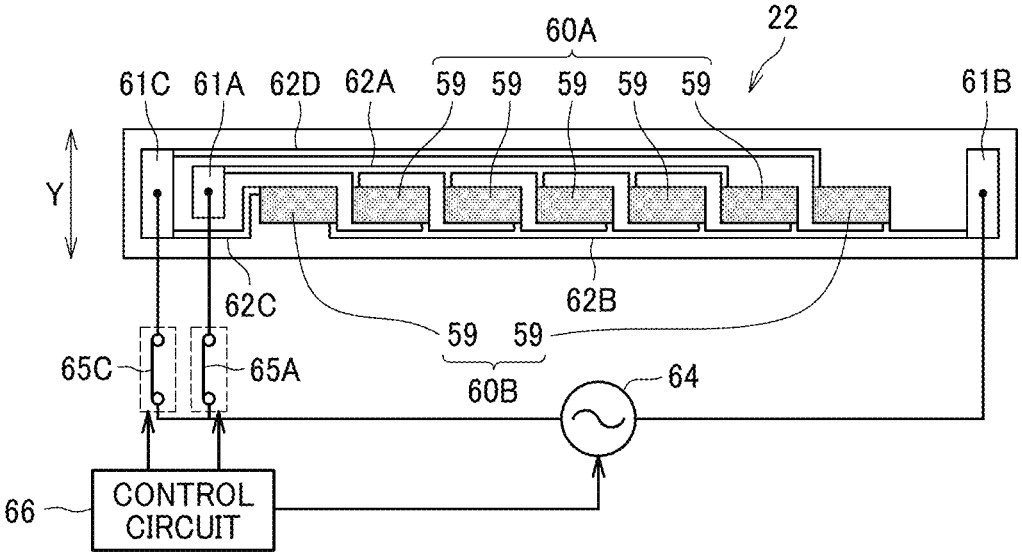
FIG. 10 is a schematic diagram illustrating a circuit to supply power to the heater according to the embodiment of the present disclosure.

As illustrated in FIG. 10, in the present embodiment, the heat generator 60 includes a first heat generator group 60A serving as a heat generation part and a second heat generator group 60B serving as another heat generation part. The first heat generator group 60A is a first group of the resistive heat generators 59, which are other than the resistive heat generators 59 on the ends of the plurality of resistive heat generators 59 arranged in a longitudinal direction of the base 50. The second heat generator group 60B is a second group of the resistive heat generators 59, which are arranged on the ends and distinct from the resistive heat generators 59 of the first heat generator group 60A. The first heat generator group 60A and the second heat generator group 60B are separately controllable to generate heat. Specifically, each of the resistive heat generators 59 constructing the first heat generator group 60A (i.e., the resistive heat generators 59 other than the resistive heat generators 59 arranged on the ends) is connected, through a first power supply line 62A, to a first electrode 61A provided on a first longitudinal end side of the base 50. Each of the resistive heat generators 59 constructing the first heat generator group 60A is also connected, through a second power supply line 62B, to a second electrode 61B provided on a second longitudinal end side of the base 50 opposite the first longitudinal end side of the base 50 on which the first electrode 61A is provided. On the other hand, each of the resistive heat generators 59 constructing the second heat generator group 60B (i.e., the resistive heat generators 59 on the ends) is connected, through a third power supply line 62C or a fourth power supply line 62D, to a third electrode 61C (different from the first electrode 61A) provided on the first longitudinal end side of the base 50. Like each of the resistive heat generators 59 of the first heat generator group 60A, each of the resistive heat generators 59 arranged on the ends is also connected to the second electrode 61B through the second power supply line 62B.

The electrodes 61A to 61C are connected to a power supply 64 via the connector 70 described above and supplied with power from the power supply 64. A switch 65A as a switching unit is disposed between the electrode 61A and the power supply 64. Turning the switch 65A on and off can switch whether or not a voltage is applied to the electrode 61A. Similarly, a switch 65C as a switching unit is disposed between the electrode 61C and the power supply 64. Turning the switch 65C on and off can switch whether or not a voltage is applied to the electrode 61C. A control circuit 66 controls ON and OFF of these switches 65A and 65C and timing of power supply to the heater 22. The control circuit 66 performs these controls based on detection results of various sensors in the image forming apparatus 1. For example, the control circuit 66 determines a sheet passing timing based on detection results of the sensors provided at the entrance and the exit of the fixing nip N and determines whether or not the heater 22 is supplied with electric power and switching timings of the switches 65A and 65C.

Applying a voltage to the first electrode 61A and the second electrode 61B energizes the resistive heat generators 59 other than the end resistive heat generators 59, and the first heat generator group 60A generates heat alone. On the other hand, applying a voltage to the second electrode 61B and the third electrode 61C energizes the end resistive heat generators 59, and the second heat generator group 60B generates heat alone. When a voltage is applied to all the first to third electrodes 61A to 61C, the resistive heat generators 59 of both the first heat generator group 60A and the second heat generator group 60B (i.e., all the resistive heat generators 59) generate heat. For example, the first heat generator group 60A generates heat alone to fix a toner image on a sheet P having a relatively small width conveyed, such as a sheet P of A4 size (sheet width: 210 mm) or a smaller sheet P. By contrast, the second heat generator group 60B generates heat together with the first heat generator group 60A to fix a toner image on a sheet P having a relatively large width conveyed, such as a sheet P larger than A4 size (sheet width: 210 mm). As described above, the heater 22 can generate heat generation areas corresponding to the sheet widths.

One approach to further downsize the image forming apparatus and the fixing device is downsizing the heater, which is one of the components disposed inside a loop formed by the fixing belt. That is, downsizing the heater in a short-side direction of the heater can downsize the fixing belt and, as a result, downsize the fixing device and the image forming apparatus. Note that the short-side direction of the heater is a direction indicated by arrow Y in FIG. 10, a direction intersecting the longitudinal direction of the heater 22 along the surface of the heater 22 on which the first heat generator group 60A and the second heat generator group 60B are provided in FIG. 10, and a direction orthogonal to the longitudinal direction of the heater 22 and different from a thickness direction of the heater 22 that is orthogonal to the sheet surface of FIG. 10. Specifically, the following three methods are considered as examples of methods to downsize the heater in the short-side direction of the heater.

A first method is downsizing the heat generator group (i.e., resistive heat generators) in the short-side direction of the heater. However, downsizing the heat generator group in the short-side direction of the heater narrows a heating span over which the fixing belt is heated, resulting in an increase in the temperature peak of the heater to maintain the same amount of heat applied to the fixing belt as the amount of heat applied before the heating span is narrowed. The increase in the temperature peak of the heater may cause the temperature of an overheating detector such as a thermostat or a fuse disposed on a back surface of the heater to exceed a heat resistant temperature. Alternatively, the increase in the temperature peak of the heater may cause malfunction of the overheating detector. In addition, the increase in the temperature peak of the heater also reduces the efficiency of heat conduction from the heater to the fixing belt. Therefore, the increase in the temperature peak of the heater is unfavorable from the viewpoint of energy efficiency. As described above, downsizing the heat generator group in the short-side direction of the heater is hardly adopted.

A second method is downsizing, in the short-side direction of the heater, parts of the heater that are not the heat generator groups, the electrodes, and the power supply lines. However, this method shortens a distance between the heat generator group and the power supply line or between the electrode and the power supply line, thus failing to secure the insulation. Considering the structure of the current heater, it is difficult to further shorten the distance between the heat generator group and the power supply line or between the electrode and the power supply line.

The remaining third method is to reduce the size of the power supply line in the short-side direction of the heater. This method has room for implementation as compared with the above two methods. However, reducing the size of the power supply line in the short-side direction increases the resistance value of the power supply line. Therefore, an unintended shunt may occur on a conductive path of the heater. In particular, if a resistance value of the heat generator group is reduced to increase the heat generation amount generated by the heat generator to speed up the image forming apparatus, the resistance value of the power supply lines and the resistance value of the heat generator group get relatively close to each other. In such a situation, an unintended shunt tends to occur. In order to prevent such an unintended shunt, the power supply lines may be upsized in a thickness direction of the heater (i.e., direction intersecting the longitudinal and short-side directions of the heater) while being downsized in the short-side direction of the heater. Such a configuration secures the cross-sectional area of the power supply lines and prevents an increase in resistance value of the power supply lines. However, in such a case, the screen printing of the power supply lines is difficult, resulting in a change of the way of forming the power supply lines. Therefore, thickening the power supply lines is hardly adopted as a solution. In conclusion, in order to downsize the heater in the short-side direction of the heater, the power supply lines are downsized in the short-side direction of the heater in anticipation of an increase in resistance value, while a measure is taken against the unintended shunt that may be caused by downsized power supply lines.

Hereinafter, referring now to FIGS. 11 to 14, a description is given of the unintended shunt and adverse effects of the unintended shunt in the heater 22 described above.

Figure 11:
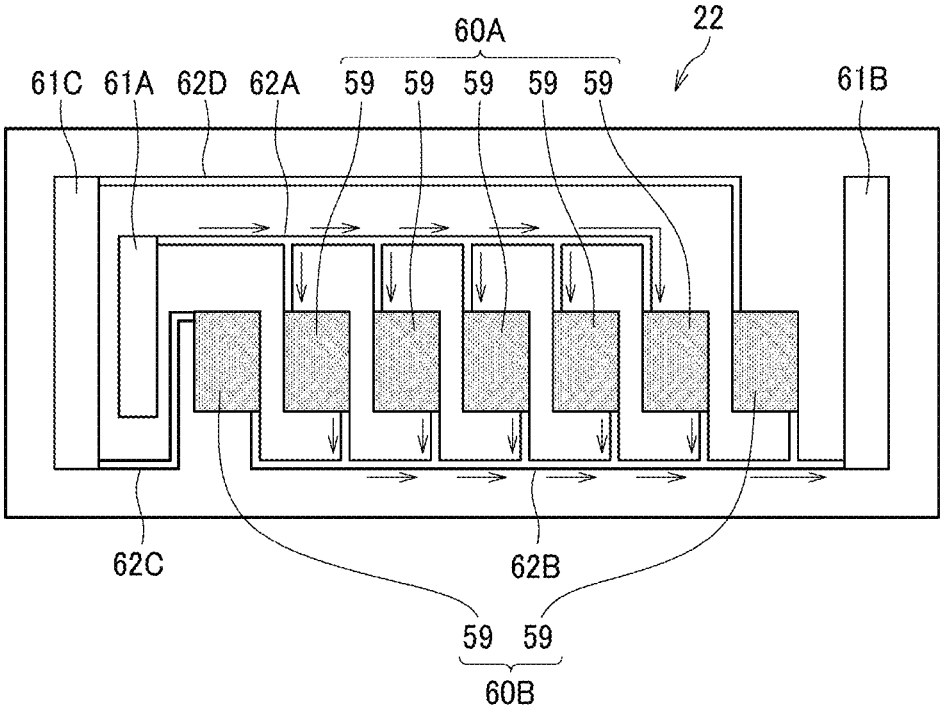
FIG. 11 is an explanatory view illustrating typical current paths in the heater depicted in FIG. 7.

In the heater 22 illustrated in FIG. 11, applying the voltage to the first electrode 61A and the second electrode 61B typically generates a current that flows through the first power supply line 62A, passes through each of the resistive heat generators 59 other than the resistive heat generators 59 located on the both ends of the heater 22, and then flows through the second power supply line 62B, and the resistive heat generators 59 of the first heat generator group 60A alone generate heat.

Figure 12:
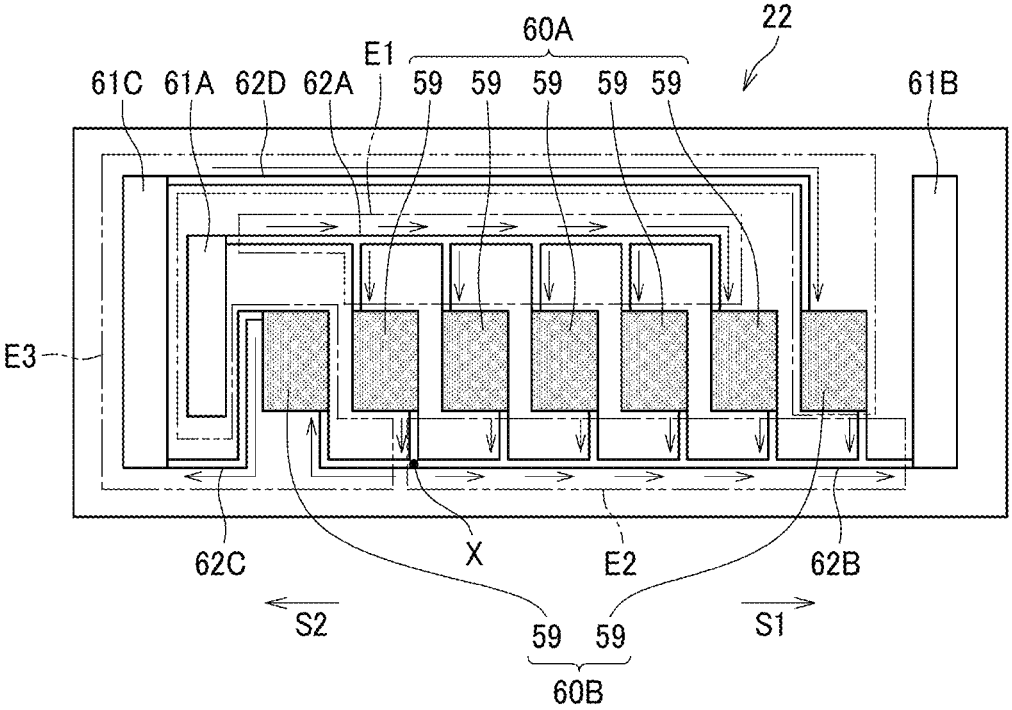
FIG. 12 is an explanatory view illustrating current paths in the heater depicted in FIG. 7 in which an unintended shunt occurs.

However, as illustrated in FIG. 12, the unintended shunt occurs in current paths when increase in resistance values of the power supply lines to downsize the heater 22 as described above and decrease in resistance values of the heat generator groups to increase the heat generation amount of the heater 22 decrease the differences between the resistance values of the power supply lines and the heat generator groups. Specifically, part of the current passing through the second resistive heat generator 59 from the left in FIG. 12 does not flow to the second electrode 61B from a branch X of the second power supply line 62B to which the current flow from the second resistive heat generator 59, but flows opposite side of the second electrode 61B from the branch X. The shunted current then passes through the resistive heat generator 59 arranged on the left end in FIG. 12 and further passes through the third power supply line 62C, the third electrode 61C, the fourth power supply line 62D, and the resistive heat generator 59 arranged on the right end in FIG. 12 in this order. Finally, the current joins the second power supply line 62B.

As described above, in the heater 22 illustrated in FIG. 12, a shunted current path E3 through which the unintended shunt flows includes a part of the second power supply line 62B extending from the branch X to the left in FIG. 12, the resistive heat generators 59 on the ends constructing the second heat generator group 60B, the third electrode 61C, the third power supply line 62C, and the fourth power supply line 62D.

The above-described unintended shunt may occur when the first heat generator group 60A is energized as long as the heater 22 includes a conductive path including at least a first conductive portion E1, a second conductive portion E2, and the shunted current path E3. The first conductive portion E1 connects the first heat generator group 60A and the first electrode 61A. The second conductive portion E2 extends from the first heat generator group 60A in a first direction S1 (i.e., to the right in FIG. 12) of a longitudinal direction of the heater 22 to connect the first heat generator group 60A and the second electrode 61B. The shunted current path E3 separates from the second conductive portion E2 in a second direction S2 (i.e., to the left in FIG. 12) opposite the first direction S1 and is connected to the second conductive portion E2 or the second electrode 61B without passing through the first conductive portion E1. In the present embodiment, the shunted current path E3 includes the second heat generator group 60B and the third electrode 61C. However, the unintended shunt may occur even on a conductive path without the second heat generator group 60B or the third electrode 61C, or a conductive path provided with a conductor other than the second heat generator group 60B and the third electrode 61C.

Figure 13:
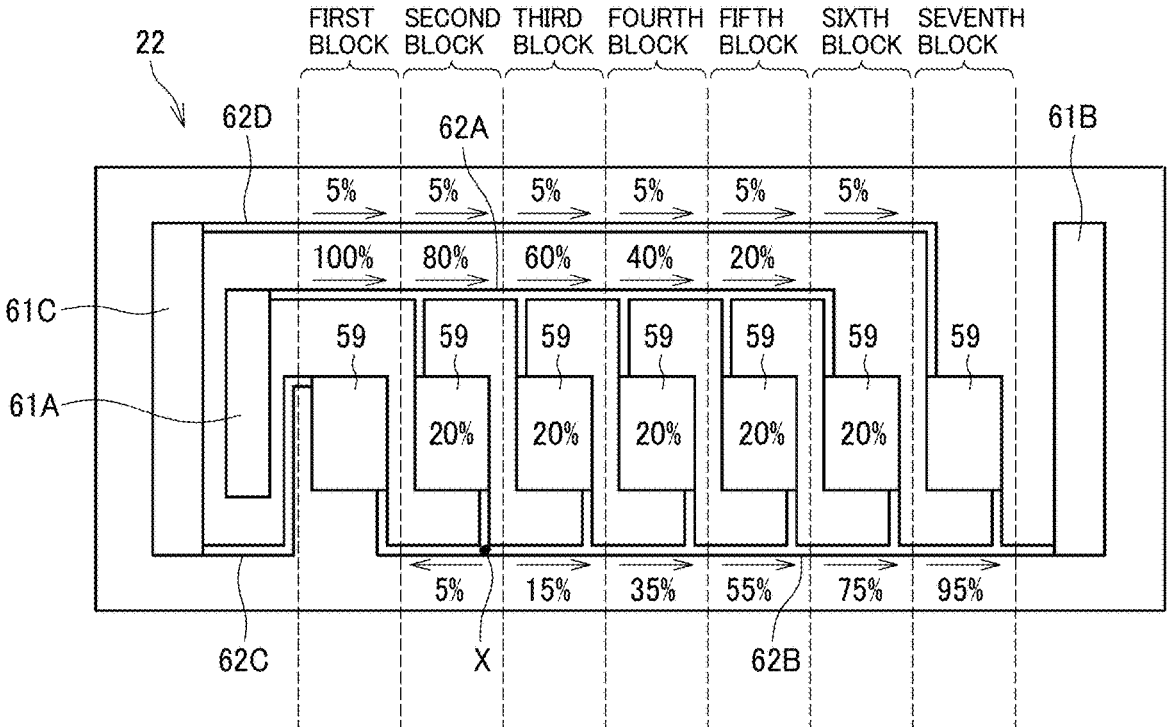
FIG. 13 is an explanatory view illustrating heat generation amounts generated by power supply lines in each block of the heater depicted in FIG. 7 in which the unintended shunt occurs.

The unintended shunt is a current flowing through an unexpected path and causes heat generation of the power supply lines in the unexpected path, and the heat generation causes a variation in the temperature distribution of the heater 22. For example, in the heater 22 illustrated in FIG. 13, 20% of a current from the first electrode 61A flows equally through each of the resistive heat generators 59 of the first heat generator group 60A. FIG. 13 illustrates a case in which 5% of a current passing through the second resistive heat generator 59 from the left in FIG. 13 flows from the branch X to the third electrode 61C, and the table in FIG. 13 illustrates heat generation amounts in each of the power supply lines in each block that is separated so as to include each resistive heat generator 59.

Since the portion of each power supply line extending in the short-side direction of the heater 22 is relatively short and therefore the heat generation amount generated in the shorter portion is relatively small, the heat generation amount in the shorter portion is eliminated. The table illustrated in FIG. 13 simply indicates the calculated heat generation amounts generated in a longer portion of each power supply line extending in the longitudinal direction of the heater 22. Specifically, the table illustrates calculated heat generation amounts in portions extending in the longitudinal direction of the heater 22 in the first power supply line 62A, the second power supply line 62B, and the fourth power supply line 62D. Since a heat generation amount (W) is represented by the following equation (1), each of the heat generation amounts indicated in the table of FIG. 13 is calculated as the square of a current (I) flowing through each of the power supply lines for convenience. Therefore, the numerical values of the heat generation amounts indicated in the table of FIG. 13 are merely values calculated simply and may be different from the actual heat generation amount.

$$W=R\times I2, \tag{1}$$

where W represents the heat generation amount, R represents the resistance, and I represents the current.

A description is given of a specific calculation method of the heat generation amounts illustrated in FIG. 13. In the first block in FIG. 13, a proportion of a current flowing through the fourth power supply line 62D to a current flowing through the first power supply line 62A is 5%, and a proportion of the current flowing through the first power supply line 62A is expressed as 100%. Therefore, the total heat generation amount generated by the power supply lines 62A and 62D in the first block is expressed as 10025, which is the total value of the square of 100 (i.e., 10000) and the square of 5 (i.e., 25). In the second block, a proportion of a current flowing through the first power supply line 62A is 80%, a proportion of a current flowing through the second power supply line 62B is 5%, and a proportion of a current flowing through the fourth power supply line 62D is 5%. Therefore, the total heat generation amount of the power supply lines 62A, 62B, and 62D in the second block is 6450 (6400+25+25), which is the sum of the squares of the above-described proportions of the currents. The heat generation amounts in other blocks are similarly calculated.

Figure 14:
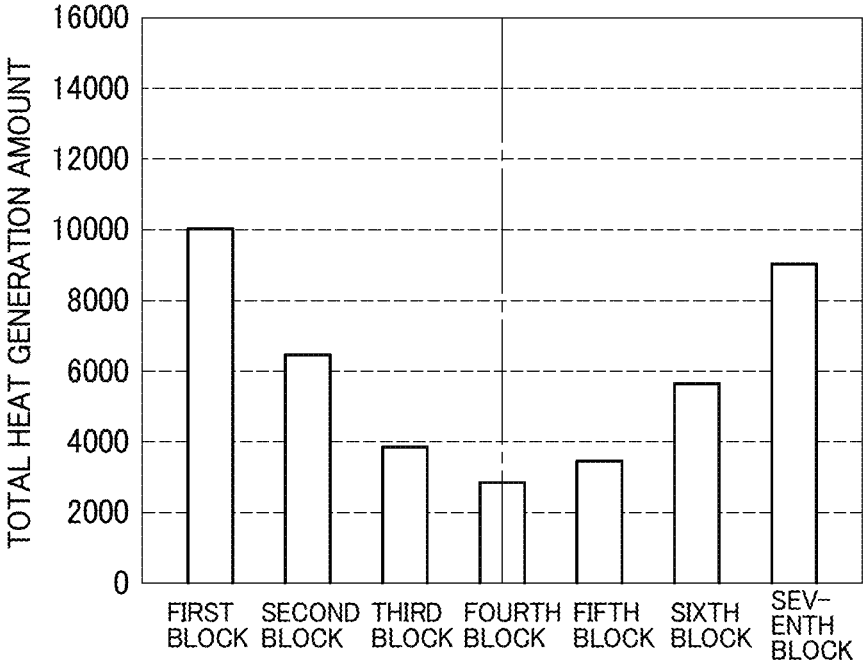
FIG. 14 is a graph illustrating the total heat generation amount generated by the power supply lines in each block of the heater illustrated in FIG. 13.

FIG. 14 is a graph based on the table of FIG. 13. The x-axis represents blocks in FIG. 13, and the y-axis represents the total heat generation amounts described above in the blocks. As illustrated in FIG. 14, the above-described unintended shunt affects the total heat generation amount in each block, and the distribution of the total heat generation amounts becomes a lateral unsymmetrical shape with respect to the fourth block located in the center of the heat generation area.

Similarly, when all the heat generator groups are energized, a difference of currents flowing through the conductive portions occurs, and the distribution of the total heat generation amounts in the longitudinal direction of the heater 22 becomes unsymmetrical shape. That is, since downsizing the heater 22 limits an arrangement of the electrodes and the conductive portions, designing the distribution of the heat generation amounts in the longitudinal direction of the heater 22 to be a lateral symmetrical shape is difficult. Speeding up the image forming apparatus as described above increases the currents flowing through the conductive portions and, as a result, increases the difference between currents flowing through the left blocks and the right blocks. The difference can not be ignored. Next, a description is given of a case when all the heat generator groups are energized.

Figure 15:
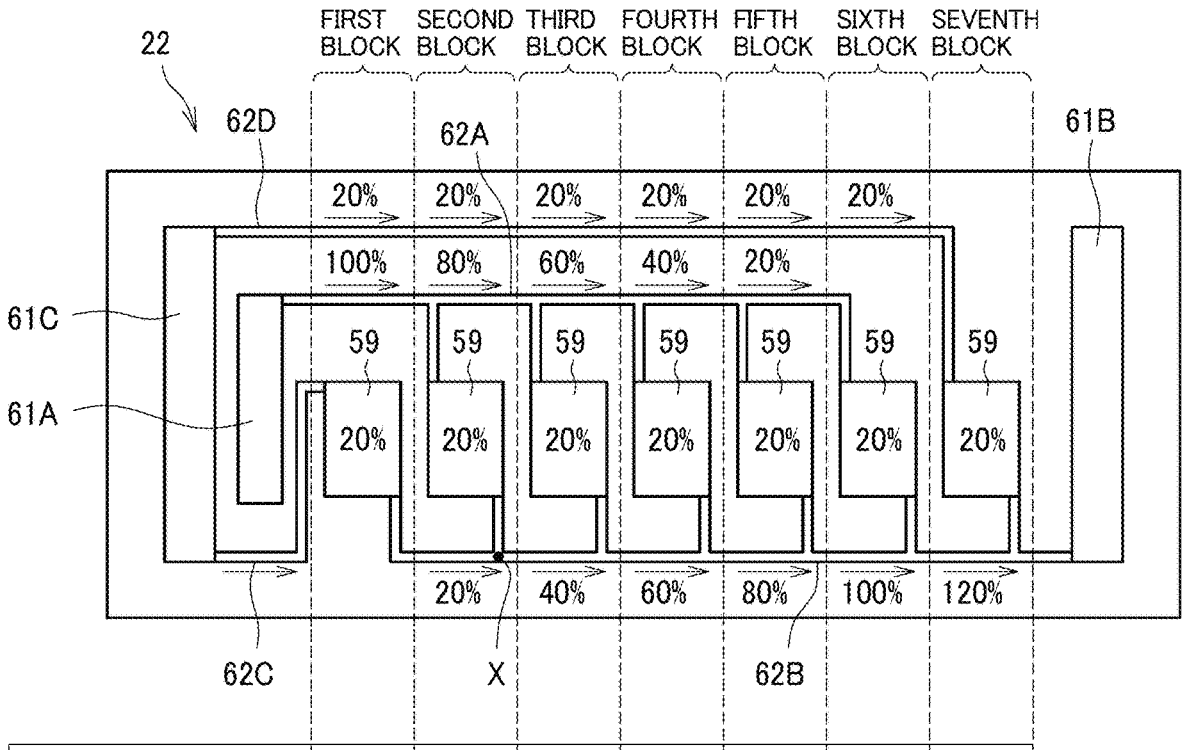
FIG. 15 is an explanatory view illustrating heat generation amounts generated by power supply lines in each block of the heater depicted in FIG. 7 when all heat generator groups are energized.

As illustrated in FIG. 15, the difference between the case when all the heat generator groups are energized and the case when the first heat generator group is energized is that a current having a proportion of 20% to the current flowing through the first power supply line 62A flows through each of the resistive heat generators 59 at both ends and each of the power supply lines 62C and 62D connected to the resistive heat generators at both ends. The value of the current flowing through the power supply line 62A is the same as that in the case when the first heat generator group is energized. In the first block in FIG. 15, a proportion of a current flowing through the fourth power supply line 62D to the current flowing through the first power supply line 62A is 20%, and the proportion of the current flowing through the first power supply line 62A is expressed as 100%. Therefore, the total heat generation amount generated by the power supply lines 62A and 62D in the first block is expressed as 10400, which is the total value of the square of 100 (i.e., 10000) and the square of 20 (i.e., 400). In the second block, a proportion of a current flowing through the first power supply line 62A is 80%, a proportion of a current flowing through the second power supply line 62B is 20%, and a proportion of a current flowing through the fourth power supply line 62D is 20%. Therefore, the total heat generation amount of the power supply lines 62A, 62B, and 62D in the second block is 7200 (6400+400+400), which is the sum of the squares of the above-described proportions of the currents. The heat generation amounts in other blocks are similarly calculated.

Figure 16:
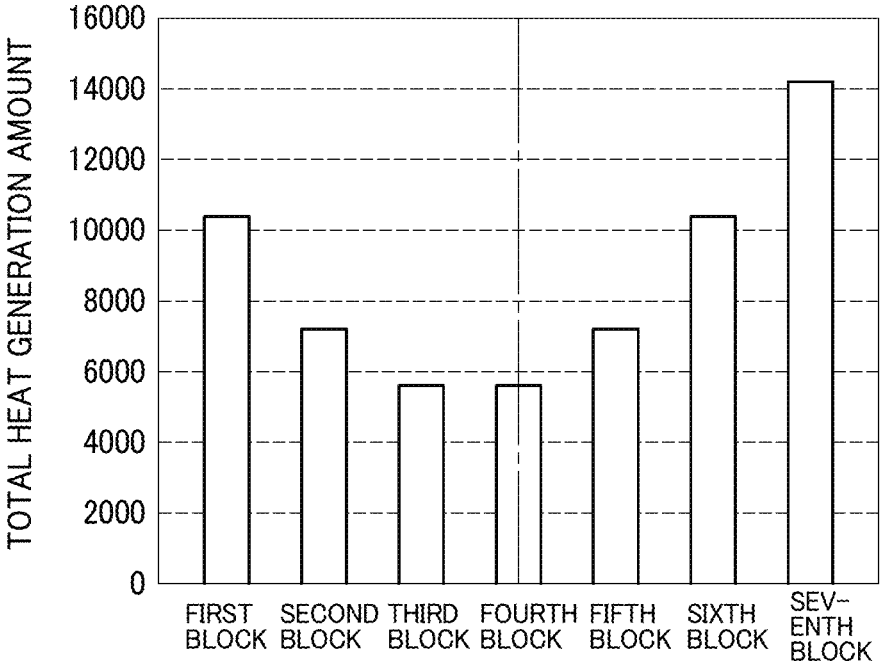
FIG. 16 is a graph illustrating the total heat generation amount generated by the power supply lines in each block of the heater illustrated in FIG. 15.

As illustrated in FIG. 16, the distribution of the total heat generation amounts becomes the lateral unsymmetrical shape with respect to the fourth block located in the center of the heat generation area. In particular, the second power supply line 62B is connected to all resistive heat generators 59, and a proportion of a current flowing through downstream portion of the power supply line 62B, that is, the power supply line 62B in the seventh block to the current flowing through the first power supply line 62A in the first block becomes 120%. Such a large current value causes a difference between heat generation amounts in right and left portions of the power supply line.

Such an asymmetrical variation in the heat generation amount of the power supply lines causes a longitudinal unevenness in temperature of the heater 22. When the temperature of the heater 22 varies in the longitudinal direction of the heater 22, the glossiness of an image fixed on a portion of the sheet P corresponding to the higher temperature portion of the heater 22 is higher than the glossiness of an image fixed on a portion of the sheet P corresponding to the lower temperature portion of the heater 22. In short, the entire image exhibits the unevenness in glossiness, leading to a deterioration in image quality. In the present embodiment, lengths of the blocks are designed to be the same so that the heater 22 can uniformly heat the sheet P regardless of the size of the sheet P.

In the present embodiment, the following measures are taken to prevent disadvantages caused by the longitudinal unevenness in temperature of the heater 22, such as the unevenness in glossiness or an unevenness in a fixing property when one of the heat generator groups is energized to fix the image on the small sheet and when all the heat generator groups are energized to fix the image on the large sheet.

Figure 17:
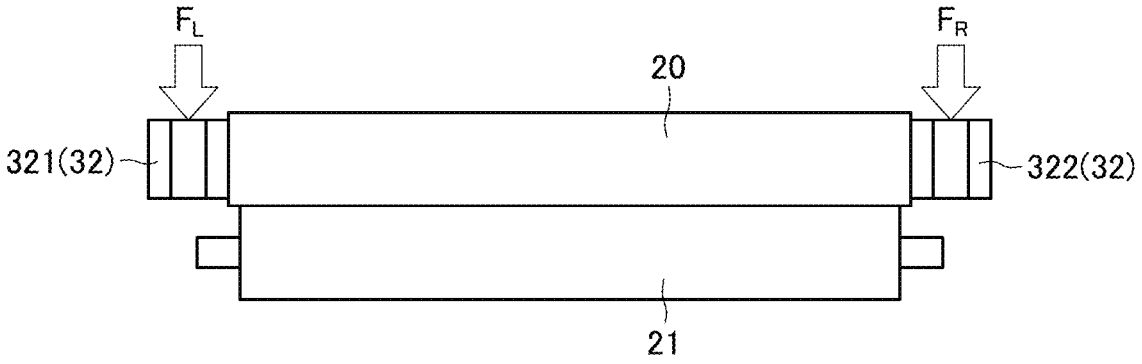
FIG. 17 is an explanatory view illustrating pressing forces applied by pressing devices under an equal pressure condition.

As illustrated in FIG. 17, one of flanges 321 and 322 supports one end of the fixing belt 20 in the longitudinal direction of the fixing belt 20, and the other one of the flanges 321 and 322 supports the other end of the fixing belt 20 in the longitudinal direction. Two independent pressing devices press flanges 321 and 322, respectively. The pressing devices press the flanges 321 and 322, and the flanges 321 and 322 press the fixing belt 20 against the pressure roller 21 to form the fixing nip N. That is, the pressing devices press the fixing belt 20.

Originally, a pressing force FL applied to the flange 321 and a pressing force FR applied to the flange 322 are set to be the same. This setting of the pressing forces is referred to as a uniform pressure condition. A pressure condition between the fixing belt 20 and the pressure roller 21 is changed, which is described in detail below.

Figure 18A:
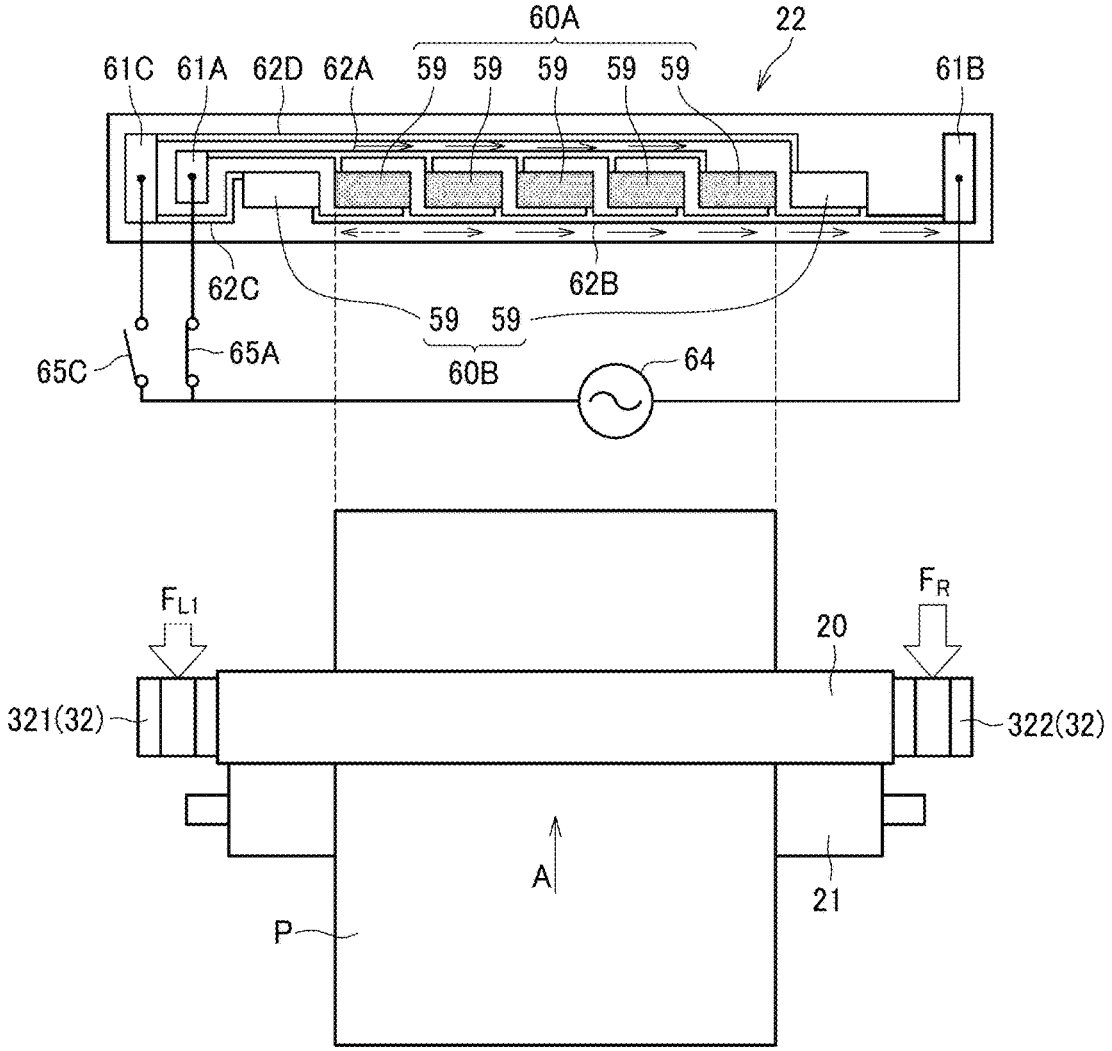
FIG. 18A is an explanatory view illustrating the heater and a longitudinal positional relationship of parts in the fixing device depicted in FIG. 2 and a small sheet when the small sheet passes through the fixing device, an upper part of FIG. 18A illustrates the heater, and a lower part of FIG. 18A illustrates the longitudinal positional relationship.
Figure 18B:
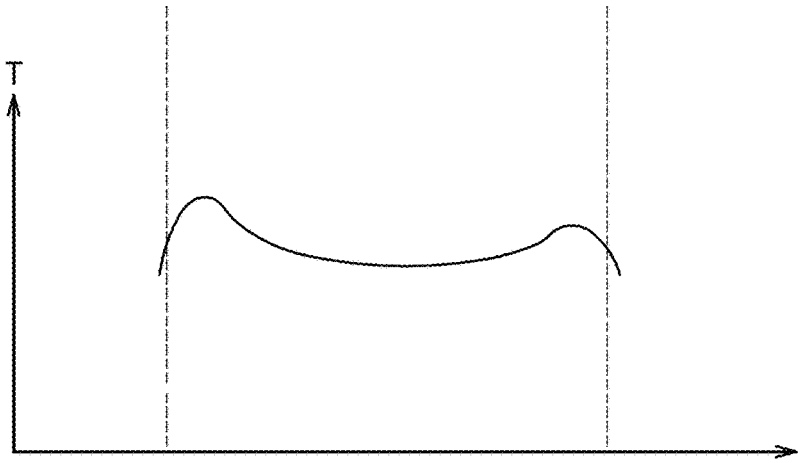
FIG. 18B is a graph illustrating a temperature distribution in the longitudinal direction of a fixing belt in the fixing device depicted in FIG. 18A when the small sheet passes through the fixing device.

FIG. 18A is an explanatory view illustrating the heater 22 and a longitudinal positional relationship of parts in the fixing device 9 depicted in FIG. 2 and the small sheet when the small sheet passes through the fixing device 9. The heater 22 is depicted in the upper part of FIG. 18A, and the parts in the fixing device 9 and the small sheet are depicted in the lower part of FIG. 18A. As a result, the longitudinal positional relationship is illustrated. FIG. 18B is a graph illustrating a temperature distribution in the longitudinal direction of the fixing belt 20. In FIG. 20B, T means temperature of the fixing belt 20. The sheet P passing between the fixing belt 20 and the pressure roller 21 in FIG. 18A is the small sheet which the heater 22 can heat, for example, the A4 size sheet.

As illustrated in the upper part of FIG. 18A, the first heat generator group 60A of the heater 22 is energized corresponding to the small sheet. In this case, as described above, one end portion of the heater 22 in the longitudinal direction that is the left end portion of the heater 22 in FIG. 18A generates a larger amount of heat than the other end portion of the heater, and as illustrated in FIG. 18B, temperatures T of the fixing belt 20 include the highest temperature in a left part in FIG. 18B. Note that the heat generation amounts in the end portions of the heater 22 alone are measured to determine whether "one end portion of the heater 22 in the longitudinal direction generates the larger amount of heat than the other end portion of the heater".

The pressing devices according to the present embodiment change the pressing forces applied to the flanges 321 and 322 under the above-described uniform pressure condition based on the distribution of temperatures T of the fixing belt 20 or the distribution of heat generation amounts of the heater 22. Specifically, as illustrated in the lower part of FIG. 18A, the pressing device changes the pressing force applied to the flange 321 supporting the one end portion of the fixing belt 20 in the longitudinal direction thereof from the pressing force FL to a pressing force FL1 smaller than the pressing force FL. Additionally, the pressing device maintains the pressing force applied to the flange 322 supporting the other end portion of the fixing belt 20 to be the same as the pressing force FR. Hereinafter, the above-described setting of the pressing forces is referred to as a first pressure condition. That is, the pressing force applied to the flange 321 is set smaller than the pressing force applied to the flange 322. As a result, a nip pressure in a part of the nip N corresponding to the portion of the heater 22 that generates the larger amount of heat than the other portion of the heater 22 in the longitudinal direction becomes relatively smaller than a nip pressure in the other part of the nip N. The nip pressure may be replaced a pressure contact force between the fixing belt 20 and the pressure roller 21 at the nip N. In addition, under the first pressure condition, a nip width in the part of the nip N corresponding to the portion of the heater 22 that generates the larger amount of heat than the other portion of the heater 22 in the longitudinal direction becomes relatively smaller than a nip width in the other part of the nip N. The nip width is a width of the nip N in a direction orthogonal to the longitudinal direction of the heater 22 that is also a conveyance direction of the sheet P in the nip N. Accordingly, the above-described condition can prevent the disadvantage caused by the temperature difference between the one end portion and the other end portion in the longitudinal direction of the heater 22. That is, the above-described condition can reduce the difference in the fixing property between the one end portion and the other end portion in the longitudinal direction of the heater 22 and the unevenness in glossiness in the longitudinal direction. That is, unevenness of the image or the unevenness in glossiness of the image on the sheet can be reduced.

Figure 19A:
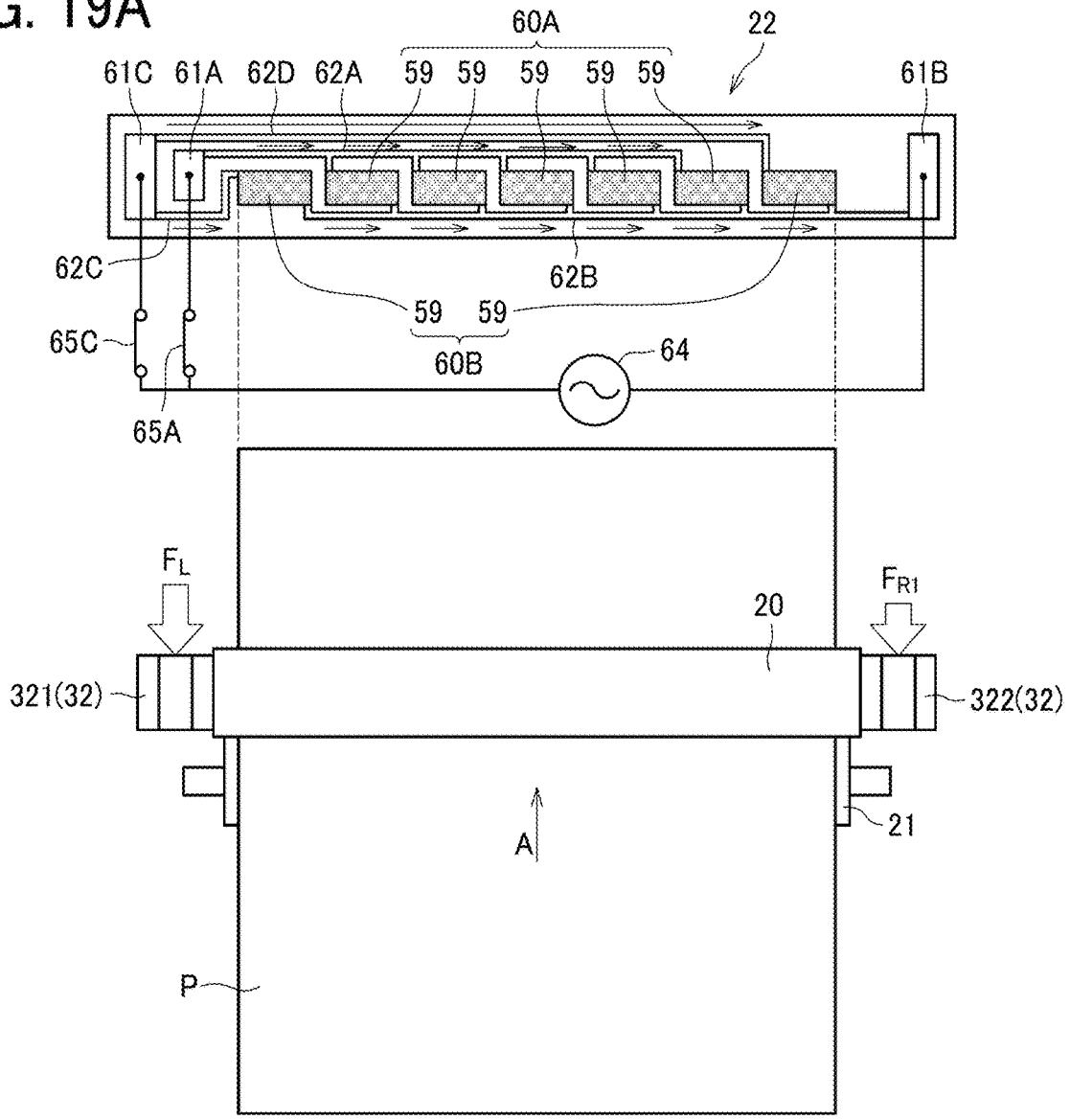
FIG. 19A is an explanatory view illustrating the heater and a longitudinal positional relationship of parts in the fixing device depicted in FIG. 2 and a large sheet when the large sheet passes through the fixing device, an upper part of FIG. 19A illustrates the heater, and a lower part of FIG. 19A illustrates the longitudinal positional relationship.
Figure 19B:
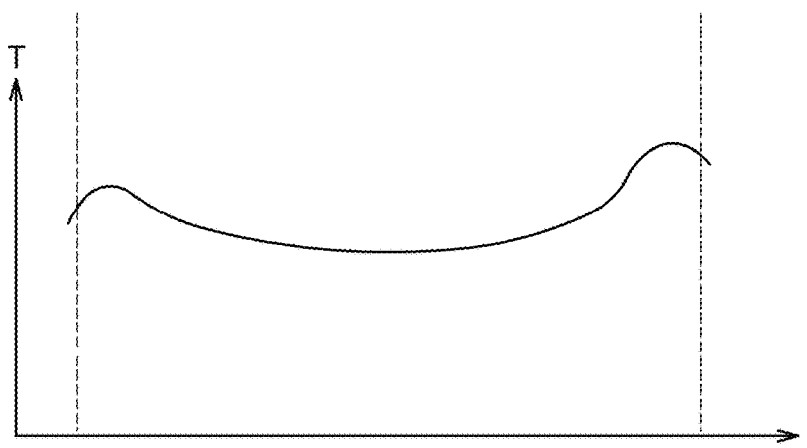
FIG. 19B is a graph illustrating a temperature distribution in the longitudinal direction of the fixing belt in the fixing device depicted in FIG. 19A when the large sheet passes through the fixing device.

On the other hand, as illustrated in FIGS. 19A and 19B, when all the heat generator groups are energized to fix the image on the large sheet such as a A3 size sheet, the other end portion of the heater 22 in the longitudinal direction in FIG. 19A generates a larger amount of heat than the one end portion of the heater, and as illustrated in FIG. 19B, temperatures T of the fixing belt 20 include the highest temperature in a right part in FIG. 19B. In this case, the pressing force applied to the flange 321 is set to be the same as the pressing force FL of the uniform pressure condition, and the pressing force applied to the flange 322 is changed from the pressing force FR to a pressing force FR1 smaller than the pressing force FR. Hereinafter, the above-described setting of the pressing forces is referred to as a second pressure condition. That is, the pressing force applied to the flange 322 is set smaller than the pressing force applied to the flange 321. As a result, the nip pressure in the part of the nip N corresponding to the portion of the heater 22 that generates the larger amount of heat than the other portion of the heater 22 in the longitudinal direction becomes relatively smaller than the nip pressure in the other part of the nip N. In addition, under the second pressure condition, the nip width in the part of the nip N corresponding to the portion of the heater 22 that generates the larger amount of heat than the other portion of the heater 22 in the longitudinal direction becomes relatively smaller than the nip width in the other part of the nip N. Accordingly, the above-described condition can prevent the disadvantage caused by the temperature difference between the one end portion and the other end portion in the longitudinal direction of the heater 22. That is, the above-described condition can reduce the difference in the fixing property between the one end portion and the other end portion in the longitudinal direction of the heater 22 and the unevenness in glossiness in the longitudinal direction.

To obtain the pressing force and the nip pressure, a pressure distribution measurement system may be used. The pressure distribution measurement system can measure a pressure in the nip N. The nip pressure can be obtained by dividing the pressing force by an area applied the pressing force. Specifically, a pressure distribution measurement system (I-SCAN, manufactured by Nitta Corporation) or the like can be used.

The nip width may be measured as follows. First, a solid black image is formed on the sheet by another image forming apparatus in advance, and the sheet with the solid black image is passed through the fixing device. Then, while the sheet is being passed through the fixing device, the fixing device is forcibly stopped and stopped for 10 seconds, and then the sheet on which the solid black image is formed is pulled out. As a result, a glossy portion is formed on the solid black image. The glossy portion has the same width as the nip width. Measuring the width of the glossy portion gives the nip width. Alternatively, the nip width may be measured as follows. First, an overhead projector (OHP) sheet is inserted into the nip N of the fixing device, and the contact state of the OHP sheet in the nip is continued for a certain period of time. Then, the OHP sheet is pulled out from the nip, and a trace having the nip width is formed on the OHP sheet. Measuring the width of the trace gives the nip width.

Next, with reference to FIG. 20, a specific embodiment of a switching timing between the above-described pressure conditions is described below.

Figure 20:
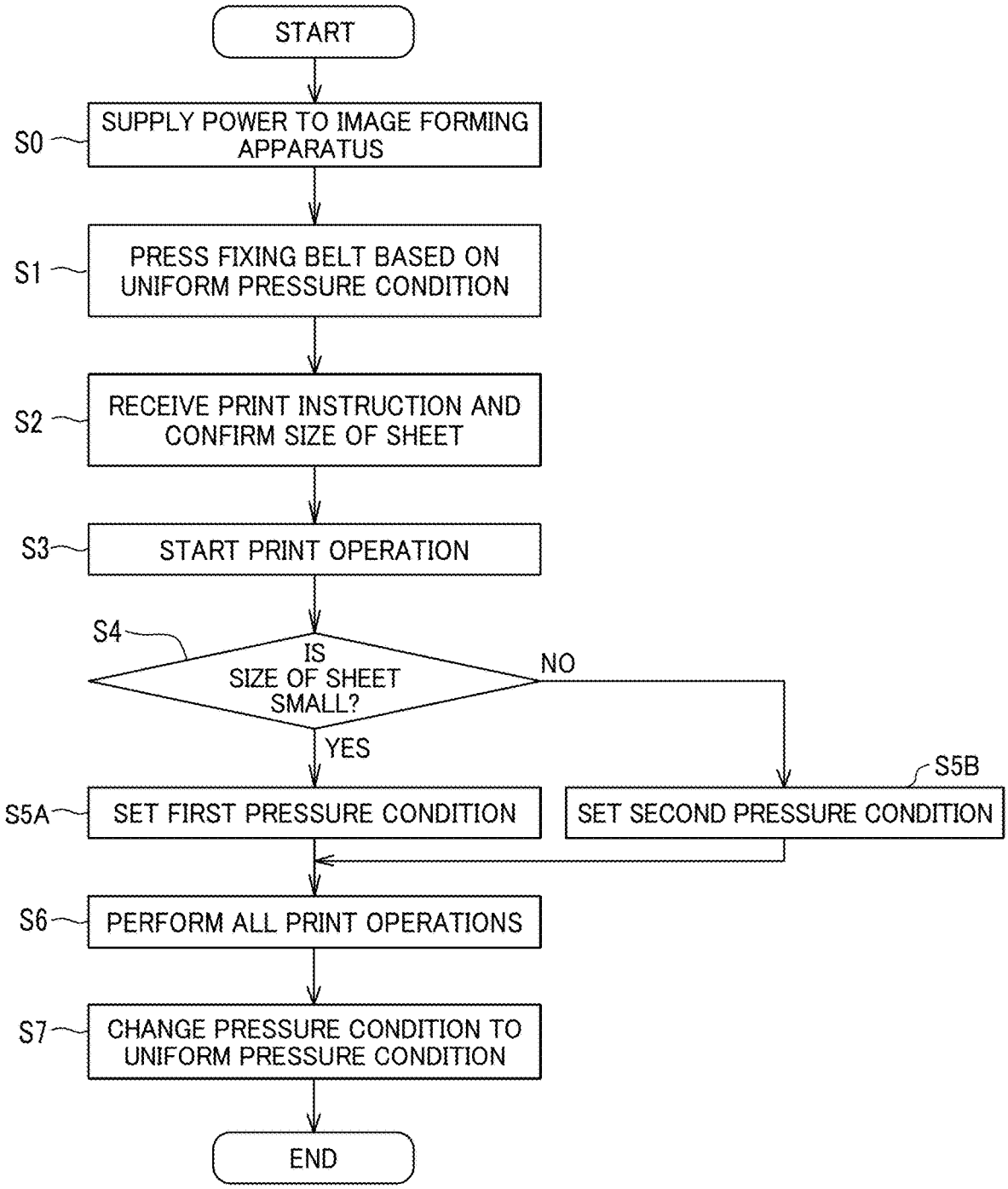
FIG. 20 is a flowchart illustrating a pressure condition control according to an embodiment of the present disclosure.

As illustrated in FIG. 20, power is supplied to the image forming apparatus 1 and the fixing device 9 in step S0. In step S1, the pressing device presses the fixing belt 20 against the pressure roller 21 under the uniform pressure condition.

In step S2, a controller in the image forming apparatus 1 receives a print instruction and confirms a size of the sheet to be printed. In step S3, the controller starts print operations, that is, image forming operations. It should be noted that the above-described print operations (i.e. the image forming operations) include various kinds of operations for printing since the controller in the image forming apparatus 1 receives the print instruction. For example, the various kinds of operations include heating the fixing belt to the fixing temperature and rotating various kinds of rollers to convey the sheet. The print operations include operations until the last printed sheet is ejected to the outside of the image forming apparatus and the image forming apparatus finishes the various kinds of operations for printing.

When the controller starts the print operations, the controller controls the heater 22 to heat and maintain the fixing belt 20 to the target temperature so that the fixing device 9 can operate. After the controller starts the print operations, the controller controls the pressing device to change the pressure condition to press the fixing belt 20 based on the size of the sheet to be printed. Specifically, the controller determines whether the sheet size is small in step S4, and, as described above, when the sheet size is small, the controller sets the pressing device to the first pressure condition in step S5A. When the sheet size is large, the controller sets the pressing device to the second pressure condition in step S5B. In the present embodiment, the controller sets the pressing device to either the first pressure condition or the second pressure condition but may set the pressing device to the uniform pressure condition for printing based on print conditions such as the sheet size. The timing at which the pressing device changes the pressure condition after the controller starts the print operations may be, for example, a predetermined timing until the sheet firstly enters the fixing device such as a timing immediately after the start of the print operations.

While the pressing device maintains the pressure condition set in step S5A or step S5B, the sheet passes through the fixing device 9. When all print operations are performed in step S6, that is, when the fixing device 9 completes fixing operations on all the sheets and the print operations are completed, the controller controls the pressing device to change the pressure condition to the uniform pressure condition in step S7.

Changing the pressure condition in the pressing device based on the size of sheet that passes through the fixing device 9 can uniform the fixing property of the image on the sheet from one end to the other end of the sheet in the longitudinal direction of the fixing belt and, as a result, reduce the unevenness of the image or the unevenness in glossiness of the image on the sheet. In addition, setting the pressing device to the uniform pressure condition except when the printing operations are performed reduces the time when the lateral deviation of the pressure applied to the fixing belt 20 occurs. This reduces the lateral deviation of abrasion of the fixing belt 20 and the pressure roller 21.

Next, with reference to FIG. 21, a different embodiment of a switching timing between the pressure conditions is described below.

Figure 21:
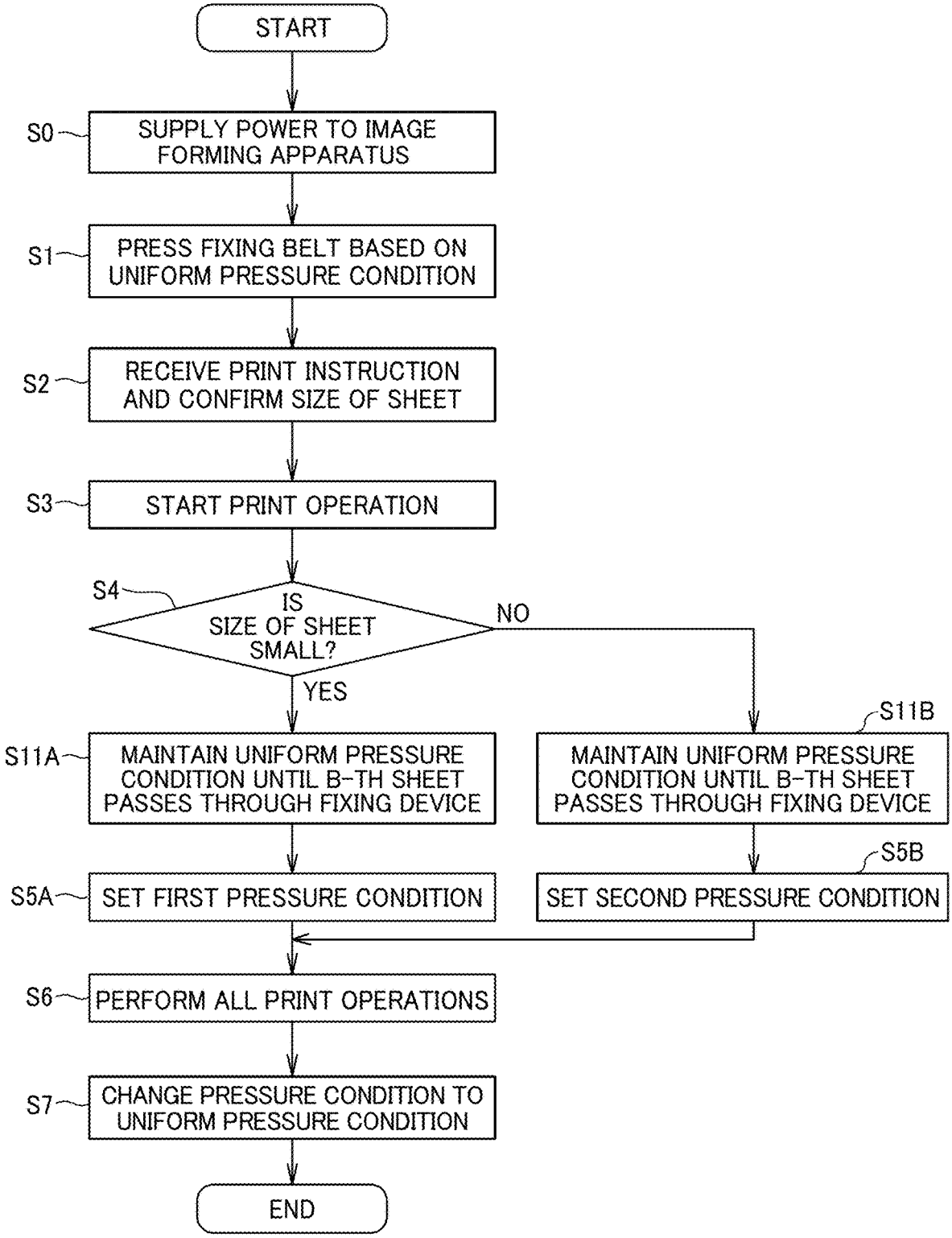
FIG. 21 is a flowchart illustrating a pressure condition control according to another embodiment of the present disclosure, which is different from the pressure control in FIG. 20.

In the flowchart of the embodiment illustrated in FIG. 21, after the controller starts the print operations in step S3, the controller does not change the pressure condition, that is, sets the pressing device to the uniform pressure condition until the Bth sheet (B is a predetermined number) passes through the fixing device in steps S11A and S11B. Note that the time at which the Bth sheet passes through the fixing device is defined as the time at which a sensor disposed near the outlet of the fixing nip N detects the trailing end of the Bth sheet. After the Bth sheet passes through the fixing device, the controller controls the pressing device to change the pressure condition according to the sheet size in step S5A or step S5B. After the change of the pressure condition, similar to the embodiment illustrated in FIG. 20, the controller controls the pressing device to change the pressure condition to the uniform pressure condition after the all print operations are completed. FIG. 21 illustrates the case in which the number of sheets to be printed is B or more. When the number of sheets to be printed is less than B, the image forming apparatus ends the print operations without changing the pressure condition from the uniform pressure condition.

Immediately after the controller starts the printing operations, the heater 22 and the fixing belt 20 have small lateral temperature differences. Accordingly, setting the pressure condition to the uniform pressure condition until the Bth sheet passes through the fixing device as in the present embodiment enables the pressing device to press the fixing belt 20 under the uniform pressure condition during a time period when uneven glossiness and uneven fixing property of the image is unlikely to occur. That is, the time during which the pressure deviation occurs in each of the fixing belt 20 and the pressure roller 21 in the present embodiment is shorter than that in the embodiment illustrated in FIG. 20 in which the pressure condition is changed immediately after the start of the print operations as described above, and the present embodiment can reduce the lateral deviation of abrasion of the fixing belt 20 and the pressure roller 21.

In the above-described embodiment, the controller controls the pressing device to change the pressure condition after the Bth sheet passes through the fixing device. However, the present disclosure is not limited to this, and providing a sensor at a position corresponding to a timing such as after the Bth sheet is ejected outside the image forming apparatus or after the Bth sheet passes through the entrance of the fixing device enables selecting such a timing. Alternatively, the controller may control the pressing device to change the pressure condition according to the sheet size after a predetermined time C has passed since the controller starts the print operations. The above-described case also sets the pressing device to the uniform pressure condition during the time period when uneven glossiness and uneven fixing property of the image is unlikely to occur and reduces the lateral deviation of abrasion of the fixing belt 20 and the pressure roller 21. A start timing to measure the above-described time C is not limited to the timing at which the controller starts the print operations. The start timing may be when the first sheet passes through a registration roller, when the first sheet reaches the fixing device, or the like. The optimum values of B sheets and the time C can be selected according to the productivity of the image forming apparatus, the thermal capacity of the fixing belt, the linear velocity of the sheet, the sheet thickness, etc. For example, B sheets may be set to 2 sheets, and the time C may be set to 10 seconds.

Figure 22A:
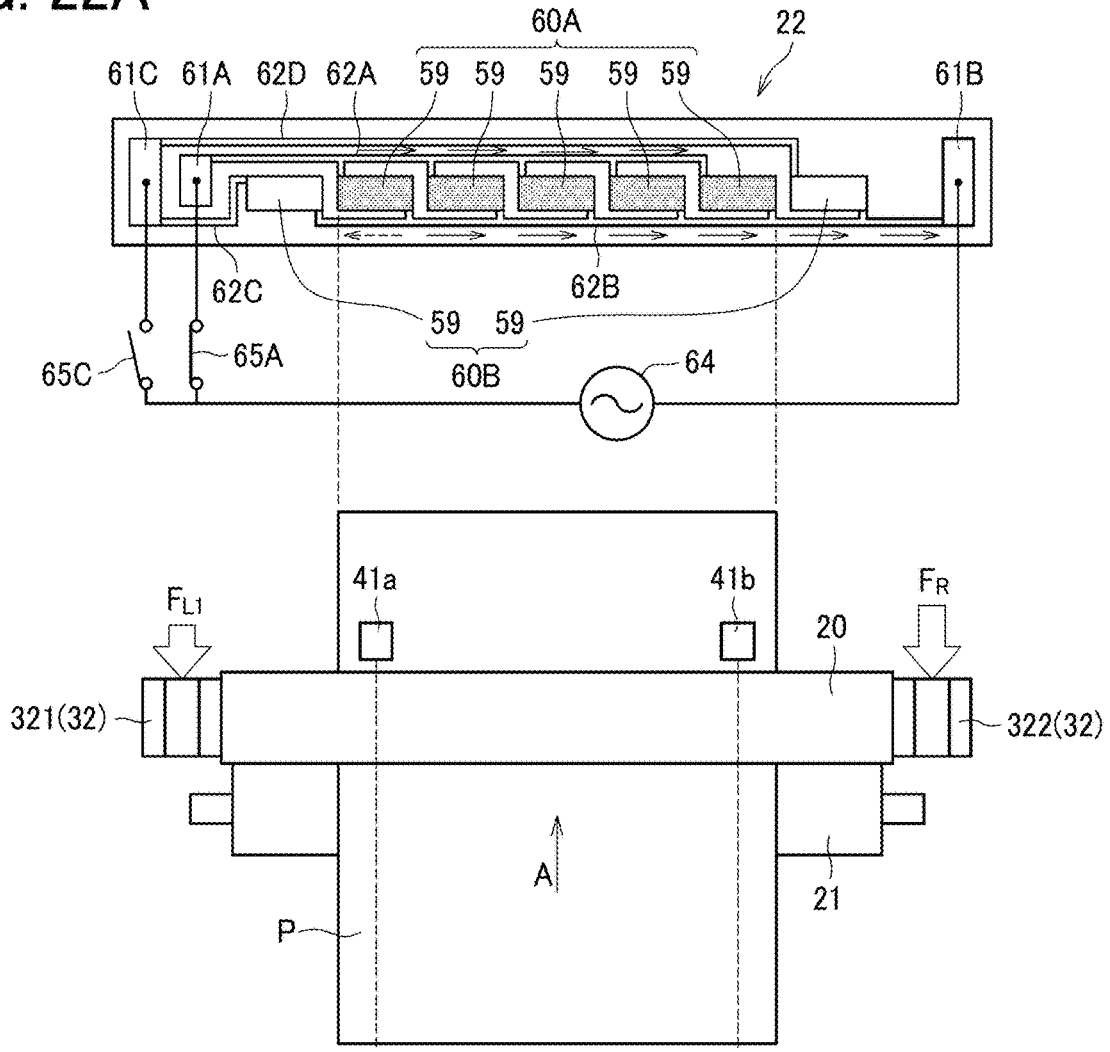
FIG. 22A is an explanatory view illustrating the heater and a longitudinal positional relationship of a plurality of temperature detectors disposed in the longitudinal direction and other parts in the fixing device according to an embodiment of the present disclosure, an upper part of FIG. 22A illustrates the heater, and a lower part of FIG. 22A illustrates the longitudinal positional relationship.
Figure 22B:
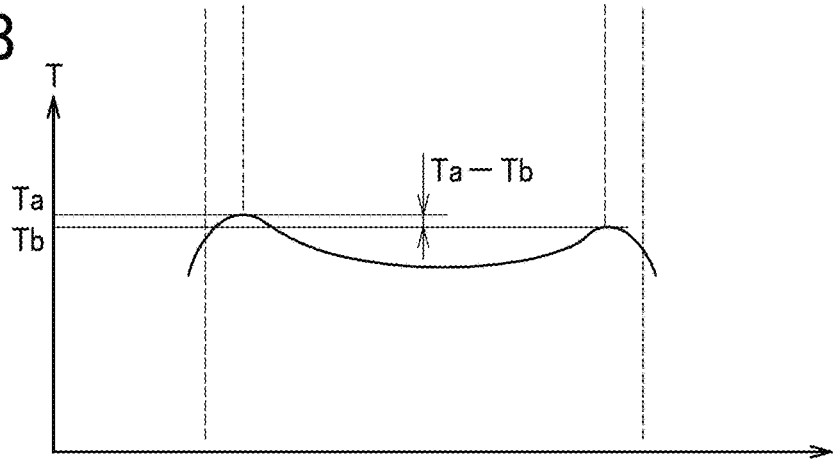
FIG. 22B is a graph illustrating a temperature distribution in the longitudinal direction of the fixing belt in the fixing device including the plurality of temperature detectors and depicted in FIG. 22A.

Next, with reference to FIG. 22, an embodiment is described in which the controller changes the pressure condition based on temperatures detected by the temperature detectors.

As illustrated in FIG. 22, the fixing device according to the present embodiment includes temperature detectors 41*a* and 41*b* facing the fixing belt 20 to detect a temperature of the surface of the fixing belt 20 on each of one portion of the fixing belt 20 and the other portion of the fixing belt 20 which are far from each other in the longitudinal direction of the fixing belt 20. The longitudinal direction of the fixing belt 20 is also the longitudinal direction of the heater 22 and the direction orthogonal to the sheet conveyance direction. As the temperature detectors 41*a* and 41*b*, for example, a thermistor may be adopted, and other temperature detectors may be appropriately used.

In the present embodiment, the temperature detectors 41*a* and 41*b* are disposed at positions corresponding to one end portion and the other end portion in the longitudinal direction of the small sheet P that passes through the fixing nip in the longitudinal direction of the heater 22. In other words, the temperature detectors 41*a* and 41*b* are disposed at the positions corresponding to the second block and the sixth block, respectively.

The controller determines whether the controller controls the pressing device to change the pressure condition depending on whether or not the difference between the temperature Ta detected by the temperature detector 41*a* and the temperature Tb detected by the temperature detector 41*b* exceeds the set temperature difference threshold T1. In the present embodiment, the controller uses the temperature detection results detected by the temperature detectors 41*a* and 41*b* to determine the pressure condition for the small sheet that passes through the fixing device 9.

Figure 23:
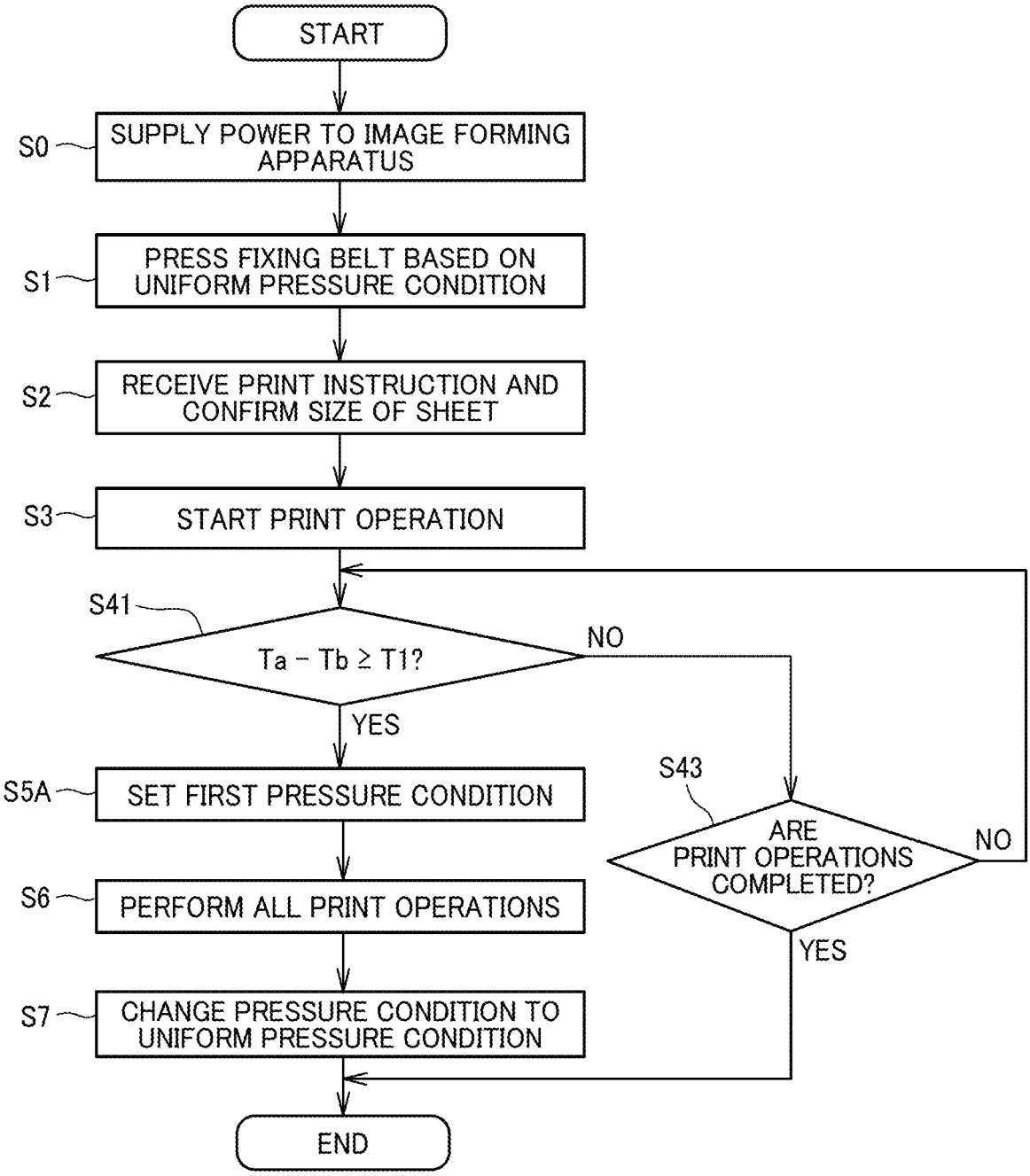
FIG. 23 is a flowchart illustrating a pressure condition control based on results detected by the plurality of temperature detectors according to an embodiment of the present disclosure.

Specifically, as illustrated in FIG. 23, when the controller receives the print instruction in step S2 and starts the print operations for the small sheet in step S3, the controller obtains the temperature detection results Ta and Tb detected by the temperature detectors 41*a* and 41*b* at a predetermined time intervals, calculates the difference Ta−Tb between the temperature detection results Ta and Tb, and determines whether the difference Ta−Tb is equal to or greater than the temperature difference threshold T1 in step S41. When the difference Ta−Tb is equal to or greater than the temperature threshold T1 (Yes in step S41), the controller controls the pressing device to change the pressure condition from the uniform pressure condition to the first pressure condition, and the pressing device reduces the pressing force applied to the one end portion of the fixing belt 20 in the longitudinal direction thereof. In other words, the controller controls one pressing device nearer to the temperature detector that detects a higher temperature among the temperature detectors 41*a* and 41*b* than the other pressing device to reduce the pressing force applied to the portion of the fixing belt 20. After the change of the pressure condition, similar to the embodiment illustrated in FIG. 20, the controller controls the pressing device to change the pressure condition to the uniform pressure condition after the all print operations are completed. When the difference Ta−Tb does not exceed the temperature threshold T1 (No in step S41), the controller determines whether the controller completes the print operations in step S43. As a result, the all print operations are completed.

Figure 24A:
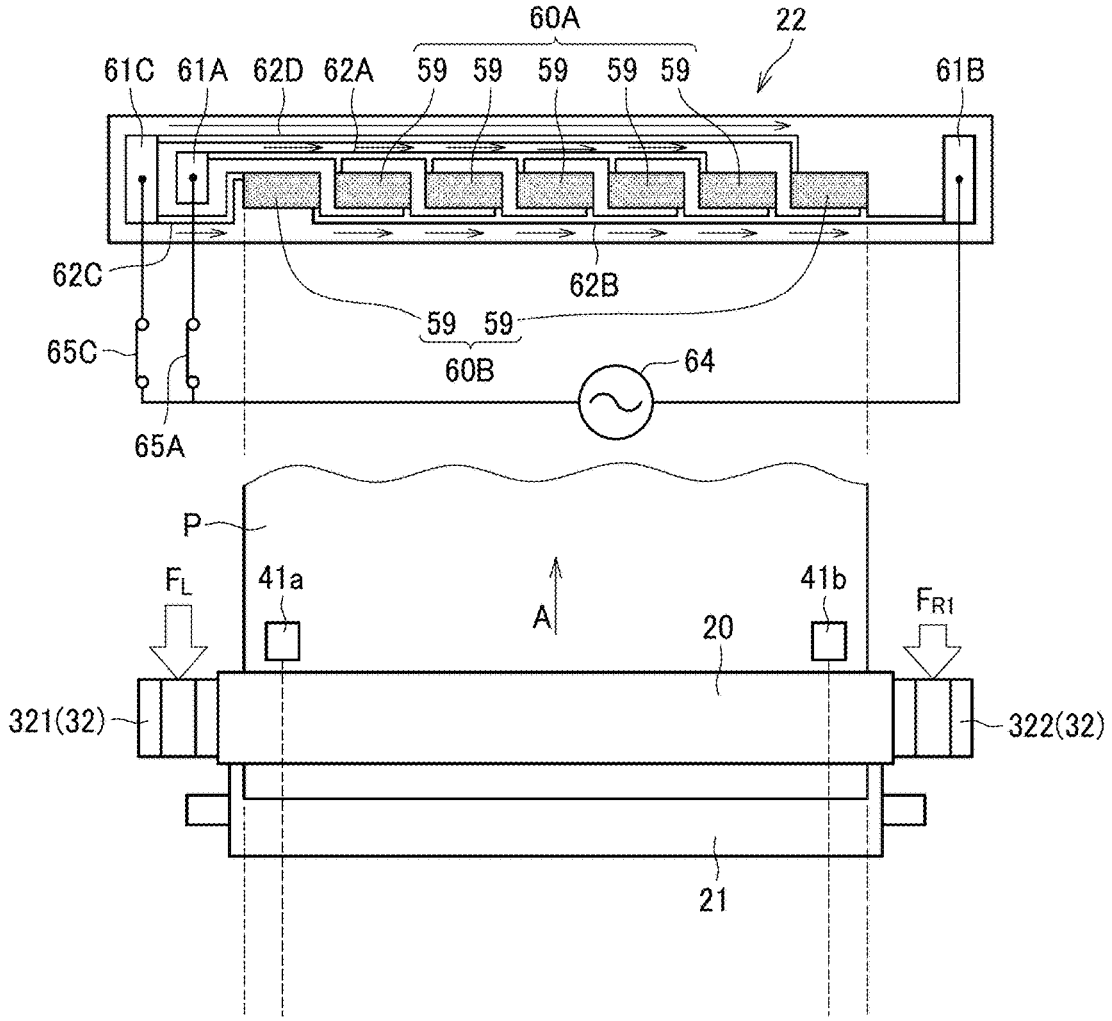
FIG. 24A is an explanatory view illustrating the heater and a longitudinal positional relationship of a plurality of temperature detectors disposed in the longitudinal direction and other parts in the fixing device according to an embodiment of the present disclosure, an upper part of FIG. 24A illustrates the heater, and a lower part of FIG. 24A illustrates the longitudinal positional relationship.
Figure 24B:
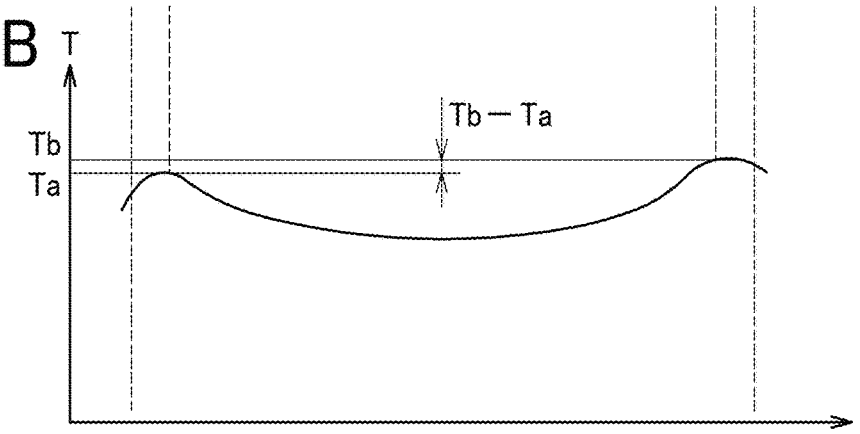
FIG. 24B is a graph illustrating a temperature distribution in the longitudinal direction of the fixing belt in the fixing device including the plurality of temperature detectors and depicted in FIG. 24A.

The temperature detectors may be disposed at positions corresponding to both end portions of the large sheet in the width direction of the large sheet. For example, as illustrated in FIG. 24, the temperature detectors 41*a* and 41*b* are disposed at positions corresponding to one end portion and the other end portion in the longitudinal direction of the large sheet P. In other words, the temperature detectors 41*a* and 41*b* are disposed at the positions corresponding to the first block and the seventh block, respectively. In the present embodiment, the controller uses the temperature detection results detected by the temperature detectors 41*a* and 41*b* to determine the pressure condition for the large sheet that passes through the fixing device 9.

Figure 25:
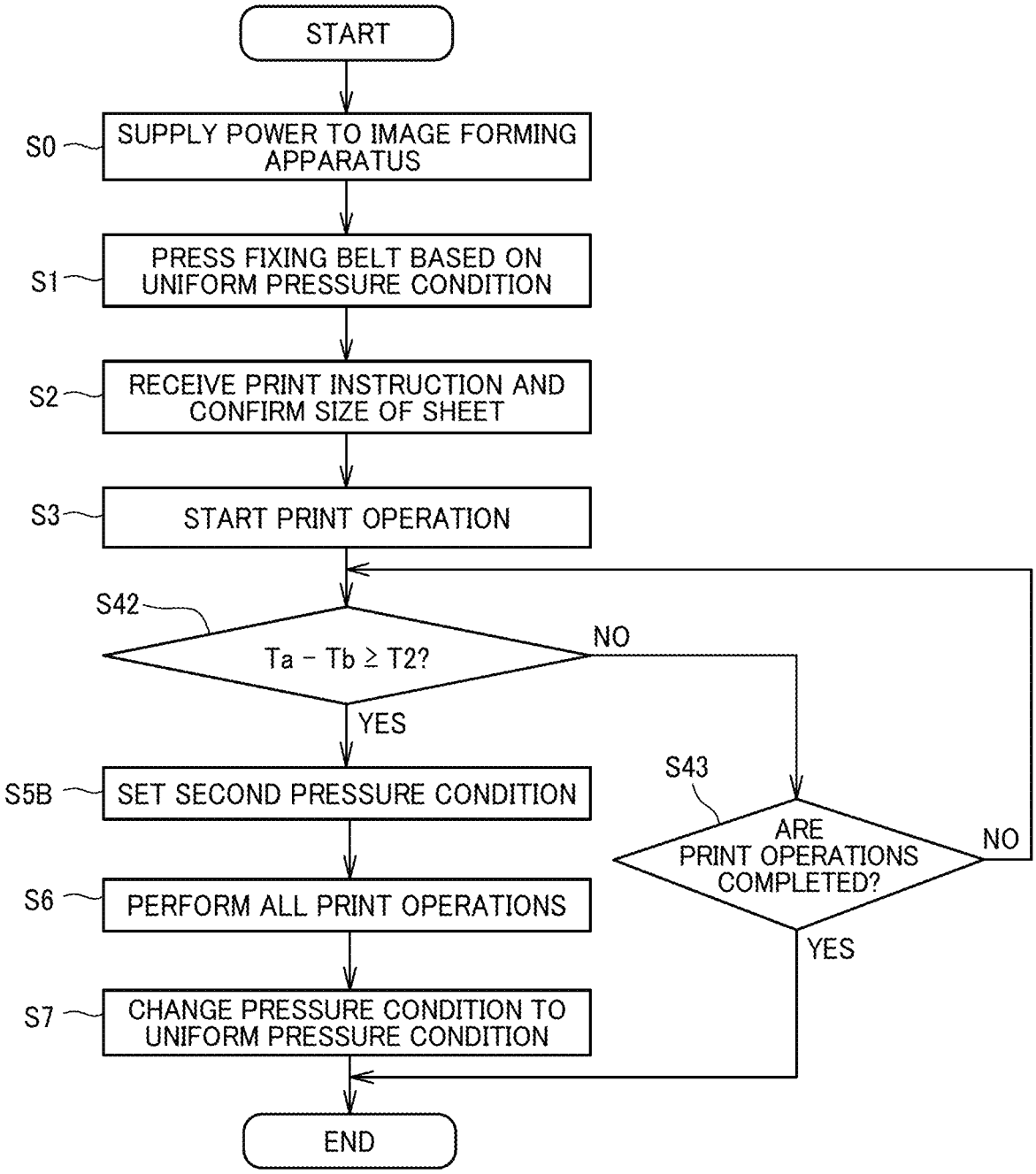
FIG. 25 is a flowchart illustrating a pressure condition control based on results detected by the plurality of temperature detectors of FIG. 24A according to an embodiment of the present disclosure.

Specifically, as illustrated in FIG. 25, when the controller receives the print instruction in step S2 and starts the print operations for the large sheet in step S3, the controller obtains the temperature detection results Ta and Tb detected by the temperature detectors 41*a* and 41*b* at a predetermined time intervals, calculates the difference Ta−Tb between the temperature detection results Ta and Tb, and determines whether the difference Ta−Tb is equal to or greater than a temperature difference threshold T2 in step S42. When the difference Ta−Tb is equal to or greater than the temperature threshold T2 (Yes in step S42), the controller controls the pressing device to change the pressure condition from the uniform pressure condition to the second pressure condition, and the pressing device reduces the pressing force applied to the other end portion of the fixing belt 20 in the longitudinal direction thereof. In other words, the pressing device reduces the pressing force applied to the portion of the fixing belt 20 at which one of the temperature detectors 41*a* and 41*b* detects a higher temperature than the other one of the temperature detectors 41*a* and 41*b*.

As described above, the temperature detectors 41*a* and 41*b* to detect the temperatures of the fixing belt 20 enables changing the pressure condition at a more appropriate timing. Accordingly, the above-described embodiment can prevent the disadvantage caused by the temperature difference between the one portion and the other portion of the heater 22 in the longitudinal direction. That is, the unevenness in glossiness of the image and the uneven fixing property of the image on the sheet can be efficiently reduced. In addition, the time during which the pressure deviation occurs in each of the fixing belt 20 and the pressure roller 21 in the present embodiment is shorter than that in the embodiment illustrated in FIG. 20, and the present embodiment can reduce the lateral deviation of abrasion of the fixing belt 20 and the pressure roller 21.

The temperatures T1 and T2 are preferably set to 20 deg or less in order to effectively prevent the unevenness in glossiness of the image and the uneven fixing property. The temperatures T1 and T2 are set in consideration of the temperature detection errors of the temperature detectors 41*a* and 41*b*, the error of the arrangement, the variation of the sheet conveyance position with respect to the fixing nip, and the error of the arrangement of the resistive heat generators 59. That is, in order to avoid detection errors due to these factors, it is more preferable to set the temperatures T1 and T2 to about 10 deg.

As described above, the image forming apparatus according to the present embodiment can change the pressure conditions at each timing for each of the large sheet and the small sheet. In one image forming apparatus, the condition for changing to the first pressure conditions and the condition for changing to the second pressure condition may be common or different. For example, the controller may change the pressure condition to the first pressure condition immediately after the controller starts the printing operations for the small sheet but, when the large sheet is printed, the controller may change the pressure condition after the Bth sheet passes through the fixing device 9. Depending on how the temperature difference occurs, the condition for changing the pressure condition may be appropriately selected. The controller may change the pressure condition only for one of the sizes of sheets.

As a timing different from the timing described above to change the pressure condition, the controller may change the pressure condition while the sheet passes through the fixing device (i.e. the sheet P passes through the fixing nip N in FIG. 2) and set the uniform pressure condition before or after the sheet P passes through the fixing device. The above-described timing can further reduce the time during which the pressure deviation occurs, without impairing the effect of preventing uneven glossiness of the image and the uneven fixing property of the image.

In the above embodiments, the pressing device presses the portion of the fixing belt 20 (that is, the one of the flanges that supports the portion of the fixing belt 20) corresponding to the portion of the heater 22 generating the larger amount of heat than the other portion of the heater 22 with the pressing force smaller than the pressing force of the uniform pressure condition. However, conversely, the pressing device may press the one of the flanges that supports the portion of the fixing belt 20 corresponding to the portion of the heater 22 generating the smaller amount of heat than other portion of the heater 22 with the pressing force larger than the pressing force of the uniform pressure condition.

In the above embodiments, when the controller completes all the print operations, the controller controls the pressing devices to return the pressure condition to the uniform pressure condition. However, the timing to return the pressure condition to the uniform pressure condition is not limited to this and may be set immediately after the sheet is lastly ejected from the main body of the image forming apparatus 1 in FIG. 1 (that is, immediately after the sheet is lastly ejected to the outside of the image forming apparatus 1 in FIG. 1) or immediately after the sheet lastly passes through the fixing device (that is, immediately after the trailing edge of the sheet P passes through the fixing nip N in FIG. 2). The above-described timing can further reduce the time during which the pressure deviation occurs in the fixing belt 20 and the pressure roller 21, without impairing the effect of preventing uneven glossiness of the image and the uneven fixing property of the image.

Next, the pressing device to press each of the flanges 321 and 322 and change the pressing force applied to each of the flanges 321 and 322 is described.

Figure 26A:
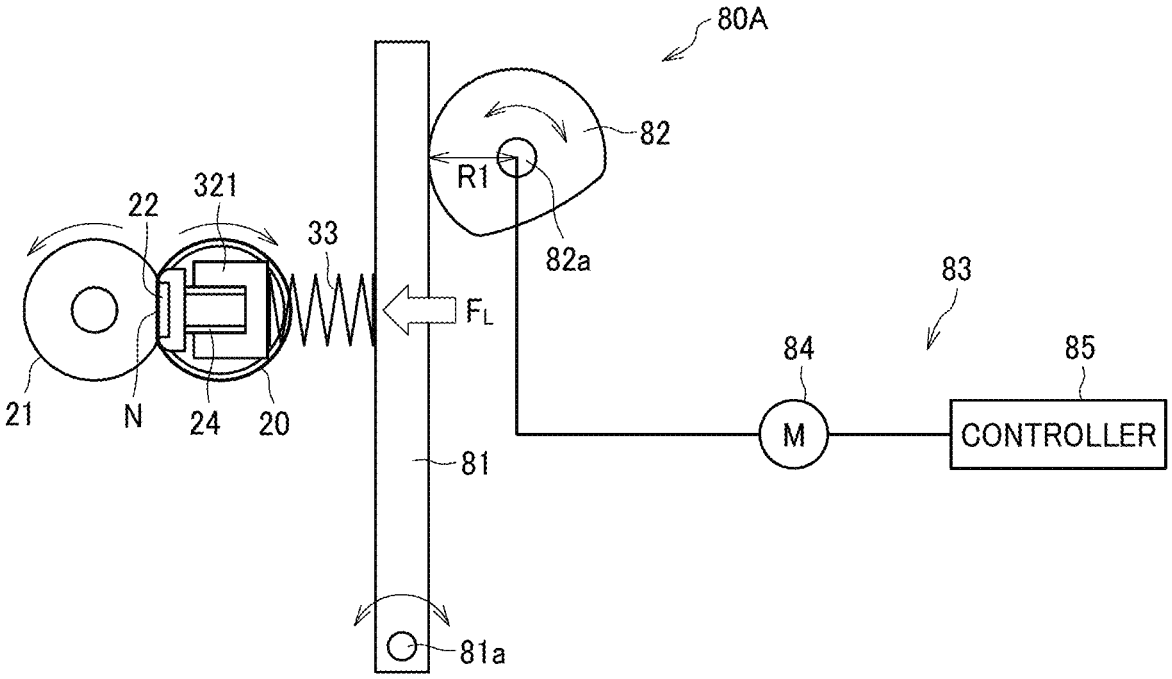
FIGS. 26A and 26B are explanatory views illustrating pressing devices under the equal pressure condition, according to an embodiment of the present disclosure.

As illustrated in FIG. 26A, the fixing device 9 includes the pressing device 80A to press the flange 321 disposed on one end of the fixing belt 20 in the longitudinal direction of the fixing belt 20. The pressing device 80A includes a spring 33 as a biasing member, a pressure lever 81 as a pressing unit, and a cam 82 as a pressing force adjuster.

One end of the spring 33 is coupled to the flange 321, and the other end of the spring 33 is coupled to the pressure lever 81.

The pressure lever 81 has a fulcrum 81*a* at one longitudinal end thereof. The fulcrum 81*a* is fixed to the frame of the fixing device 9 (for example, the side wall 28 in FIG. 3), and the pressure lever 81 is rotatably provided around the fulcrum 81*a* (see the double-headed arrow in FIG. 26A). The other longitudinal end of the pressure lever 81 contacts the cam 82. The spring 33 is coupled to a surface of the pressure lever 81 opposite the right surface of the pressure lever 81 in FIG. 26A on which the cam 82 contacts.

The cam 82 is provided rotatably around a cam shaft 82*a*. The cam shaft 82*a* is coupled to the drive control mechanism 83.

The drive control mechanism 83 includes a motor 84 that applies a rotational drive force to the cam shaft 82*a* and a controller 85 that controls the motor.

The cam 82 presses the one end of the pressure lever 81, and the pressing force is transmitted to the flange 321 via the spring 33 and presses the fixing belt 20 against the pressure roller 21.

Figure 26B:
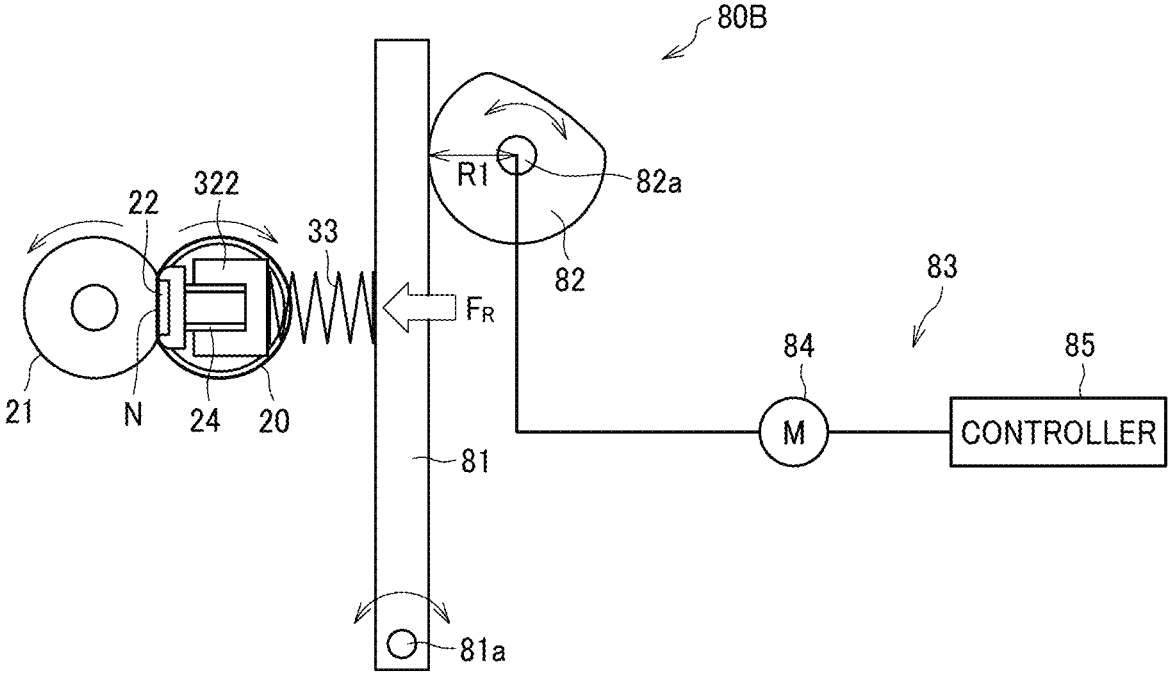

As illustrated in FIG. 26B, similar to the pressing device 80A to press the flange 321, the fixing device 9 includes the pressing device 80B to press the flange 322 disposed on the other end of the fixing belt 20 in the longitudinal direction of the fixing belt 20. The pressing device 80B has basically the same configuration as the pressing device 80A. The cams 82A and 82B provided on the pressing devices 80A and 80B have a common cam shaft 82*a*. The drive control mechanism 83 gives a driving force to the cam shaft 82*a* and rotates the cams 82A and 82B by the same phase. In the present embodiment, the two cams 82A and 82B are mounted in a phase shift of 120 degrees relative to the cam shaft 82*a*. The drive control mechanism 83 that rotates the cam shaft 82*a* includes a pulse motor that drives the cam shaft 82*a* at intervals of 120 degrees. Each pressure lever 81 is independently rotatable about each fulcrum 81*a*.

The pressing device 80A presses the flange 321, the pressing device 80B presses the flange 322, and the flanges 321 and 322 press the fixing belt 20 against the pressure roller 21 to form the fixing nip N.

The drive control mechanism 83 rotates the cam shaft 82*a* to change the pressing forces applied to the flanges 321 and 322. That is, rotating each cam 82 about the cam shaft 82*a* changes a surface at which the cam 82 contacts the pressure lever 81 to change the pressing force.

In the uniform pressure condition, as illustrated in FIGS. 26A and 26B, the pressing devices 80A and 80B set the both cams 82A and 82B so that long radius portions of the both cams 82A and 82B (each of which has a radius R1) contact the pressure lever 81. As a result, the pressing devices 80A and 80B apply the same pressing forces FL and FR to the flanges 321 and 322, respectively. The cam 82A of the pressing device 80A and the cam 82B of the pressing device 80B have different rotational phases, and short radius portions of the cams 82A and 82B contact the pressure lever 81 at different timings. Note that FIGS. 26A and 26GB are views seen from the same direction.

Figure 27A:
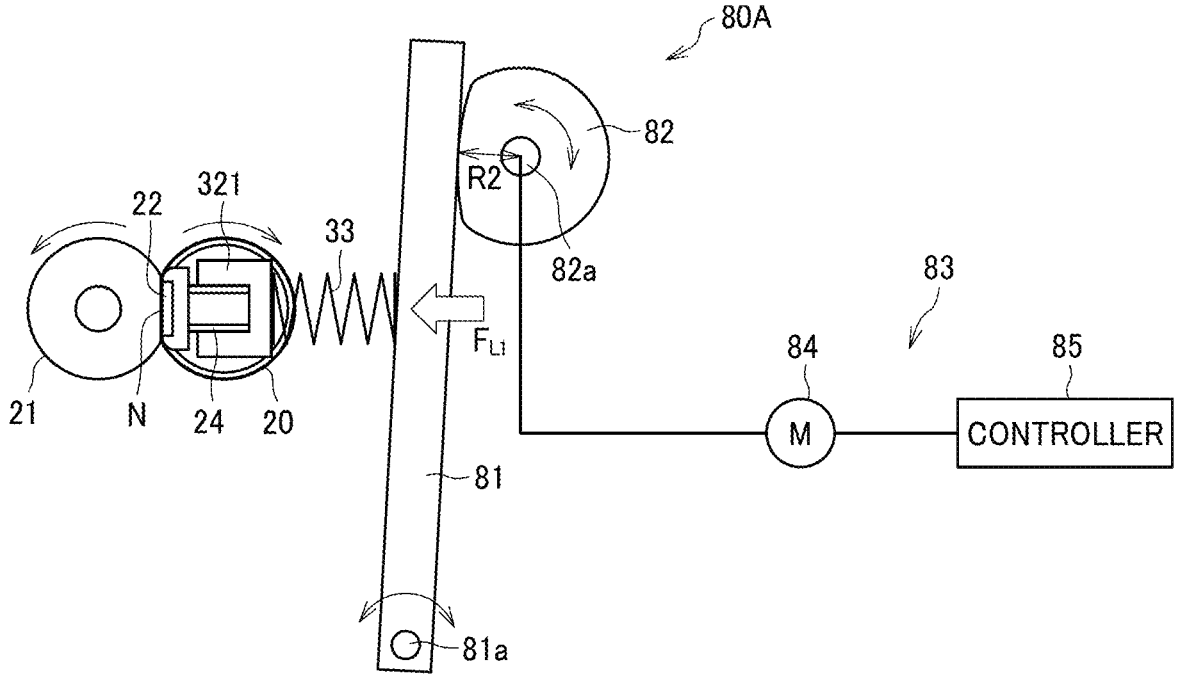
FIGS. 27A and 27B are explanatory views illustrating the pressing devices under a first pressure condition, according to an embodiment of the present disclosure.
Figure 27B:
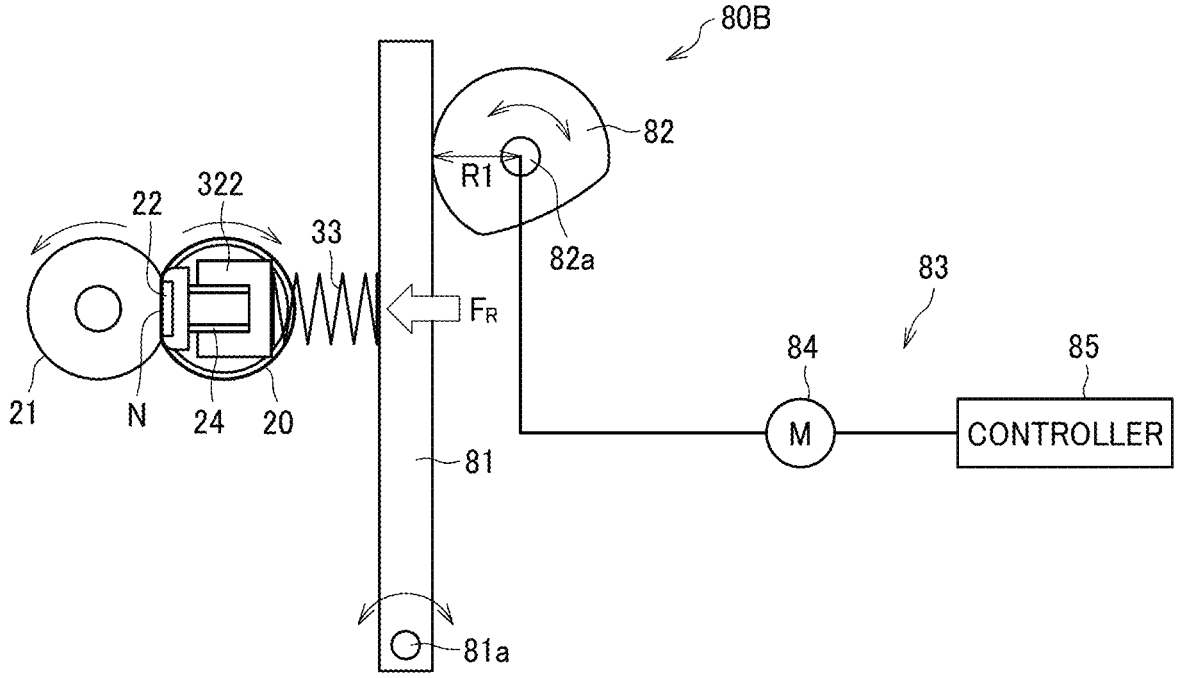

As illustrated in FIGS. 27A and 27B, rotating the cam shaft 82*a* by a predetermined rotation amount (i.e. in the present embodiment, 120 degrees clockwise from the phase illustrated in FIG. 26A) changes the pressure condition from the uniform pressure condition to the first pressure condition. Specifically, the short radius portion (i.e. a portion having a radius R2) of the cam 82 in the pressing device 80A contacts the pressure lever 81, and the long radius portion of the cam 82 in the pressing device 80B contacts the pressure lever 81. Changing the surface at which the cam 82 of the pressing device 80A contacts the pressure lever 81 from the long radius portion to the short radius portion reduces the pressing force of the cam 82 on the pressure lever 81 and decreases a spring load of the spring 33 that acts on the flange 321. That is, the pressing force applied to the flange 321 becomes small. On the other hand, the pressing force of the pressing device 80B that presses the flange 322 does not change. As a result, the pressing forces of the pressing devices 80A and 80B are set to be the pressing forces FL1 and FR, respectively. According to the displacement of the pressure lever 81 in the lateral direction in FIGS. 26A and 27A, the amount of expansion or contraction of the spring 33 changes.

Figure 28A:
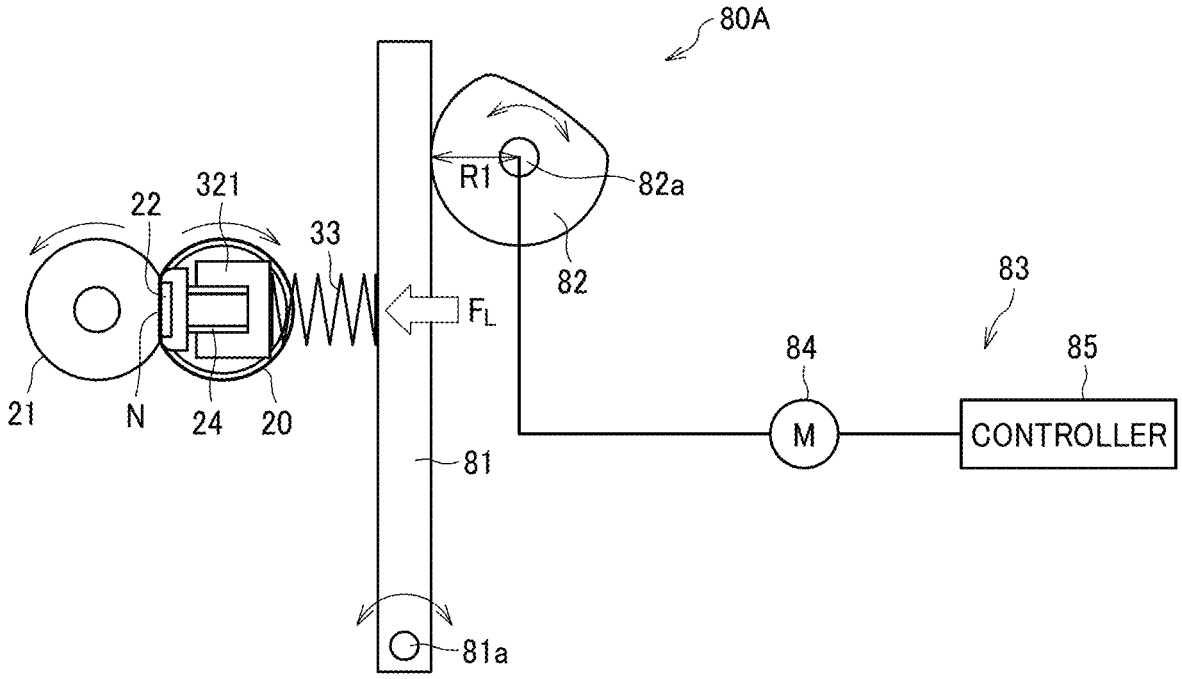
FIGS. 28A and 28B are explanatory views illustrating the pressing devices under a second pressure condition, according to an embodiment of the present disclosure.
Figure 28B:
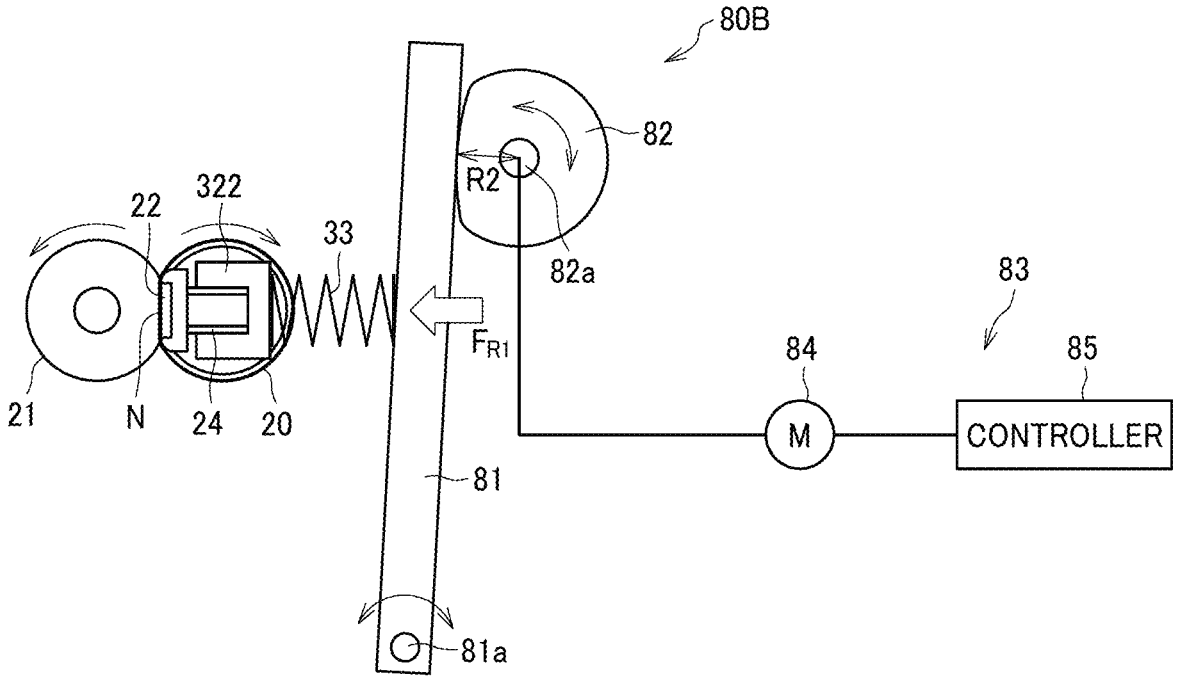

As illustrated in FIGS. 28A and 28B, rotating the cam shaft 82*a* by a predetermined rotation amount (i.e. in the present embodiment, 240 degrees clockwise from the phase illustrated in FIG. 26A), which is different from the rotation amount for changing the first pressure condition, changes the pressure condition to the second pressure condition. Specifically, the long radius portion of the cam 82 in the pressing device 80A contacts the pressure lever 81, and the short radius portion of the cam 82 in the pressing device 80B contacts the pressure lever 81 to set the pressing force FL in the pressing device 80A and the pressing force FR1 in the pressing device 80B.

Changing the phases of the cams 82A and 82B in the pressing devices 80A and 80B enables a configuration in which the common cam shaft 82*a* rotates the cams 82A and 82B to change the pressing forces in the pressing devices 80A and 80B. Sharing the cam shaft 82*a* between the pressing devices 80A and 80B can reduce the driving force of the pressing devices 80A and 80B and prevent an occurrence of deviation in the rotational phase between the cams 82A and 82B.

In the above embodiments, the pressing device corresponding to the portion of the heater that generates the larger amount of heat than the other portion of the heater in the longitudinal direction of the heater reduces the pressing force. However, the pressing device corresponding to the portion of the heater that generates the smaller heat generation amount than the other portion may increase the pressing force. That is, the pressing device 80B may increase the pressing force to set the first pressure condition, and the pressing device 80A may increase the pressing force to set the second pressure condition.

Figure 29A:
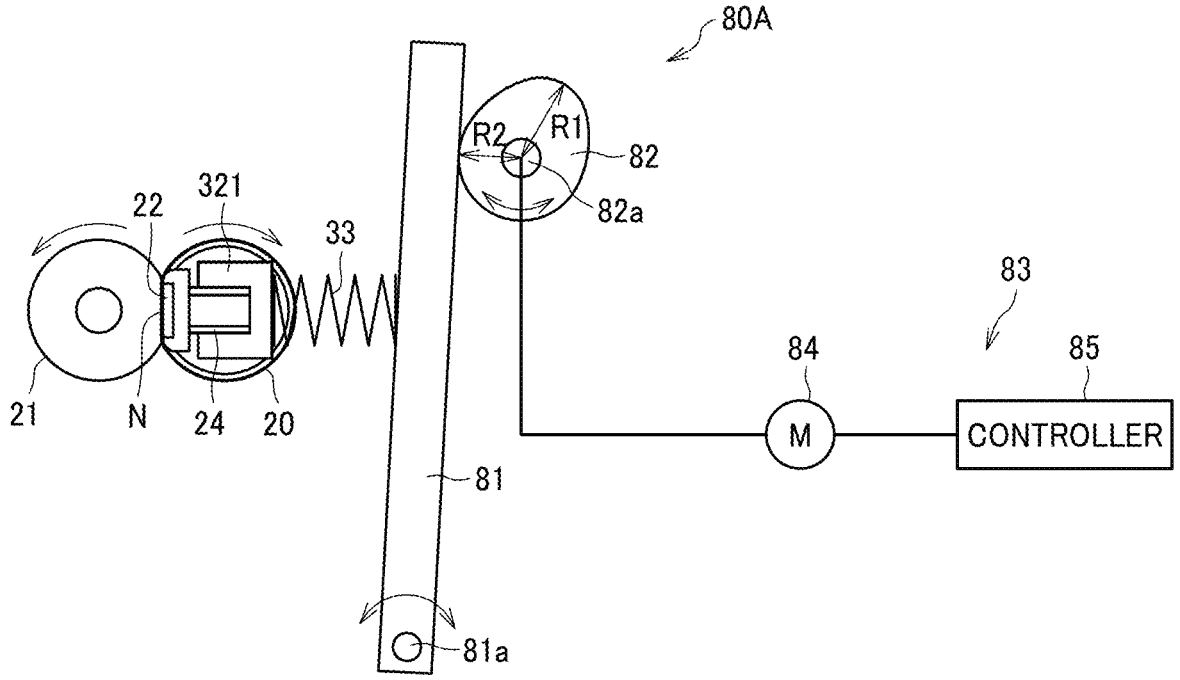
FIGS. 29A and 29B are explanatory views illustrating pressing devices according to another embodiment.
Figure 29B:
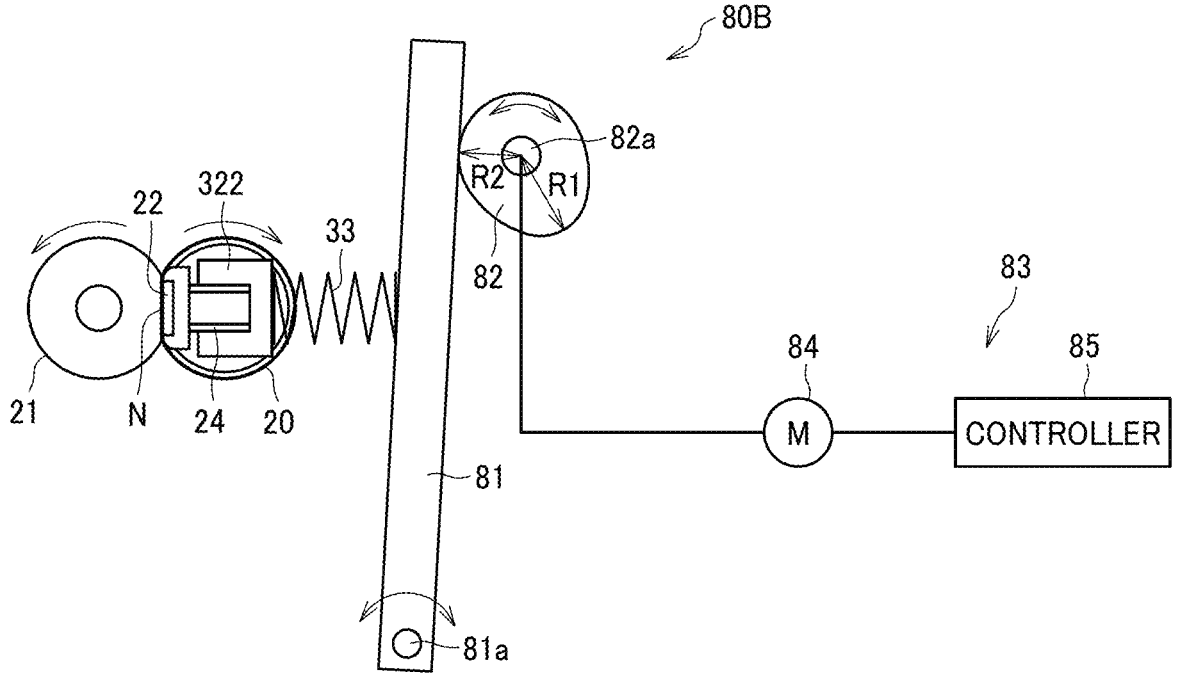

As an embodiment, FIGS. 29A and 29B illustrates the pressing device 80A and the pressing device 80B that increase the pressing force as described above. The difference from the pressing devices in the other embodiments described above is that the circumferential range of the short radius portion (i.e. the portion having the radius R2) of each of the cams 82A and 82B is wider than the circumferential range of the long radius portion (i.e. the portion having the radius R1). Similar to the other embodiments, the phase of the cam 82A in the pressing device 80A is different from the phase of the cam 82B in the pressing device 80B by 120 degrees. FIGS. 29A and 29B illustrate the pressing devices 80A and 80B under the uniform pressure condition. Rotating the cam shaft 82*a* illustrated in FIGS. 29A and 29B clockwise by 120 degrees causes the long radius portion of the cam 82B in the pressing device 80B to contact the pressure lever 81. As a result, the pressing force FR applied by the pressing device 80B is changed to be larger than the pressing force FL applied by the pressing device 80A. Alternatively, rotating the cam shaft 82*a* illustrated in FIGS. 29A and 29B clockwise by 240 degrees causes the long radius portion of the cam 82A in the pressing device 80A to contact the pressure lever 81. As a result, the pressing force FL applied by the pressing device 80A is changed to be larger than the pressing force FR applied by the pressing device 80B.

In the above embodiments, the pressing devices 80A and 80B change the pressing forces. However, each of the pressing devices 80A and 80B may change the pressing force to change a pressing amount of the fixing belt 20 to the pressure roller 21 to change the fixing nip width.

Figure 30:
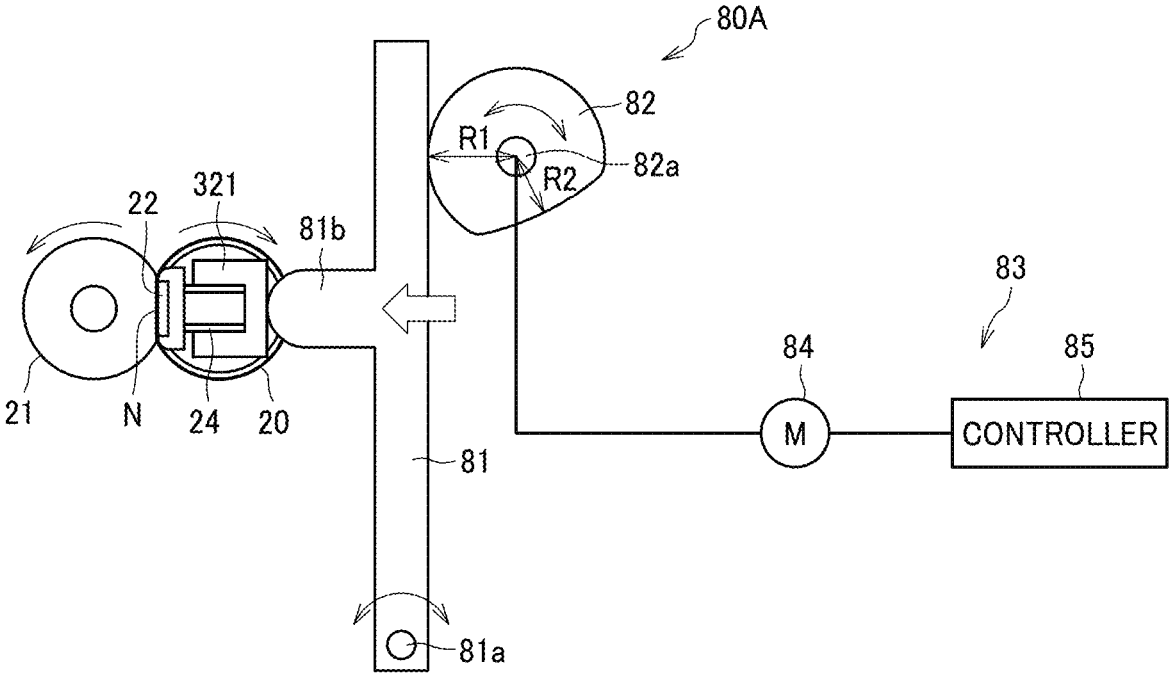
FIG. 30 is an explanatory view illustrating a pressing device according to still another embodiment.

For example, as illustrated in FIG. 30, the pressure lever 81 in the pressing device 80A according to the present embodiment includes a pressure portion 81*b* instead of the spring 33. The pressure portion 81*b* projects toward the flange 321 and contacts the flange 321. The pressing device 80B basically has the same configuration.

In the pressing device including the spring 33 described above, the displacement of pressure lever 81 is replaced and absorbed by the amount of compression of the spring 33. On the other hand, in the present embodiment, the flange 321 moves by an amount corresponding to the displacement of the pressure lever 81 in the lateral direction in FIG. 30, and the displacement of the pressure lever 81 changes a state in which the fixing belt 20 presses against the pressure roller 21. That is, the width of the fixing nip N changes.

FIG. 30 illustrates the cam 82A including the short radius portion with a narrow circumferential range. However, as illustrated in FIG. 29, each of the cams 82A and 82B may include the long radius portion with a narrow circumferential range to increase the width of the fixing nip N on a portion of the fixing belt near the portion of the heater that generates smaller heat the other portion of the heater in the longitudinal direction of the heater.

In the above-described embodiments, one of the pressing devices corresponding to the one portion of the heater that generates the larger amount of heat than the other portion of the heater generates the smaller pressing force than the other pressing device corresponding to the other portion of the heater, which prevents the disadvantage caused by the temperature difference of the heater 22 and the fixing belt 20 in the longitudinal direction. That is, the fixing device according to the present disclosure prevents uneven glossiness of the image and uneven fixing property of the image. Accordingly, speeding up and downsizing the image forming apparatus can be achieved.

Figure 31:
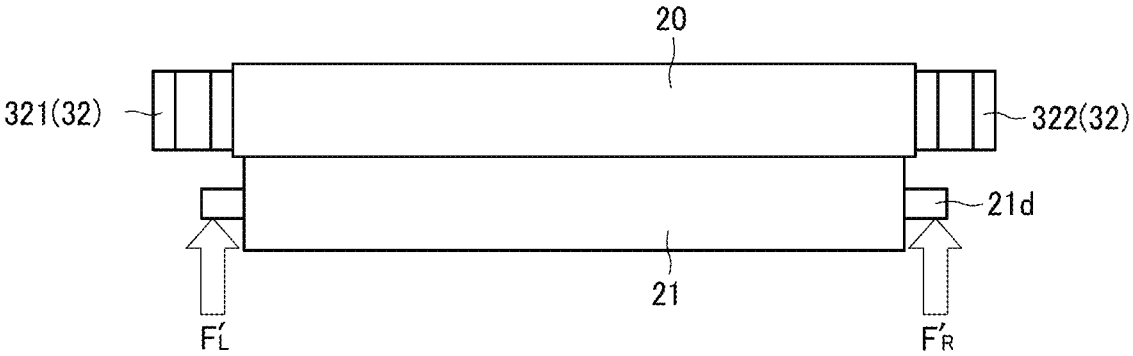
FIG. 31 is an explanatory view illustrating a fixing device including pressing devices that presses a pressure roller.

The pressing devices in the above embodiments press the flanges supporting the fixing belt. However, as illustrated in FIG. 31, the pressing device may press the shaft 21*d* of the pressure roller 21 to press the pressure roller 21 against the fixing belt 20. Although the pressing device presses the shaft 21*d* of the pressure roller 21 in FIG. 31, the pressing device may press a bearing supporting the shaft of the pressure roller 21.

Figure 32:
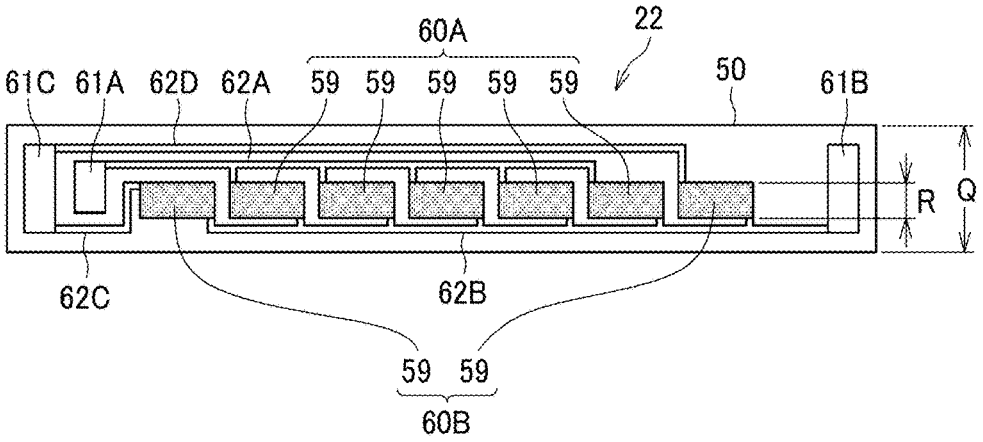
FIG. 32 is a plan view of the heater, illustrating a short-side dimension of the heater and a short-side dimension of the resistive heat generators.

The Embodiments of the present disclosure are particularly suitable for the heater downsized in the short-side direction. Specifically, it is preferable for the embodiments to be applied to the heater 22 illustrated in FIG. 32 in which a ratio (R/Q) of the short-side dimension R of the resistive heat generators 59 to the short-side dimension Q of the heater 22 (i.e. the base 50) is not less than 25%. It is more preferably for the embodiments to be applied to the heater 22 having the ratio (R/Q) of 40% or more in the short-side direction. A larger effect can be expected by applying the embodiments to the small heater 22 as described above.

In order to decrease the variation in the temperature of the heater 22 described above, a resistive heat generator having a PTC characteristic may be used. PTC defines a property in which the resistance value increases as the temperature increases. Therefore, for example, a heater output decreases under a given voltage when the temperature increases. The heat generator having the PTC property starts quickly with an increased output at low temperatures and prevents overheating with a decreased output at high temperatures. For example, if a temperature coefficient of resistance (TCR) of the PTC is in a range of from about 300 ppm/° C. to about 4,000 ppm/° C., the heater 22 is manufactured at reduced costs while retaining a resistance required for the heater 22. The TCR is preferably in a range of from about 500 ppm/° C. to about 2,000 ppm/° C.

The TCR can be calculated using the following equation (2). In the equation (2), T0 represents a reference temperature, T1 represents a freely selected temperature, R0 represents a resistance value at the reference temperature T0, and R1 represents a resistance value at the selected temperature T1. For example, in the heater 22 described above with reference to FIG. 7, the TCR is 2,000 ppm/° C. from the equation (2) when the resistance values between the first electrode 61A and the second electrode 61B are 10Ω (i.e., resistance value R0) and 12Ω (i.e., resistance value R1) at 25° C. (i.e., reference temperature T0) and 125° C. (i.e., selected temperature T1), respectively.

$$TCR=(R1-R0)/R0/(T1-T0)\times 106 \quad (2)$$

Figure 33A:
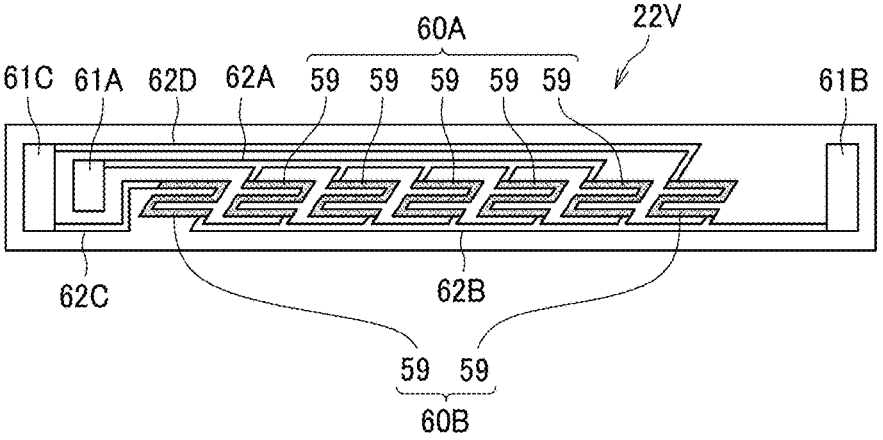
FIGS. 33A and 33B are plan views of heaters according to variations of the present disclosure.
Figure 33B:
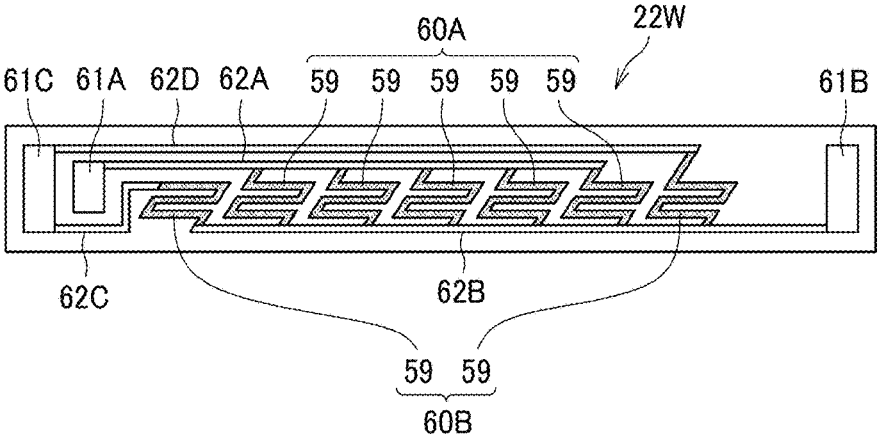

The heater to which the embodiments of the present disclosure are applied is not limited to the heater 22 including block-shaped (or square-shaped) resistive heat generators 59 as illustrated in FIG. 7. For example, FIGS. 33A and 33B are plan views of heaters 22V and 22W as variations of the heater 22. The embodiments are applicable to the heaters 22V and 22W including resistive heat generators 59 having a shape in which a straight line is folded back as illustrated in FIGS. 33A and 33B. The embodiments are also applicable to a heater including resistive heat generators having another shape. In FIGS. 33A and 33B, portions filled with gray are the resistive heat generators 59. In FIG. 33A, the heater 22V has power supply lines extending in a direction intersecting the longitudinal direction of the heater 22V from the power supply line 62A or 62D extending in the longitudinal direction. On the other hand, in FIG. 33B, the heater 22W has the resistive heat generators 59 having portions extending in the direction intersecting the longitudinal direction of the heater 22W from the power supply line 62A or 62D extending in the longitudinal direction.

Figure 34:
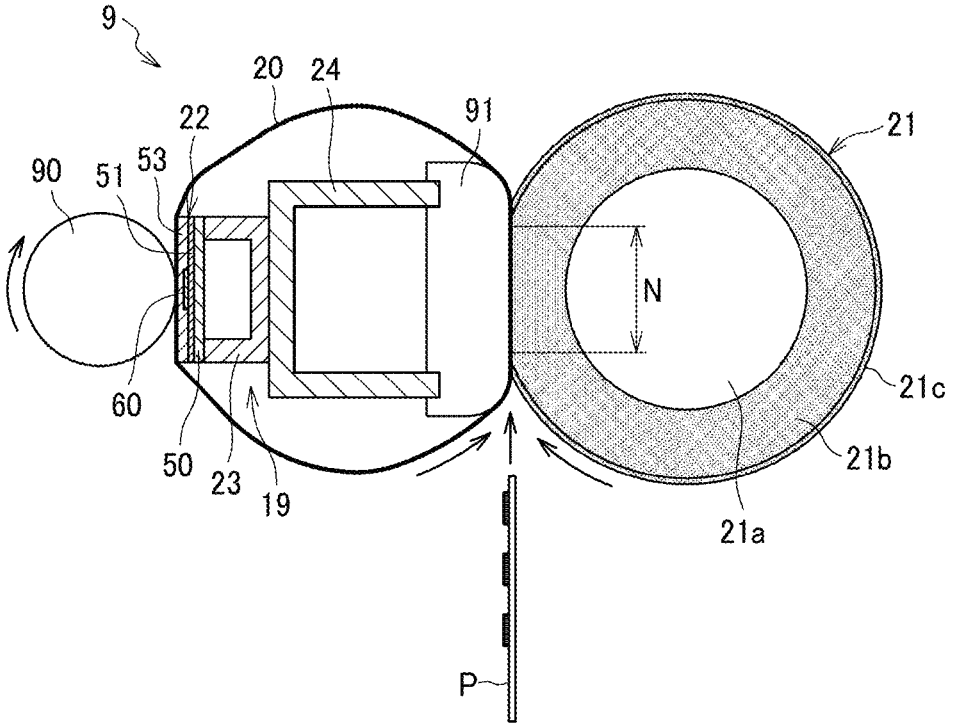
FIG. 34 is a schematic cross-sectional view illustrating a configuration of another fixing device according to an embodiment of the present disclosure.
Figure 35:
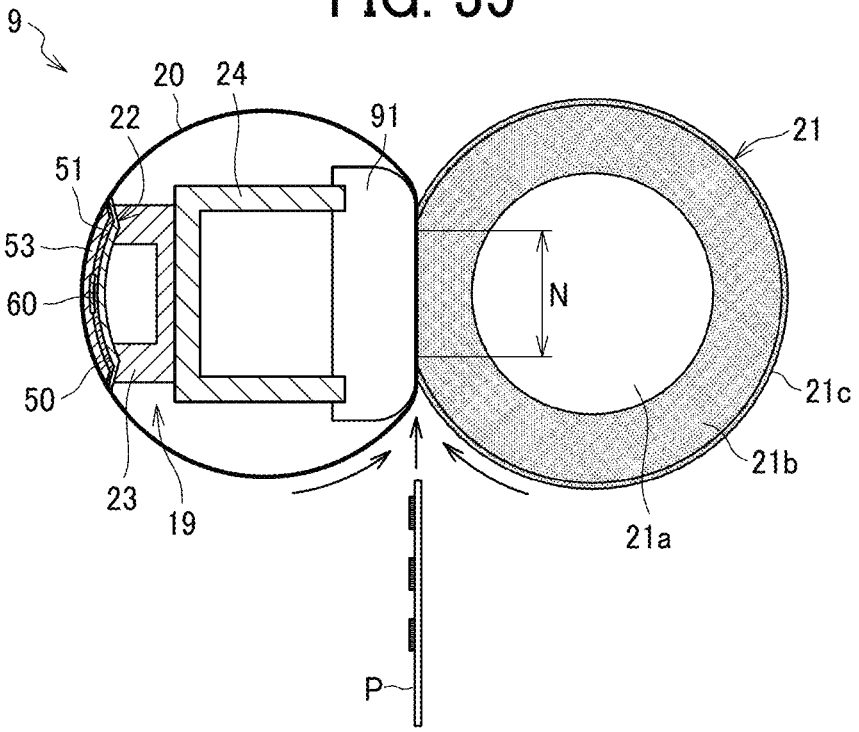
FIG. 35 is a schematic cross-sectional view illustrating a configuration of still another fixing device according to an embodiment of the present disclosure.
Figure 36:
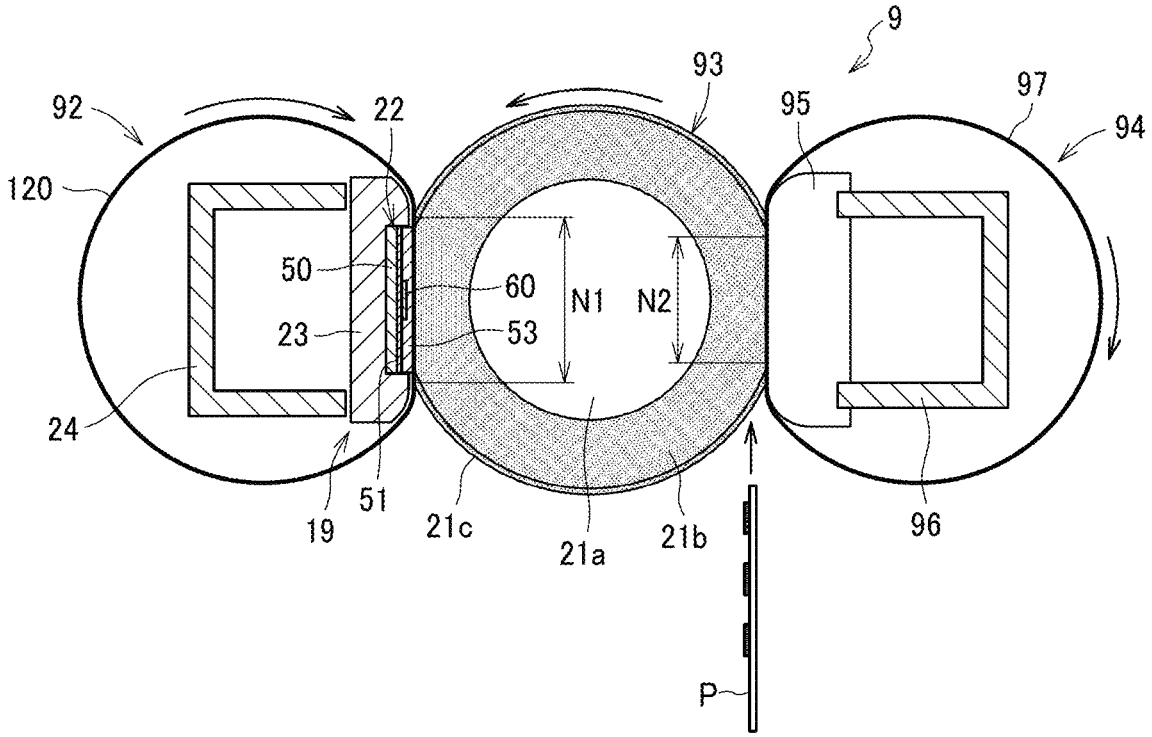
FIG. 36 is a schematic cross-sectional view illustrating a configuration of still another fixing device according to an embodiment of the present disclosure.

The embodiments of the present disclosure are also applicable to fixing devices as illustrated in FIGS. 34 to 36, respectively, other than the fixing device 9 described above. Referring now to FIGS. 34 to 36, a description is given of some variations of the fixing devices.

First, the fixing device 9 illustrated in FIG. 34 includes a pressurization roller 90 opposite the pressure roller 21 with respect to the fixing belt 20. The fixing belt 20 is sandwiched by the pressurization roller 90 and the heater 22 and heated by the heater 22. On the other hand, a nip formation pad 91 is disposed inside the loop of the fixing belt 20 and opposite the pressure roller 21. The stay 24 supports the nip formation pad 91. The fixing belt 20 is sandwiched by the nip formation pad 91 supported by the stay 24 and the pressure roller 21 to form the nip N between the fixing belt 20 and the pressure roller 21.

The fixing device 9 illustrated in FIG. 34 also includes the pressing devices as described in the above embodiments. The pressing device presses one of the fixing belt 20 and the pressure roller 21 against the other one of the fixing belt 20 and the pressure roller 21 or may press both the fixing belt 20 and the pressure roller 21 so that the fixing belt 20 and the pressure roller 21 press each other. One of the pressing devices corresponding to the one portion of the heater that generates the larger amount of heat than the other portion of the heater generates the smaller pressing force than the other pressing device corresponding to the other portion of the heater. As a result, the nip pressure in the part of the nip N corresponding to the portion of the heater 22 that generates the larger amount of heat than the other portion of the heater 22 in the longitudinal direction becomes relatively smaller than the nip pressure in the other part of the nip N. In addition, the nip width in the part of the nip N corresponding to the portion of the heater 22 that generates the larger amount of heat than the other portion of the heater 22 in the longitudinal direction becomes relatively smaller than the nip width in the other part of the nip N. Accordingly, the above-described fixing device 9 can prevent the disadvantage caused by the temperature difference between the one end portion and the other end portion in the longitudinal direction of the heater 22. That is, the above-described fixing device can reduce the difference in the fixing property between the one end portion and the other end portion of the image in the longitudinal direction of the image and the unevenness in glossiness of the image in the longitudinal direction. That is, unevenness of the image or the unevenness in glossiness of the image on the sheet can be reduced.

Next, a description is given of in the fixing device 9 illustrated in FIG. 35, which does not include the above-described pressurization roller 90. The fixing device 9 in FIG. 35 includes the heater 22 formed to be arc having a curvature of the fixing belt 20 to keep a circumferential contact length between the fixing belt 20 and the heater 22. Other parts of the fixing device 9 illustrated in FIG. 35 are the same as the fixing device 9 illustrated in FIG. 34.

Finally, the fixing device 9 illustrated in FIG. 36 is described. The fixing device 9 includes a heating assembly 92, a fixing roller 93 that is a rotator and a fixing member, and a pressure assembly 94 that is a facing member. The heating assembly 92 includes the heater 22, the heating unit 19, which are described in the above embodiments, and the heating belt 120. The fixing roller 93 includes a core 21*a*, an elastic layer 21*b*, and a release layer 21*c*. The core 21*a* is a solid core made of iron. The elastic layer 21*b* coats the circumferential surface of the core 21*a*. The release layer 21*c* coats an outer circumferential surface of the elastic layer 21*b*. In addition, the fixing device 9 includes a pressure assembly 94 opposite the heating assembly 92 via the fixing roller 93. The pressure assembly 94 includes a nip formation pad 95, a stay 96, and a pressure belt 97. The nip formation pad 95 and the stay 96 are inside the loop of the pressure belt 97. The pressure belt 97 is rotatable. The sheet P passes through the fixing nip N2 between the pressure belt 97 and the fixing roller 93 and is applied to heat and pressure, and the image is fixed on the sheet P.

In the fixing device 9 illustrated in FIG. 36, the heating assembly 92 heats the fixing roller 93. When the heater 22 generates a difference in the heat generation amount between one portion and the other portion of the heater 22 in the longitudinal direction (i.e. a depth direction in FIG. 36), the fixing roller 93 also has a temperature difference between one portion and the other portion of the fixing roller 93 in the longitudinal direction of the fixing roller 93.

Accordingly, the fixing device 9 illustrated in FIG. 36 also includes the pressing devices that press one of the fixing roller 93 as the rotator (i.e. the fixing member) and the pressure assembly 94 as an opposite member against the other one of the fixing roller 93 and the pressure assembly 94 or may press both the fixing roller 93 and the pressure assembly 94 so that the fixing roller 93 and the pressure assembly 94 press each other. One of the pressing devices corresponding to the one portion of the heater that generates the larger amount of heat than the other portion of the heater generates the smaller pressing force than the other pressing device corresponding to the other portion of the heater. As a result, the nip pressure in the part of the nip N corresponding to the portion of the heater 22 that generates the larger amount of heat than the other portion of the heater 22 in the longitudinal direction becomes relatively smaller than the nip pressure in the other part of the nip N. In addition, the nip width in the part of the nip N corresponding to the portion of the heater 22 that generates the larger amount of heat than the other portion of the heater 22 in the longitudinal direction becomes relatively smaller than the nip width in the other part of the nip N. Accordingly, the above-described fixing device 9 can prevent the disadvantage caused by the temperature difference between the one end portion and the other end portion in the longitudinal direction of the heater 22. That is, the above-described fixing device 9 can reduce the difference in the fixing property between the one end portion and the other end portion of the image in the longitudinal direction of the image and the unevenness in glossiness of the image in the longitudinal direction. That is, unevenness of the image or the unevenness in glossiness of the image on the sheet can be reduced.

A layout of the electrodes and the like arranged on the base 50 of the heater 22 is not limited to the above embodiments, and the present disclosure may be applied to the heater in which a temperature difference occurs between one portion and the other portion of the heater in the longitudinal direction.

Figure 37:
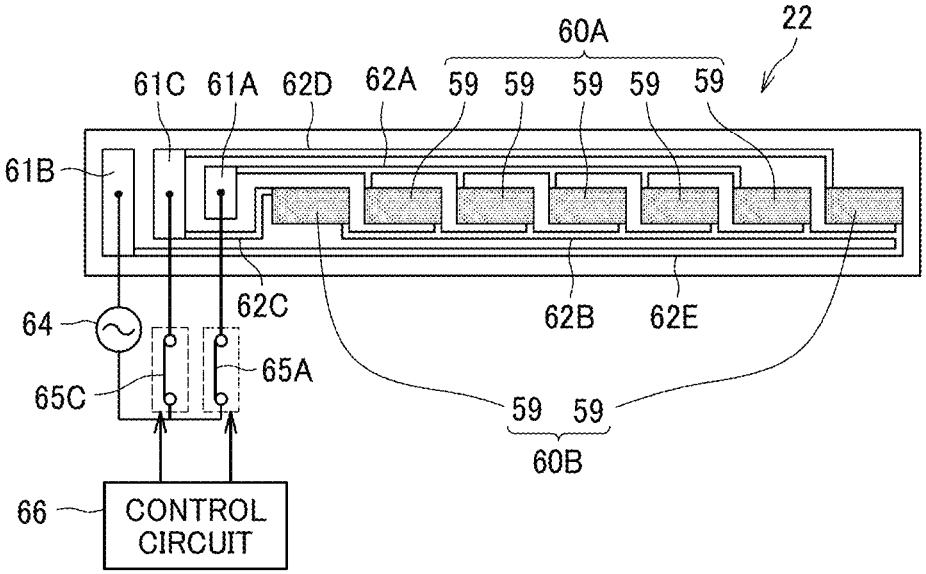
FIG. 37 is a schematic diagram illustrating a circuit to supply power to the heater according to another embodiment of the present disclosure.

For example, FIG. 37 illustrates an example of another heater to which the present disclosure is applied. All electrodes of the heater 22 illustrated in FIG. 37 are arranged on one portion in the longitudinal direction, which is different from the above-described embodiments. That is, the second electrode 61B and other electrodes of the heater 22 in FIG. 37 is disposed on one end portion in the longitudinal direction of the heater 22, which is different from the heater 22 in FIG. 10. As illustrated in FIG. 37, since the second electrode 61B is disposed on one end portion of the heater 22 in the longitudinal direction, the power supply line directly connected to the second electrode 61B extends to the other end portion of the heater 22 in the longitudinal direction and turns back to resistive heat generators 59 to be connected to all resistive heat generators 59. In the present embodiment, the power supply line that connects the second electrode 61B and all resistive heat generators 59 includes the second power supply line 62B that is connected to all resistive heat generators 59 and extends to a turning back position on the other end portion of the heater 22 and a fifth power supply line 62E as the conductor extending from the turning back position to the second electrode 61B on the one end portion of the heater 22 in the longitudinal direction of the heater 22.

The temperature difference in the longitudinal direction as described above occurs in the above heater 22 of FIG. 37 when the first heat generator group 60A is energized and when the first heat generator group 60A and the second heat generator group 60B are energized.

Figure 38:
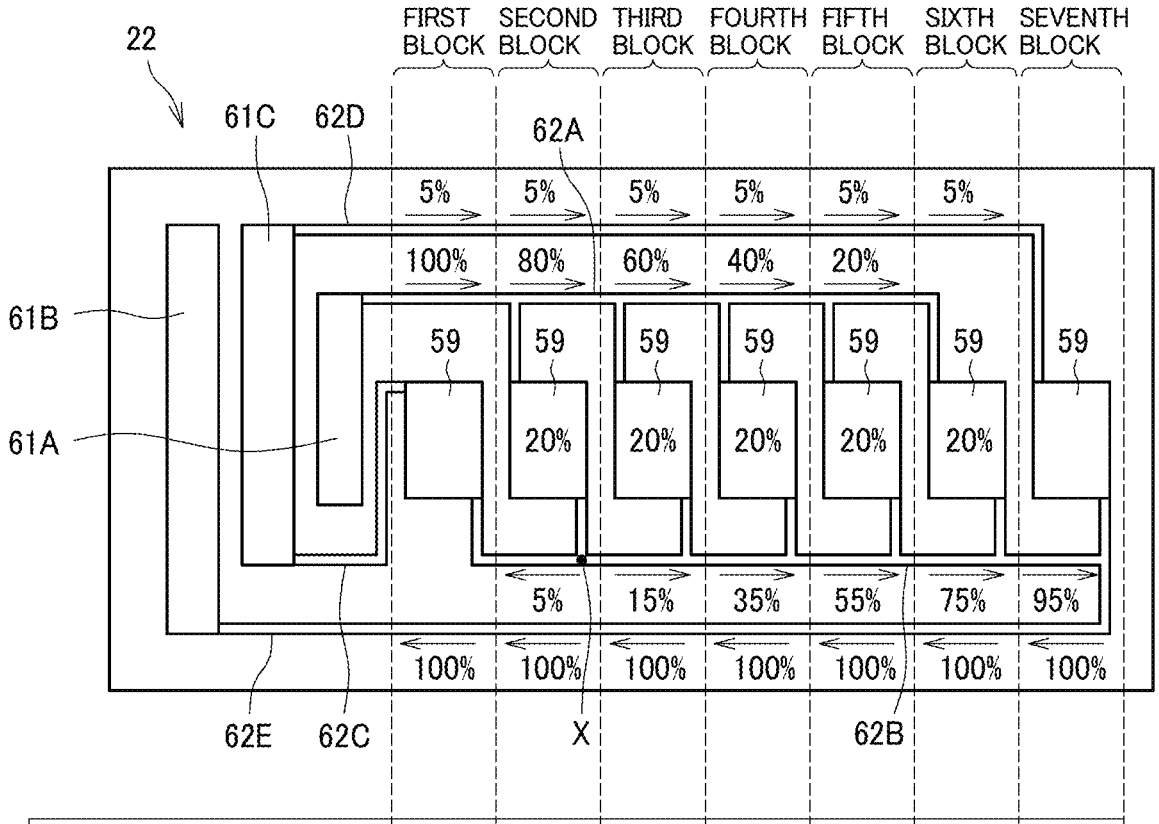
FIG. 38 is an explanatory view illustrating heat generation amounts generated by power supply lines in each block of the heater depicted in FIG. 37 in which the unintended shunt occurs.
Figure 39:
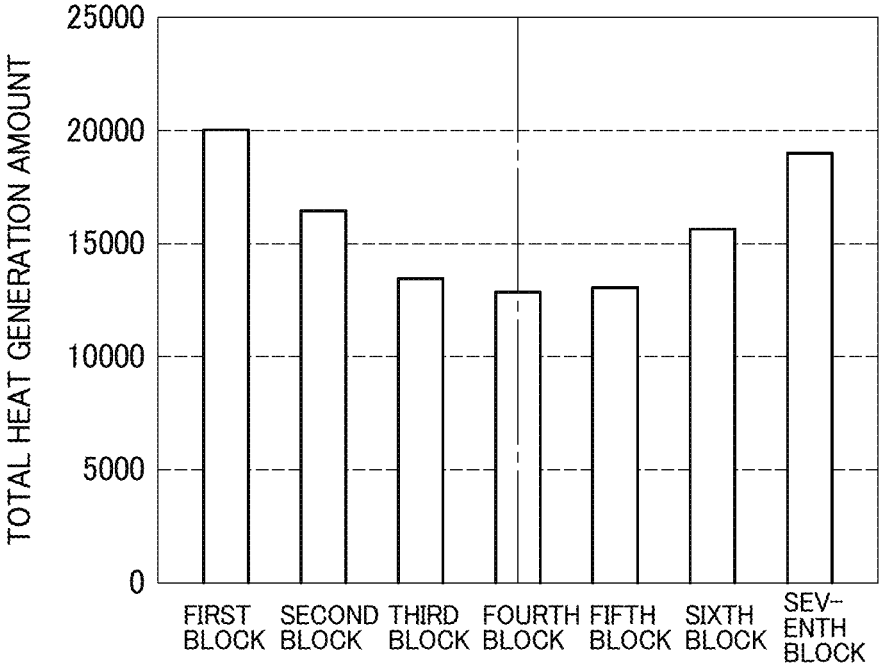
FIG. 39 is a graph illustrating the total heat generation amount generated by the power supply lines in each block of the heater illustrated in FIG. 38.
Figure 40:
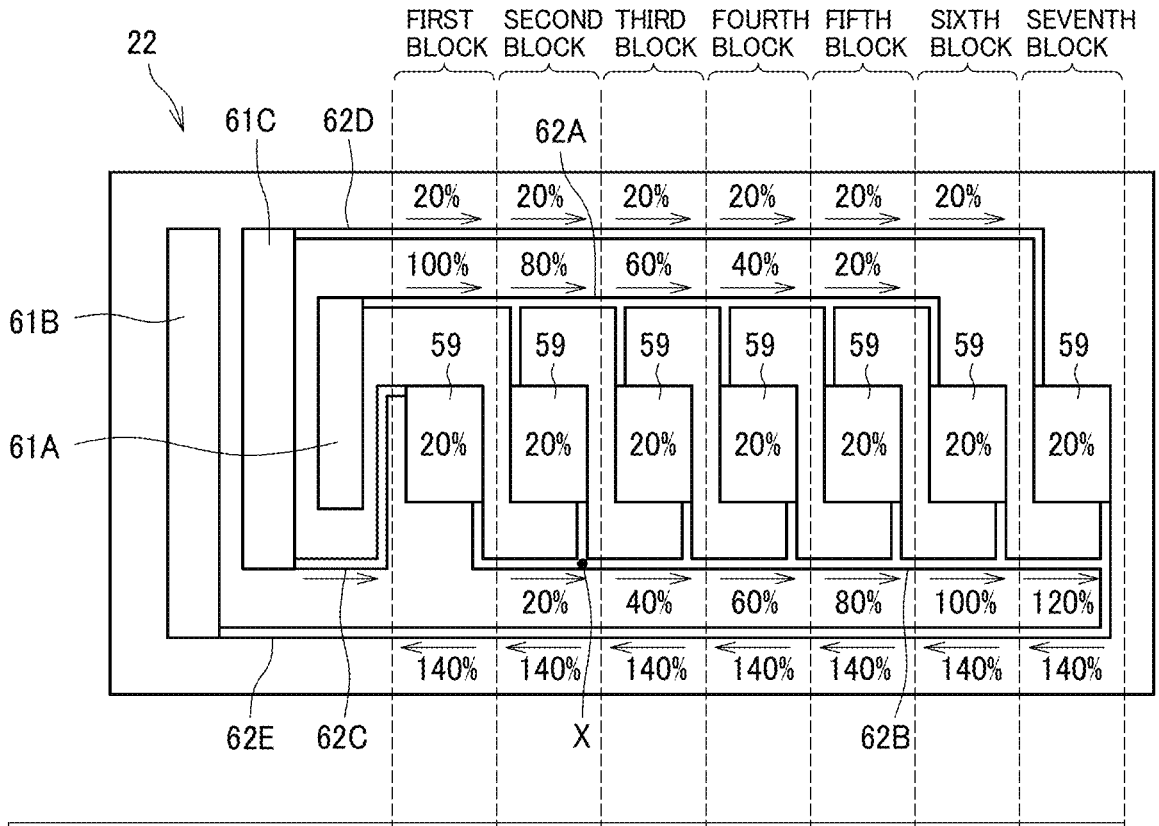
FIG. 40 is an explanatory view illustrating heat generation amounts generated by power supply lines in each block of the heater depicted in FIG. 37 when all heat generator groups are energized.
Figure 41:
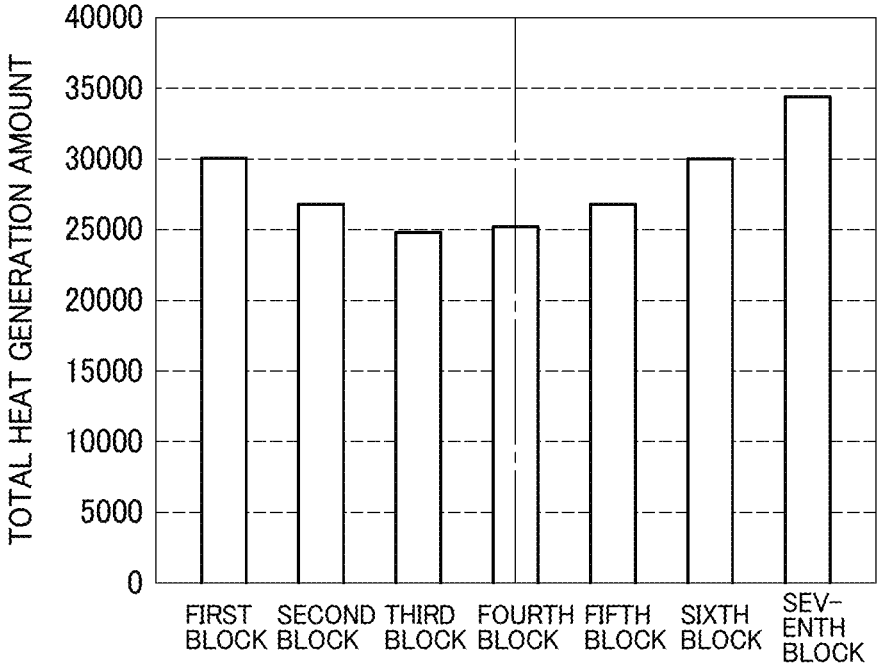
FIG. 41 is a graph illustrating the total heat generation amount generated by the power supply lines in each block of the heater illustrated in FIG. 40.

When only the first heat generator group 60A is energized, the unintended shunt occurs and flows toward the third power supply line 62C, as illustrated in FIGS. 38 and 39. As a result, the distribution of the total heat generation amounts becomes unsymmetrical shape in the lateral direction with respect to the fourth block located in the center of the heat generation area, and the heat generation amount in the one end portion of the heater in the longitudinal direction is larger than the heat generation amount in the other end portion of the heater. When the first heat generator group 60A and the second heat generator group 60B are energized, as illustrated in FIGS. 40 and 41, the distribution of the total heat generation amounts becomes unsymmetrical shape in the lateral direction with respect to the fourth block, and the heat generation amount in the other end portion of the heater in the longitudinal direction is larger than the heat generation amount in the one end portion of the heater.

Similar to the above-described embodiments, one of the pressing devices corresponding to the one portion of the heater that generates the larger amount of heat than the other portion of the heater in the longitudinal direction of the heater generates the smaller pressing force than the other pressing device corresponding to the other portion of the heater. As a result, the nip pressure and the nip width in the part of the nip N corresponding to the portion of the heater 22 that generates the larger amount of heat than the other portion of the heater 22 in the longitudinal direction becomes relatively smaller than the nip pressure and the nip width in the other part of the nip N. Accordingly, the above-described embodiment can prevent the disadvantage caused by the temperature difference between the one portion and the other portion of the heater 22 in the longitudinal direction. That is, the above-described embodiment can reduce the difference in the fixing property between the one end portion and the other end portion of the image in the longitudinal direction of the image and the unevenness in glossiness of the image in the longitudinal direction. That is, unevenness of the image or the unevenness in glossiness of the image on the sheet can be reduced.

A heating device according to the present disclosure is not limited to the fixing device described in the above embodiments. The heating device according to the present disclosure is also applicable to, for example, a heating device such as a dryer to dry ink applied to the sheet, a coating device (a laminator) that heats, under pressure, a film serving as a covering member onto the surface of the sheet such as paper, and a thermocompression device such as a heat sealer that seals a seal portion of a packaging material with heat and pressure. Applying the present disclosure to the above heating device can prevent the disadvantage caused by the temperature difference between the one end portion and the other end portion in the longitudinal direction of the heater.

The sheets P serving as recording media may be thick paper, postcards, envelopes, plain paper, thin paper, coated paper, art paper, tracing paper, overhead projector (OHP) transparencies, plastic film, prepreg, copper foil, and the like.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. Further, features of components of the embodiments, such as the number, the position, and the shape are not limited the embodiments and thus may be preferably set.

What is claimed is:

1. A heating device comprising:

a rotator;

an opposed rotator configured to contact the rotator to form a nip;

a heater configured to heat the rotator, the heater including a first portion and a second portion that generates a smaller amount of heat than the first portion of the heater; and a plurality of pressing devices arranged in a longitudinal direction of the heater and each configured to press at least one of the rotator and the opposed rotator and cause the rotator and the opposed rotator to press each other, the pressing devices including:

a first pressing device corresponding to the first portion of the heater; and a second pressing device corresponding to the second portion of the heater, the first pressing device being configured to generate a smaller pressing force than the second pressing device.

2. The heating device according to claim 1, wherein the first pressing device is configured to generate a smaller nip pressure on a first part of the nip corresponding to the first portion of the heater than a second part of the nip corresponding to the second portion of the heater.

3. The heating device according to claim 1, wherein the first pressing device is configured to generate a smaller nip width on a first part of the nip corresponding to the first portion of the heater than a second part of the nip corresponding to the second portion of the heater.

4. The heating device according to claim 1, wherein the heater includes a first heat generator group including at least one resistive heat generator, a second heat generator group including at least two resistive heat generators outside the first heat generator group at both end sides of the heater in the longitudinal direction of the heater, a plurality of conductors, a first electrode coupled to the first heat generator group via at least one of the conductors, a second electrode coupled to the first heat generator group and the second heat generator group via at least one of the conductors, and a third electrode coupled to the second heat generator group via at least one of the conductors.

5. An image forming apparatus comprising the heating device according to claim 1, wherein the first pressing device is configured to generate the smaller pressing force after the image forming apparatus starts an image forming operation.

6. An image forming apparatus comprising the heating device according to claim 1, wherein the first pressing device is configured to generate the smaller pressing force after a predetermined number of recording media passes through the heating device.

7. An image forming apparatus comprising the heating device according to claim 1, wherein the first pressing device is configured to generate the smaller pressing force after a predetermined time has passed since the image forming apparatus starts an image forming operation.

8. An image forming apparatus comprising the heating device according to claim 1, wherein the first pressing device and the second pressing device are configured to press one longitudinal side and the other longitudinal side, respectively, of the at least one of the rotator and the opposed rotator with a same pressing force after the image forming apparatus ends an image forming operation.

9. The heating device according to claim 1, wherein the heater includes at least one resistive heat generator, and wherein, in a short-side direction that is different from a thickness direction of the heater and orthogonal to the longitudinal direction of the heater, a ratio of a short-side dimension of the at least one resistive heat generator to a short-side dimension of the heater is 25% or more.

10. The heating device according to claim 1, wherein the heater includes at least one resistive heat generator, and wherein, in a short-side direction that is different from a thickness direction of the heater and orthogonal to the longitudinal direction of the heater, a ratio of a short-side dimension of the at least one resistive heat generator to a short-side dimension of the heater is 40% or more.

11. A fixing device comprising the heating device according to claim 1.

12. An image forming apparatus comprising the heating device according to claim 1.

13. A heating device comprising:

a rotator;

an opposed rotator configured to contact the rotator to form a nip;

a heater configured to heat the rotator, the heater including:

a first heat generator group including at least one resistive heat generator;

a second heat generator group including at least two resistive heat generators outside the first heat generator group at both end sides of the heater in a longitudinal direction of the heater;

a plurality of conductors;

a first electrode coupled to the first heat generator group via at least one of the conductors;

a second electrode coupled to the first heat generator group and the second heat generator group via at least one of the conductors; and a third electrode coupled to the second heat generator group via at least one of the conductors; and a plurality of pressing devices arranged in the longitudinal direction of the heater and each configured to press at least one of the rotator and the opposed rotator and cause the rotator and the opposed rotator to press each other, the pressing devices including:

a first pressing device disposed on a first portion corresponding to the first electrode; and a second pressing device disposed on a second portion that is different from the first portion in the longitudinal direction of the heater, the first pressing device being configured to generate a larger pressing force than the second pressing device when both of the first heat generator group and the second heat generator group are energized and generate a smaller pressing force than the second pressing device when the first heat generator group is energized and the second heat generator group is not energized.

14. A fixing device comprising the heating device according to claim 13.

15. An image forming apparatus comprising the heating device according to claim 13.

16. The heating device according to claim 13, further comprising:

a controller configured to, control a motor to actuate a first cam to press the first pressing device with the larger pressing force compared to the second pressing device when both of the first heat generator group and the second heat generator group are energized, and control the motor to actuate the first cam to press the first pressing device with the smaller pressing force compared to the second pressing device when the first heat generator group is energized and the second heat generator group is not energized.

17. A heating device comprising:

a rotator;

an opposed rotator configured to contact the rotator to form a nip;

a heater configured to heat the rotator;

a plurality of temperature detectors facing the rotator and including:

a first temperature detector facing the rotator and disposed corresponding to one side of the heater in a longitudinal direction of the heater; and a second temperature detector facing the rotator and disposed corresponding to the other side of the heater in the longitudinal direction of the heater; and a plurality of pressing devices arranged in the longitudinal direction of the heater and each configured to press at least one of the rotator and the opposed rotator and cause the rotator and the opposed rotator to press each other, the pressing devices including:

a first pressing device disposed corresponding the first temperature detector; and a second pressing device disposed corresponding to the second temperature detector, wherein the first pressing device is configured to press the at least one of the rotator and the opposed rotator with a smaller pressing force than the second pressing device when a temperature detected by the first temperature detector is higher than a temperature detected by the second temperature detector and a temperature difference between the temperature detected by the first temperature detector and the temperature detected by the second temperature detector is equal to or larger than a predetermined value, and wherein the second pressing device is configured to press the at least one of the rotator and the opposed rotator with a smaller pressing force than the first pressing device when the temperature detected by the second temperature detector is higher than the temperature detected by the first temperature detector and the temperature difference between the temperature detected by the first temperature detector and the temperature detected by the second temperature detector is equal to or larger than the predetermined value.

18. A fixing device comprising the heating device according to claim 17.

19. An image forming apparatus comprising the heating device according to claim 17.

* * * * *